US011364425B1

(12) United States Patent
Hodge et al.

(10) Patent No.: US 11,364,425 B1
(45) Date of Patent: Jun. 21, 2022

(54) BALL BAT HAVING ASYMMETRICAL BARREL COMPOSITION OR CONSTRUCTION

(71) Applicant: Baden Sports, Inc., Renton, WA (US)

(72) Inventors: Kyle Louis Hodge, Seattle, WA (US); Grant Farrell Douglas, Seattle, WA (US); Blair Jack Ellington, Redmond, WA (US); William B. Giannetti, Mission Viejo, CA (US); Jay Michael Helmick, Seattle, WA (US); Hugh Linton Tompkins, Seattle, WA (US); Brent Mathew Weidenbach, Seattle, WA (US)

(73) Assignee: Baden Sports, Inc., Renton, WA (US)

( * ) Notice: Subject to any disclaimer, the term of this patent is extended or adjusted under 35 U.S.C. 154(b) by 0 days.

(21) Appl. No.: 16/805,064

(22) Filed: Feb. 28, 2020

Related U.S. Application Data

(60) Provisional application No. 62/875,826, filed on Jul. 18, 2019, provisional application No. 62/812,178, filed on Feb. 28, 2019.

(51) Int. Cl.
*A63B 59/58* (2015.01)
*A63B 60/54* (2015.01)
*A63B 59/51* (2015.01)

(52) U.S. Cl.
CPC ..... *A63B 59/58* (2015.10); *A63B 59/51* (2015.10); *A63B 60/54* (2015.10); *A63B 2209/02* (2013.01)

(58) Field of Classification Search
CPC ..... A63B 59/50; A63B 59/51; A63B 59/54; A63B 59/55; A63B 59/56; A63B 59/58; A63B 2206/02; A63B 59/52; A63B 2102/18; A63B 2102/182; A63B 2109/00; A63B 2109/02; A63B 2109/023
USPC ..... 473/564, 566, 567
See application file for complete search history.

(56) References Cited

U.S. PATENT DOCUMENTS

| | | | | |
|---|---|---|---|---|
| 3,697,069 | A * | 10/1972 | Merola | A63B 60/16 473/566 |
| 3,876,204 | A | 4/1975 | Moore et al. | |
| 5,676,610 | A * | 10/1997 | Bhatt | A63B 59/56 473/566 |
| 5,759,113 | A | 6/1998 | Lai et al. | |
| 6,042,485 | A | 3/2000 | Cheng | |
| 6,042,493 | A * | 3/2000 | Chauvin | A63B 59/51 473/566 |
| 6,565,462 | B1 * | 5/2003 | Gregg | A63B 69/0002 124/5 |
| 6,612,945 | B1 | 9/2003 | Anderson | |
| 6,764,419 | B1 * | 7/2004 | Giannetti | A63B 59/54 473/567 |
| 6,949,038 | B2 | 9/2005 | Fritzke | |
| 7,115,054 | B2 | 10/2006 | Giannetti et al. | |
| 7,384,354 | B2 * | 6/2008 | Giannetti | A63B 59/54 473/567 |

(Continued)

*Primary Examiner* — Joseph B Baldori
(74) *Attorney, Agent, or Firm* — Lowe Graham Jones PLLC

(57) ABSTRACT

Embodiments are directed toward a bat, such as a softball or baseball bat, that includes a handle and a barrel. The barrel is preferably coupled to the handle. The barrel preferably defines a longitudinal axis. The barrel preferably has asymmetrical composition or construction about the longitudinal axis of the barrel.

17 Claims, 43 Drawing Sheets

(56) References Cited

U.S. PATENT DOCUMENTS

| | | | | |
|---|---|---|---|---|
| 7,442,135 | B2 * | 10/2008 | Giannetti | A63B 60/54 473/567 |
| 7,867,114 | B2 * | 1/2011 | Sutherland | A63B 59/50 473/567 |
| 7,878,930 | B2 * | 2/2011 | Leinert | A63B 59/50 473/568 |
| 7,883,434 | B2 * | 2/2011 | Davis | A63B 59/51 473/567 |
| 8,512,176 | B1 | 8/2013 | Mathew et al. | |
| 8,814,733 | B2 | 8/2014 | Tsukamoto et al. | |
| 8,992,352 | B1 * | 3/2015 | Lindsay | A63B 59/50 473/566 |
| 9,211,460 | B2 | 12/2015 | Slater et al. | |
| 9,238,163 | B2 | 1/2016 | Slater et al. | |
| 9,242,155 | B1 * | 1/2016 | Lindsay | A63B 59/50 |
| 9,498,690 | B2 | 11/2016 | Carlson et al. | |
| 10,265,595 | B1 * | 4/2019 | Stenzler | A63B 60/42 |
| 2005/0070384 | A1 | 3/2005 | Fitzgerald et al. | |
| 2006/0025253 | A1 * | 2/2006 | Giannetti | A63B 60/00 473/567 |

* cited by examiner

BALL BAT HAVING ASYMMETRICAL BARREL COMPOSITION OR CONSTRUCTION

CROSS-REFERENCE TO RELATED APPLICATIONS

This application claims the benefit of U.S. Provisional Application No. 62/812,178, filed Feb. 28, 2019, titled "Non-cylindrical Baseball Bat", and U.S. Provisional Application No. 62/875,826, filed Jul. 18, 2019, titled "Ball bat with circumferentially asymmetric composite materials", which are hereby incorporated by reference in their entirety.

FIELD OF THE INVENTION

The invention relates generally to bats such as baseball or softball bats having asymmetrical barrel composition and, more particularly, to baseball or softball bats having a hitting barrel face and a non-hitting barrel face that has a different composition than the hitting face.

BACKGROUND OF THE INVENTION

The rules of baseball and softball require cylindrical barrels for bats. For this reason, the inner and outer walls of bat barrels typically include symmetrical construction and composition about the longitudinal axis of the bats along the entire lengths of the barrels, and the barrels generally have equal performance and durability on all faces around the circumference of the barrels. Some bats are made entirely of wood, whereas others are non-wood bats. Non-wood bats include metal or composite barrels. The outer walls of metal barrels typically include aluminum or an alloy about the entire circumference of the barrel along the entire length of the barrel. The outer walls of composite barrels typically include layers of carbon or glass fibers combined with a resin matrix about the entire circumference of the barrel along the entire length of the barrel.

The rules of baseball and softball also limit the maximum allowed performance of bats, such as the bat-ball coefficient of restitution ("BBCOR"), the batted-ball speed ("BBS"), or other batted ball performance measures. Both the BBCOR and the BBS are measures of the bat barrel's efficiency in transferring energy from and to the ball based on the bat barrel's elasticity. Manufacturers of non-wood bats typically stiffen the barrels to make the bats comply with the performance-limiting rules. Manufacturers often stiffen barrels by adding stiffeners, such as rings, inside the barrel or by increasing the thickness of the barrel walls. Both approaches to make the bats comply with the rules increase the weight of the bat and, thus, increase the moment of inertias ("MOIs") of the bats, which can negatively impact player performance, such as the ability to consistently repeat the same swing. The drop-weight of a barrel can be reduced by reducing the diameter of the barrel, yet players prefer bats with larger barrel diameters. In addition, manufacturers of composite barrels typically orient the fibers circumferentially or substantially circumferentially about the longitudinal axis of the bat about the entire circumference of the barrel and along the entire length of the barrel to increase the stiffness of the barrel to comply with the performance-limiting rules. Stiffening the barrel tends to increase the amount of vibration felt by the player's hands gripping the bat handle, thereby causing player discomfort, such as a sting or shock to the hands.

Associations, such as the National Collegiate Athletic Association ("NCAA") or the National Federation of State High School Associations ("NFHS"), evaluate bat performance metrics, such as the BBCOR or BBS, to approve baseball and softball bats for use in competitive games to ensure that all bats are fair and safe for gameplay. As the resin bonds between the fibers and binder in a composite barrel break down over the life of a bat, the performance of the bat increases and can exceed the allowable performance limits even if the bat complied with the rules at the time of first purchase. The NCAA developed and the associations use the Accelerated Break-In ("ABI") procedure to evaluate a bat's performance across at least a portion of its durable life and, thus, determine whether the bat is expected to comply with the rules for the bat's durable life. The ABI procedure involves "rolling" the barrel between two nylon wheels, under the force of a load frame, to radial depths (measured in distance from the longitudinal axis of the bat) ranging from 0.02"-0.50". The force of the nylon wheels accelerates the breakdown of the composite bat barrel. The ABI procedure attempts to simulate the breakdown of the bat barrel over the bat's durable life. In many cases, the combination of bat-performance metric testing and the ABI procedure continues until the bat shows signs of visible damage. The ABI procedure fails to protect against players tampering with bats to increase bat performance in environments beyond intended bat use. For example, some players attempt to increase the performance of composite bats by performing a tampering process, such as the process of rolling as described above. Other players attempt to increase the performance of bats by performing a tampering process known as "shaving", which involves removing composite material from the inner wall of the barrel to increase the BBCOR or BBS.

SUMMARY OF THE INVENTION

It is therefore an object of the present invention to provide baseball or softball bats that have reduced drop weights or MOIs for a given BBCOR or BBS.

It is also an object of the present invention to provide baseball or softball bats that achieve the above object and that also decrease the amount of vibration felt by player's hands when gripping the bat handles.

It is another object of the present invention to provide baseball or softball bats that achieve the above objects and that also prevent increased bat performance from tampering by rolling or shaving.

The invention achieves the above objects, as well as other objects and advantages that will become apparent from the description that follows, by providing a barrel for a softball or baseball bat. The bat preferably has a handle and the barrel coupled to the handle. The barrel preferably defines a longitudinal axis. The barrel preferably has an asymmetrical composition or construction about the longitudinal axis of the barrel.

The barrel preferably has a hitting face and a non-hitting face. One or more portions of the non-hitting face preferably have a different composition or construction than one or more portions of the hitting face. The one or more portions of the non-hitting face are preferably disposed at the same longitudinal position along the longitudinal axis as the one or more portions of the hitting face. The one or more portions of the non-hitting face are preferably disposed opposite the longitudinal axis from the one or more portions of the hitting face.

In some versions, the non-hitting face includes one or more materials that are absent from the hitting face. The hitting face preferably includes plies having fiber bundles disposed substantially orthogonal to the longitudinal axis. The non-hitting face preferably includes plies having fiber bundles disposed substantially parallel to the longitudinal axis.

The non-hitting face preferably includes more plies having fiber bundles disposed substantially parallel to the longitudinal axis than the hitting face (i.e., the hitting face has fewer plies having fiber bundles disposed substantially parallel to the longitudinal axis).

In some versions, one or more portions of the non-hitting face have a different thickness than one or more portions of the hitting face. The barrel preferably includes a barrel shell that defines the hitting face. The non-hitting face preferably includes an insert coupled to the barrel shell.

In some versions, the insert includes a cap. The insert preferably includes a characteristic-modifying sheet. In some versions, the insert includes a shaft. The barrel shell preferably defines an opening or void disposed in the non-hitting face. In some versions, the insert is at least partially disposed in the opening or void of the barrel shell.

The hitting face of the barrel is preferably devoid of one or more features, characteristics, or elements in the non-hitting face of the barrel. In some versions, the non-hitting face is devoid of one or more features, characteristics, or elements in the hitting face of the barrel.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
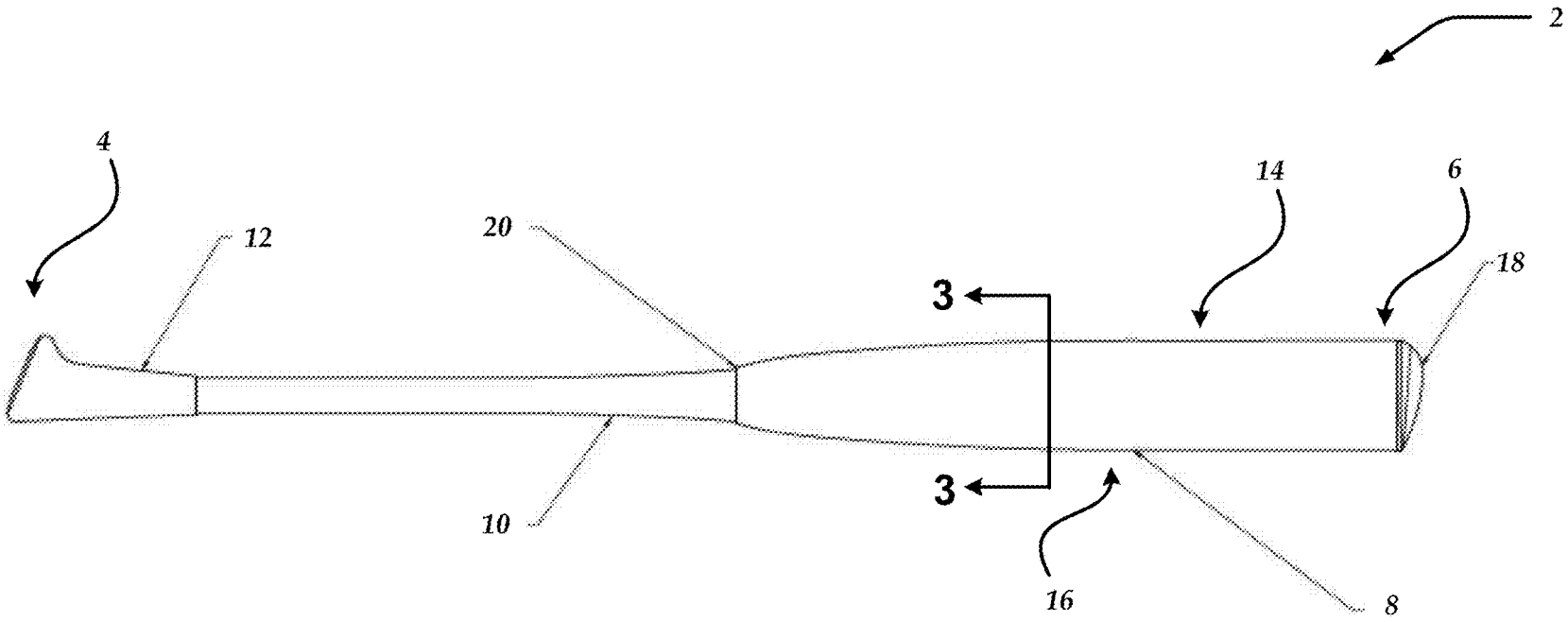
FIG. 1 is an isometric side elevational view of a preferred baseball or softball bat.
Figure 2:
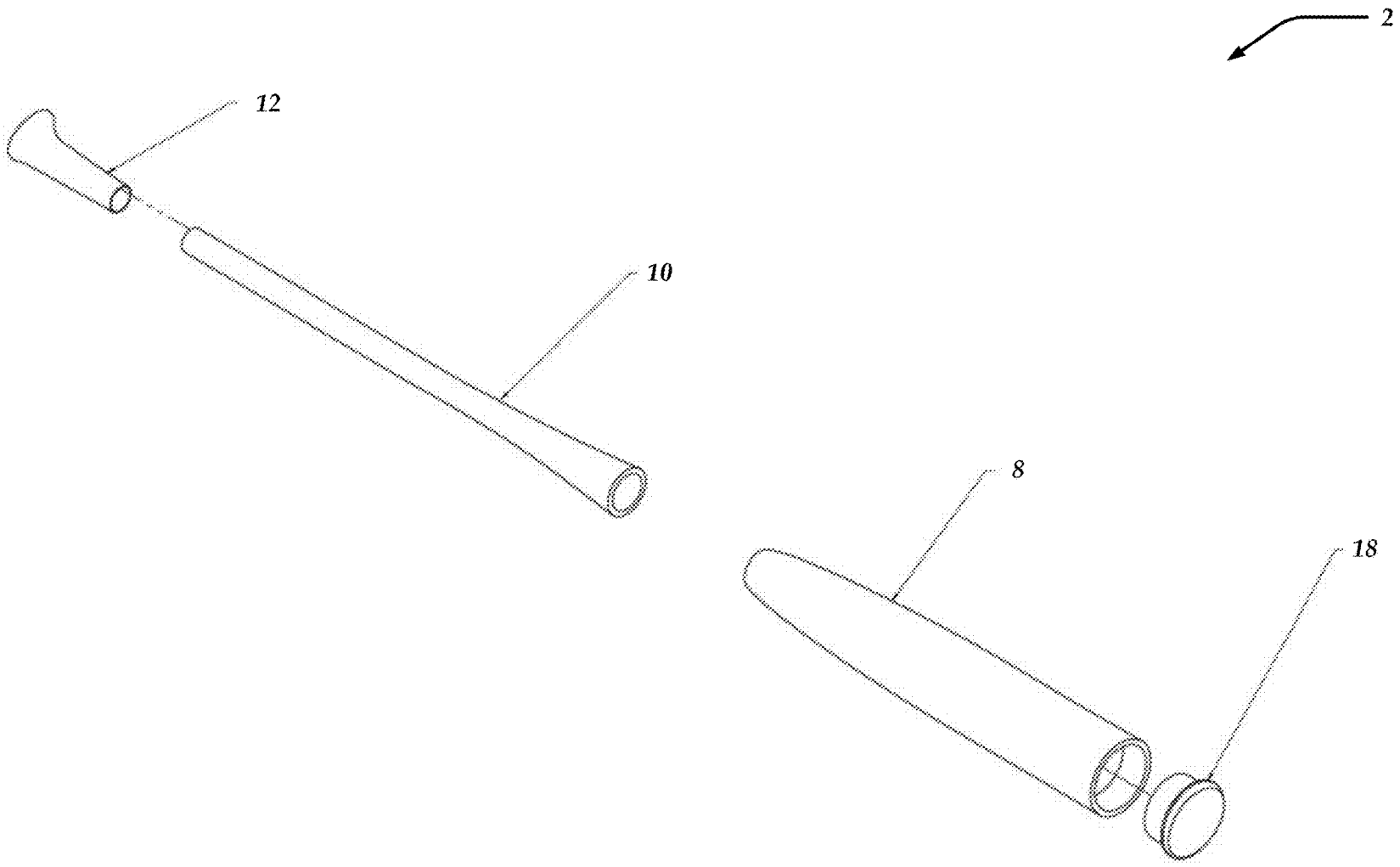
FIG. 2 is an isometric exploded view of the bat of FIG. 1.
Figure 3:
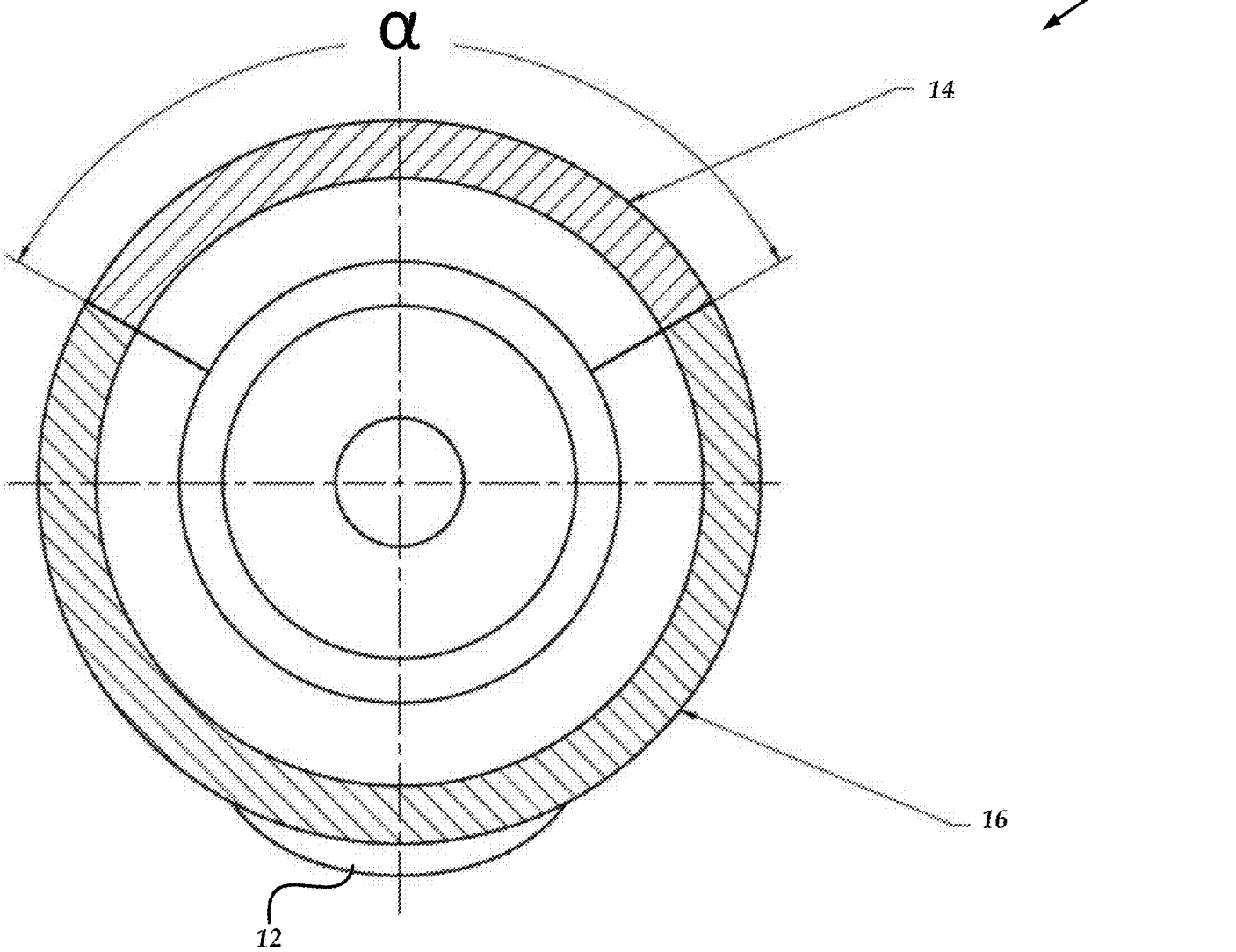
FIG. 3 is a cross-sectional view of the bat of FIG. 1, taken along the line 3-3 in FIG. 1.

FIG. 1 shows a preferred baseball or softball bat 2 in accordance with the principles of the invention. The bat 2 preferably has a proximal end portion 4 that the player's hands may grip and a distal end portion 6 that is opposite the proximal end portion 4. The bat 2 preferably has a barrel 8 and a handle 10. One or more characteristics of the bat 2 are preferably configured to induce the player to grip the bat 2 with substantially the same orientation each time the player grips the bat 2 to swing during competitive game play. The handle 10 preferably defines such a characteristic. The handle 10 preferably has a grip or knob 12 that has an asymmetrical shape about the longitudinal axis of the bat 2. The bat 2 is configured to strike the ball on a hitting face 14 during regular game play and is not configured to strike the ball on a spine or non-hitting face 16 that is opposite the hitting face 14. The hitting face 14 and the non-hitting face 16 preferably have different compositions or constructions from each other. The bat 2 preferably has an end cap 18 and a transition region disposed between the handle 10 and a sweet spot in the barrel 8. As shown in FIG. 2, the components of the bat 2 may be distinct components that are coupled to each other. In other versions, two or more of the components of the bat 2 are integral for each other, such as a single-piece metal bat or an entirely composite bat. Appropriate metals include one or more of aluminum, aluminum alloy, titanium alloy, scandium alloy, steel, or others. As shown in FIG. 3, the non-hitting face preferably includes a circumferential portion of the barrel 8 that covers an angle $\alpha$ of the circumference of the barrel 8, such as 180, 150, 120, or less degrees.

Figure 4:
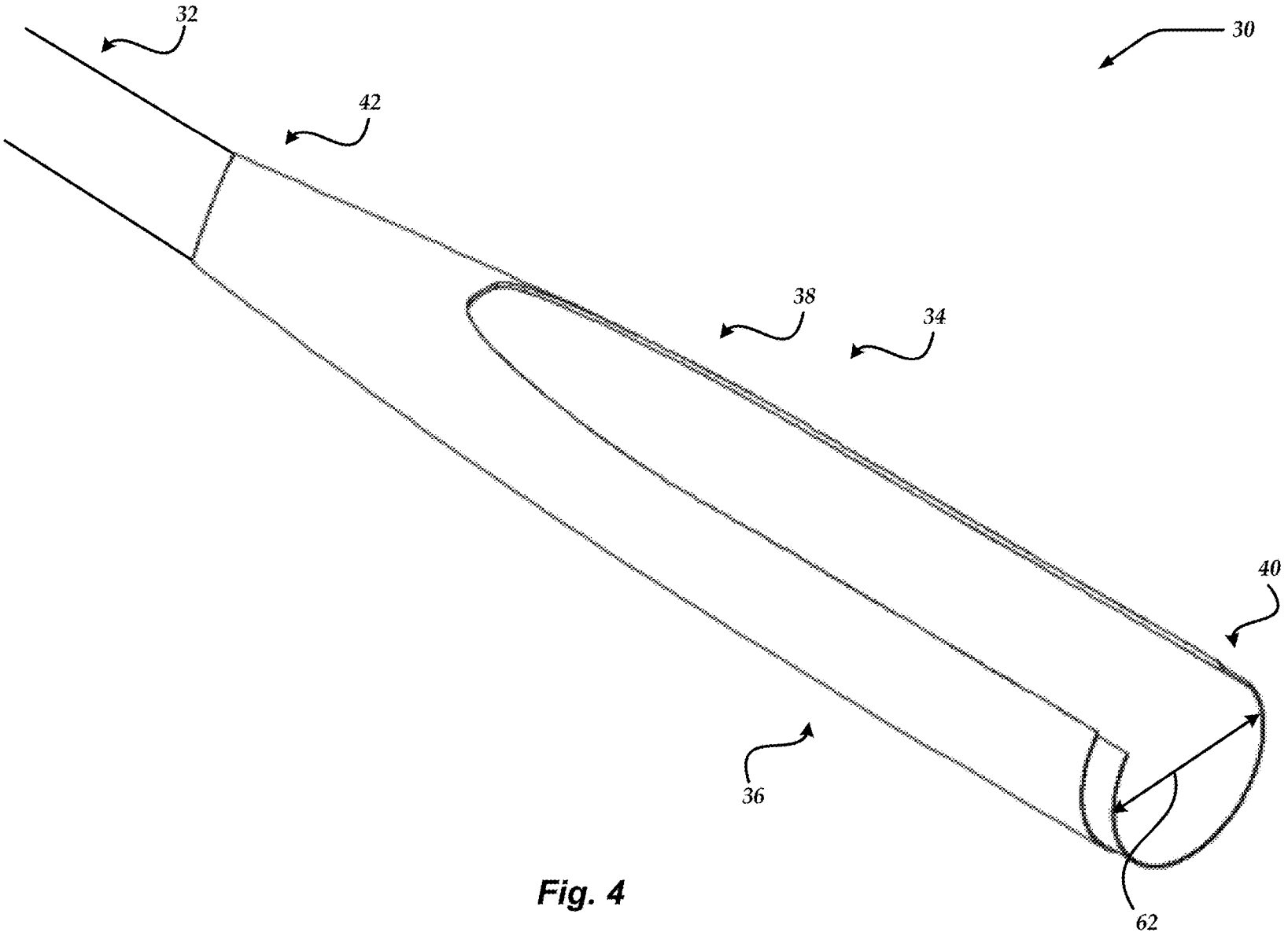
FIG. 4 is a perspective view of a preferred barrel and handle portion of a baseball or softball bat.

FIG. 4 shows a preferred integral barrel and handle portion 30 of a baseball or softball bat in accordance with the principles of the invention. The barrel and handle portion 30 preferably defines a handle or handle portion 32 and a barrel shell 34. The barrel shell 34 and the handle portion 32 preferably have a thin wall of material, such as aluminum. The wall is preferably too thin for a bat to pass performance tests based on the rules of baseball or softball, such as a thickness of 1-4 mm. The barrel shell 34 preferably has a hitting face 36 and a non-hitting face 38. A portion of or the entirety of the non-hitting face 38 of the barrel shell 34 is preferably devoid of the material of the barrel shell wall. The shell wall material is preferably cut out or otherwise removed from such portions of the non-hitting face 38 of the barrel shell 34 after forming the barrel shell 34. In other versions, the barrel shell 34 is formed with the portions of the non-hitting face 38 being devoid of the shell wall material without subsequent removal of the material. As shown in FIG. 3, the portion of the non-hitting face 38 of the barrel shell 34 that is devoid of the shell wall material extends from the distal end portion 40 to the transition portion 42. The portion of the non-hitting face 38 of the barrel shell 34 that is devoid of the shell wall material preferably defines approximately one third of the outer circumference of the barrel shell 34.

Figure 5:
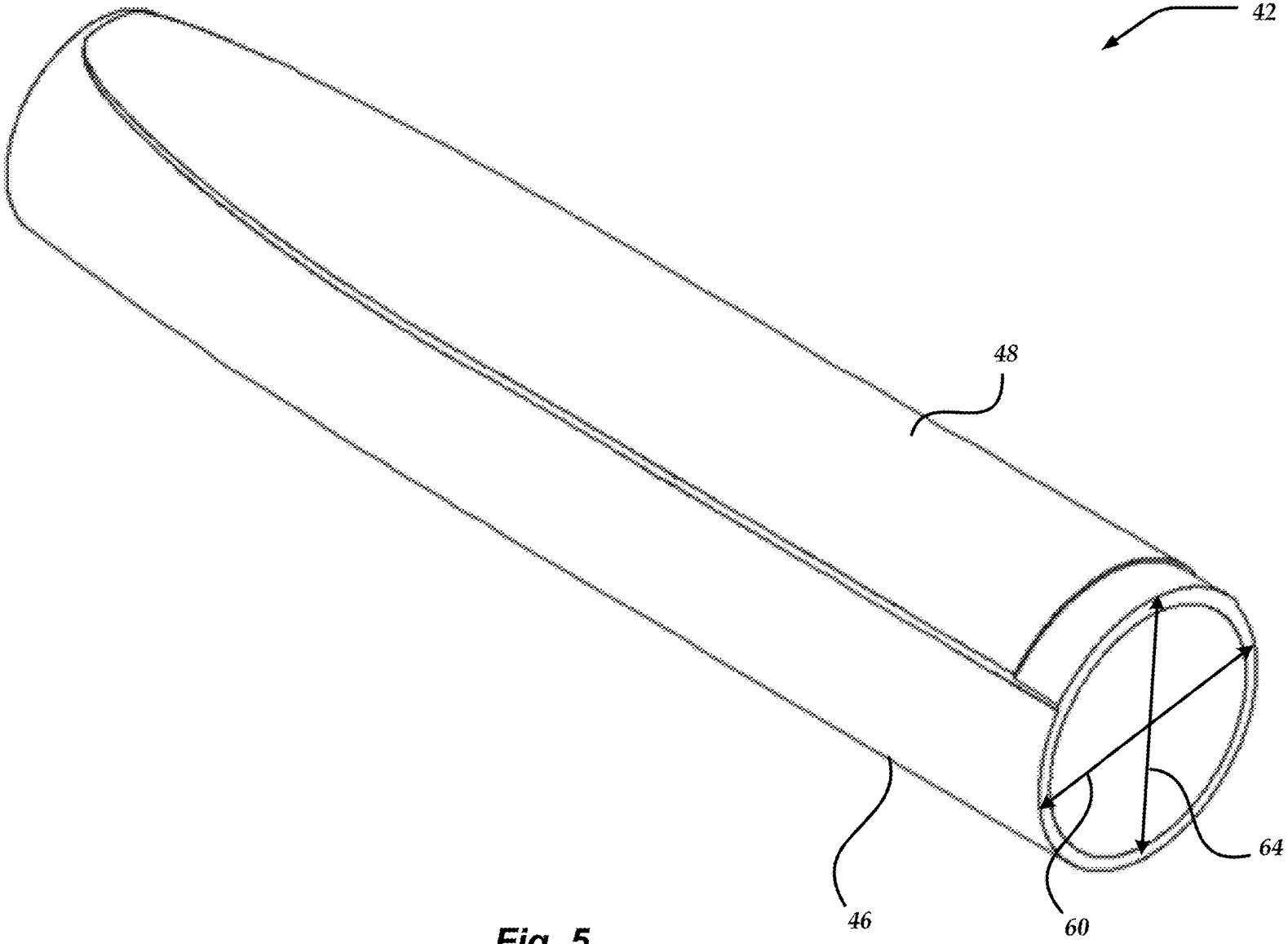
FIG. 5 is a perspective view of a preferred insert.
Figure 6:
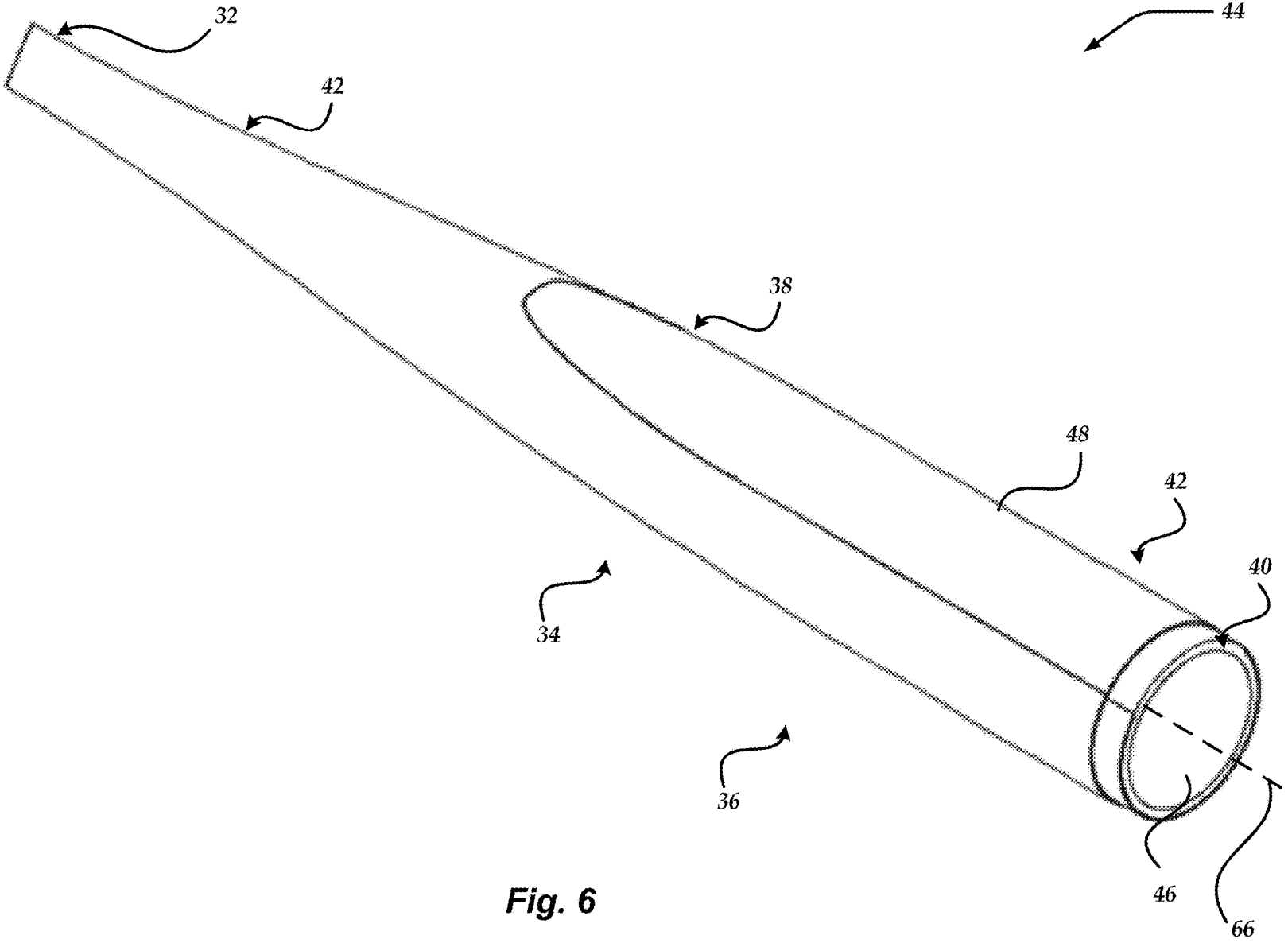
FIG. 6 is a perspective view of a preferred barrel that includes the barrel and handle portion of FIG. 4 and the insert of FIG. 5.

FIG. 5 shows a preferred barrel insert 42 in accordance with the principles of the invention. The barrel insert 42 preferably includes different material than the barrel shell 34, such as one or more thermoplastic materials (for example, polycarbonate), thermoset materials, or a polymer matrix composite material. The material of the barrel insert 42 is preferably lighter than the material of the barrel shell 34. The barrel insert 42 is preferably configured to couple to the barrel shell 34 and fill in the portions of the barrel shell 34 that are devoid of the shell wall material and thereby provide a cylindrical barrel 44, as shown in FIG. 6. The insert 42 preferably has a generally cylindrical body 46. The body 46 preferably defines a protrusion 48. The protrusion 48 is preferably configured to be received by a corresponding portion of the non-hitting face 38 of the barrel shell 34 that is devoid of the shell wall material. The body 46 preferably has an outer diameter 60 that substantially matches the inner diameter 62 of the barrel shell 34, except that the insert 42 preferably has a diameter 64 as measured at the protrusion 48 that substantially matches the inner diameter of the barrel shell 34 plus the thickness of the barrel shell wall. Accordingly, the outer surface of the protrusion 48 is preferably configured to be flush with the outer surface of the barrel shell 34 when the insert 42 is coupled to the barrel shell 34 (see FIG. 6).

As shown in FIG. 6, the construction and composition of the barrel 44 is preferably asymmetrical about the longitudinal axis 66 of the barrel 44. The barrel insert 42 preferably reduces the performance of the barrel 44 (for example, BBCOR, BBS, or others) as compared to a barrel having a barrel shell with the same wall thickness and material as the barrel shell 34 yet with the shell wall extending entirely around the circumference of the barrel and lacking the barrel insert 42. A bat having the barrel 44 preferably has a lower weight than a bat having a barrel shell with the same wall thickness and material as the barrel shell 34 yet with the shell wall extending entirely around the circumference of the barrel and lacking the barrel insert 42. The insert 42 preferably improves the durability of the barrel 44 by limiting the deflection of the barrel shell 34.

Figure 7:
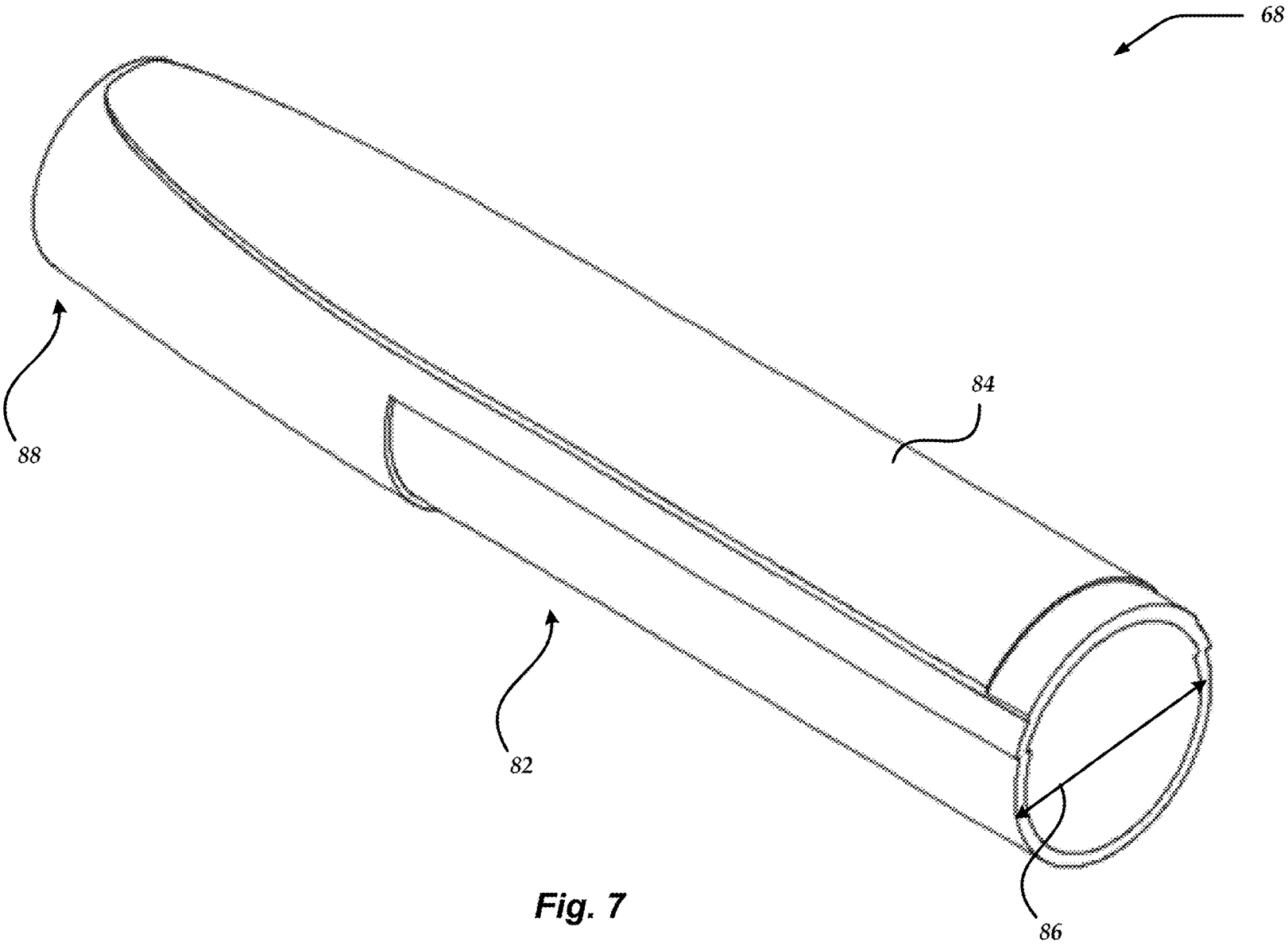
FIG. 7 is a perspective view of a preferred insert.
Figure 8:
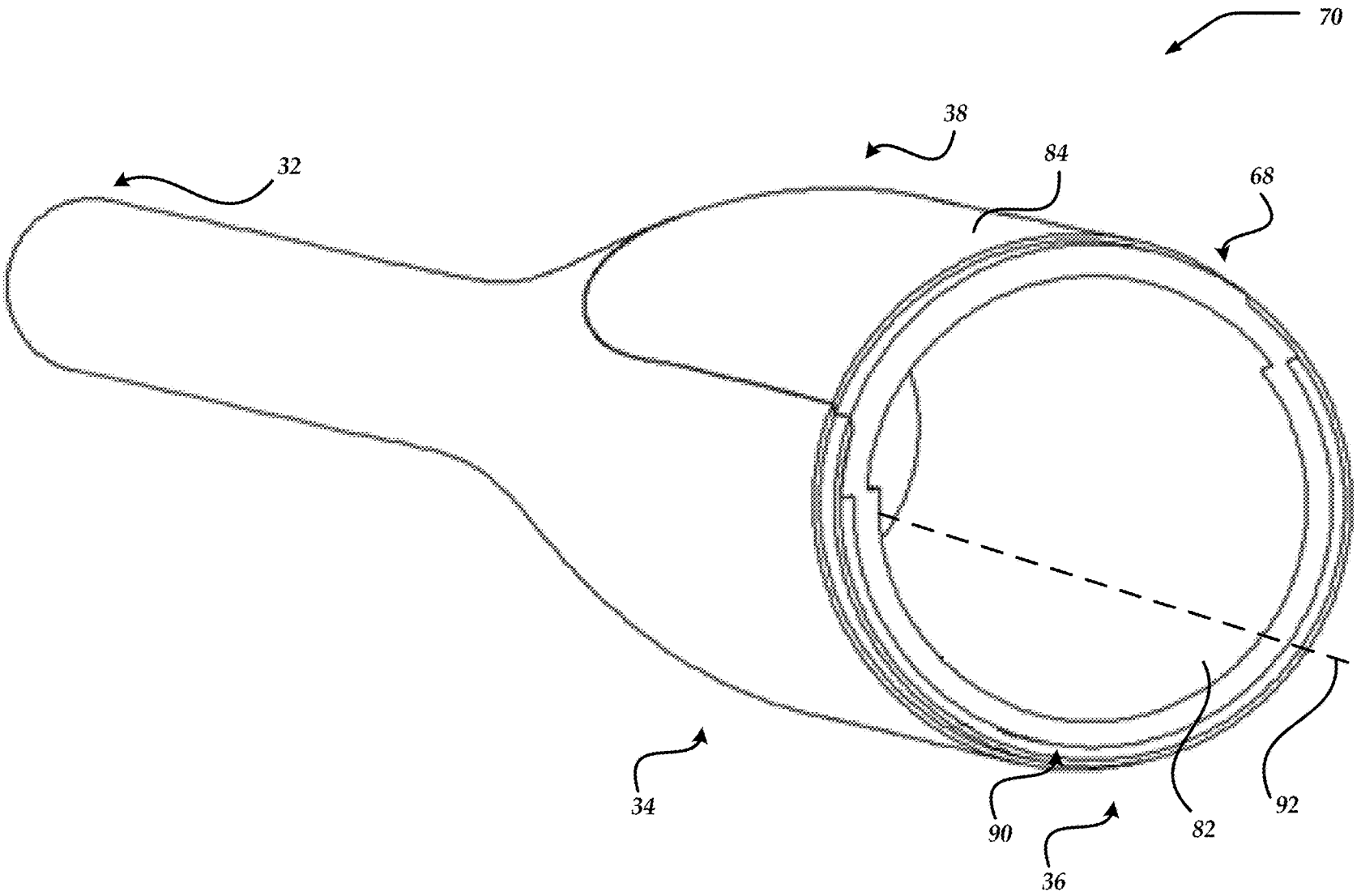
FIG. 8 is a perspective view of a preferred barrel that includes the barrel and handle portion of FIG. 4 and the insert of FIG. 7.

FIG. 7 shows a preferred barrel insert 68 in accordance with the principles of the invention. The barrel insert 68 preferably includes different material than the barrel shell 34, such as one or more thermoplastic materials (for example, polycarbonate), thermoset materials, or a polymer matrix composite material. The material of the barrel insert 68 is preferably lighter than the material of the barrel shell 34. The barrel insert 68 is preferably configured to couple to the barrel shell 34 and fill in the portions of the barrel shell 34 that are devoid of the shell wall material and thereby provide a cylindrical barrel 70, as shown in FIG. 8. The insert 68 preferably has a generally cylindrical body 82. The body 82 preferably defines a protrusion 84. The protrusion 84 is preferably configured to be received by a corresponding portion of the non-hitting face 38 of the barrel shell 34 that is devoid of the shell wall material. At least a portion of the body 82 preferably has an outer diameter 86 that is less than the inner diameter 62 of the barrel shell 34. A portion of the body 82, such as the proximal end portion 88, preferably has an outer diameter that substantially matches the inner diameter 62 of the barrel shell 34. The outer surface of the protrusion 84 is preferably configured to be flush with the outer surface of the barrel shell 34 when the insert 68 is coupled to the barrel shell 34 (see FIG. 8). When the insert 68 is coupled to the barrel shell 34, the insert 68 and the barrel shell 34 preferably define a gap 90 between the inner surface of the hitting face 36 of the barrel shell 34 and the corresponding outer surface of the insert body 82 (see FIG. 8). The gap 90 is preferably in the range of approximately 0.01-0.5 inches. Accordingly, the construction and composition of the barrel 70 is preferably asymmetrical about the longitudinal axis 90 of the barrel 70 (see FIG. 8).

As shown in FIGS. 6 and 8, the insert 42 or the insert 68 is preferably secured to the barrel shell 34 based on at least a portion of the outer circumference of the insert 42 or the insert 68 having a friction fit with the inner circumference of the barrel shell 34. The protrusion 48 or the protrusion 84 preferably facilitates preventing the insert 42 or the insert 68 from rotating relative to the barrel shell 34. In some versions, the insert 42 or the insert 68 and the barrel shell 34 are configured to mechanically lock to each other. Adhesive is preferably disposed between the portions of the insert 42 or the insert 68 and the barrel shell 34 that contact each other. In other versions, the insert couples to the barrel shell in a different manner.

Figure 9:
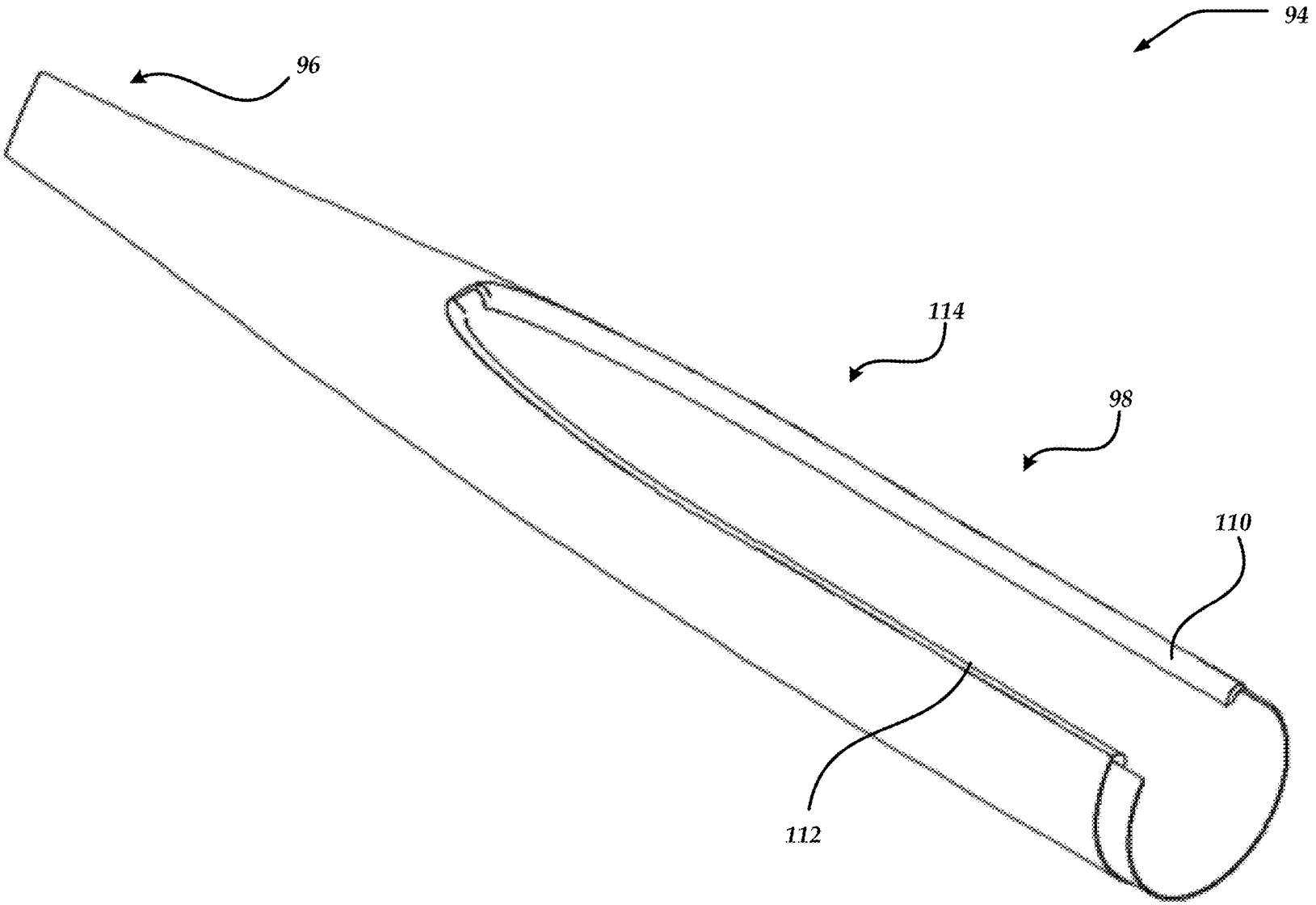
FIG. 9 is a perspective view of a preferred barrel and handle portion of a baseball or softball bat.

FIG. 9 shows a preferred integral barrel and handle portion 94 of a baseball or softball bat in accordance with the principles of the invention. The barrel and handle portion 94 preferably defines a handle or handle portion 96 and a barrel shell 98. The barrel shell 98 preferably has the same composition and construction as the barrel shell 98, except that barrel shell 98 preferably has one or more couplers, such as hooked lips 110, 112, that are configured to secure an insert and that partially define or are near each opening in the non-hitting face 114. The lips 110, 112 are preferably formed by bending edges of the barrel shell 98 that at least partially define each opening in the non-hitting face 114.

Figure 10:
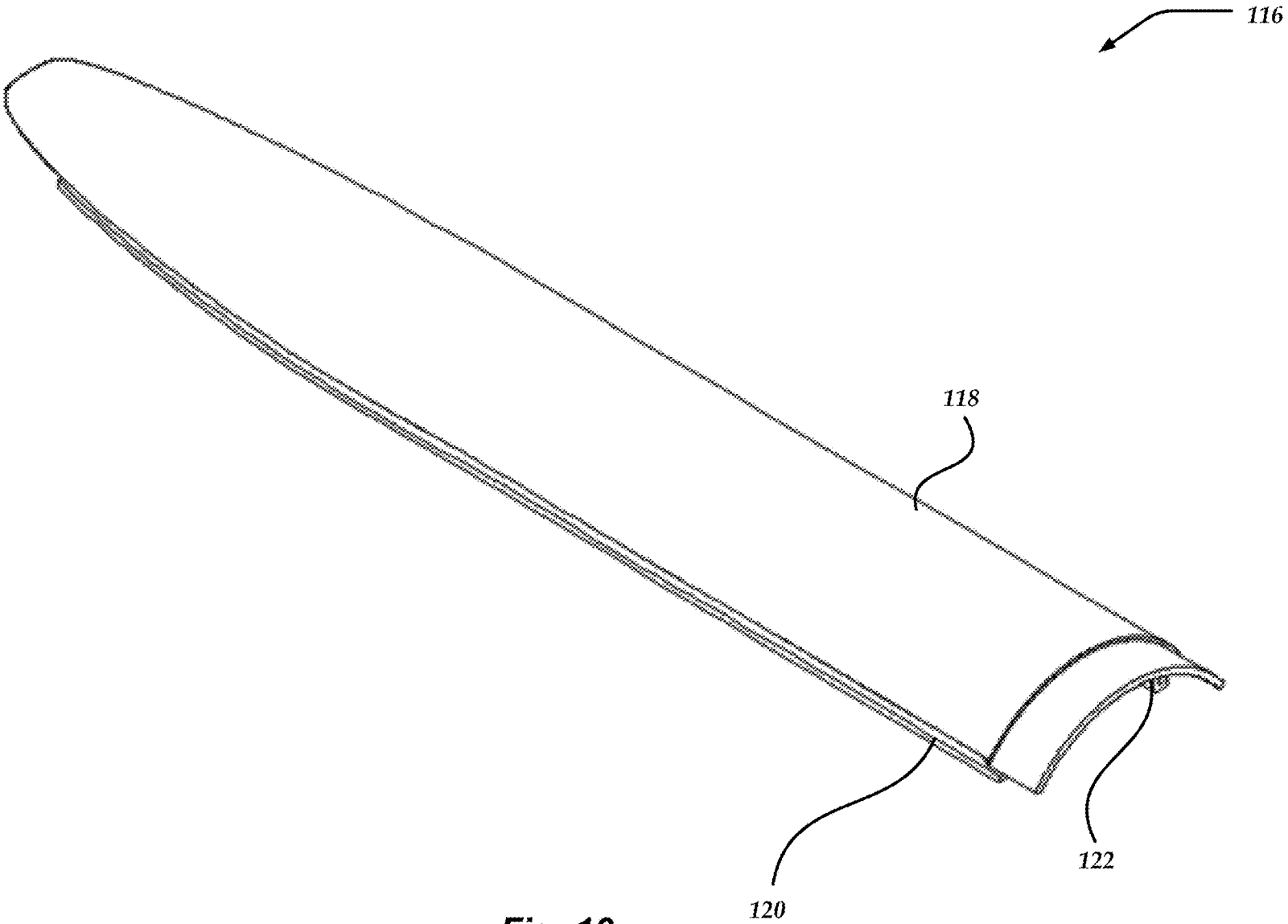
FIG. 10 is a perspective view of a preferred insert.
Figure 11:
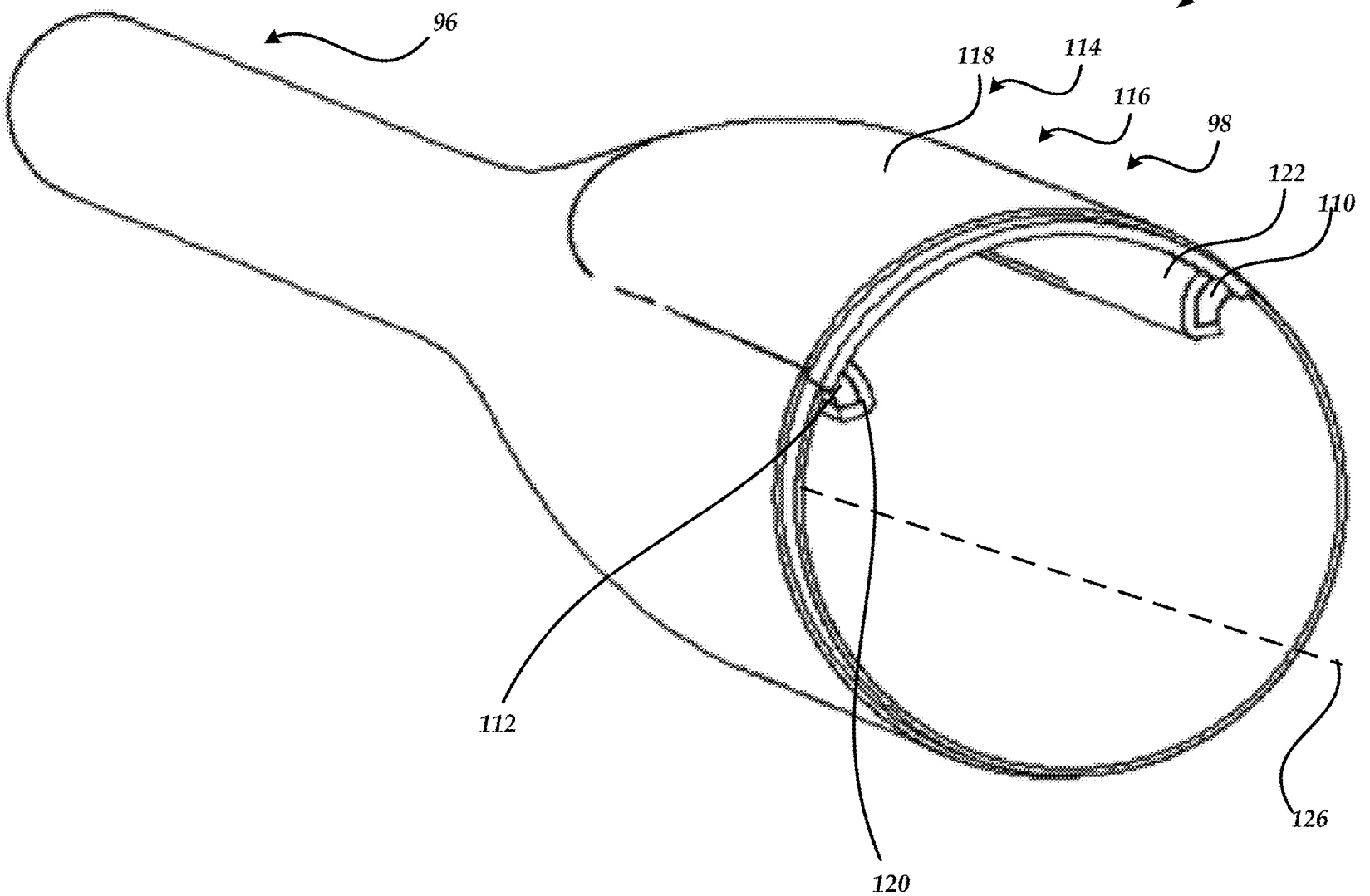
FIG. 11 is a perspective view of a preferred barrel that includes the barrel and handle portion of FIG. 9 and the insert of FIG. 10.
Figure 12:
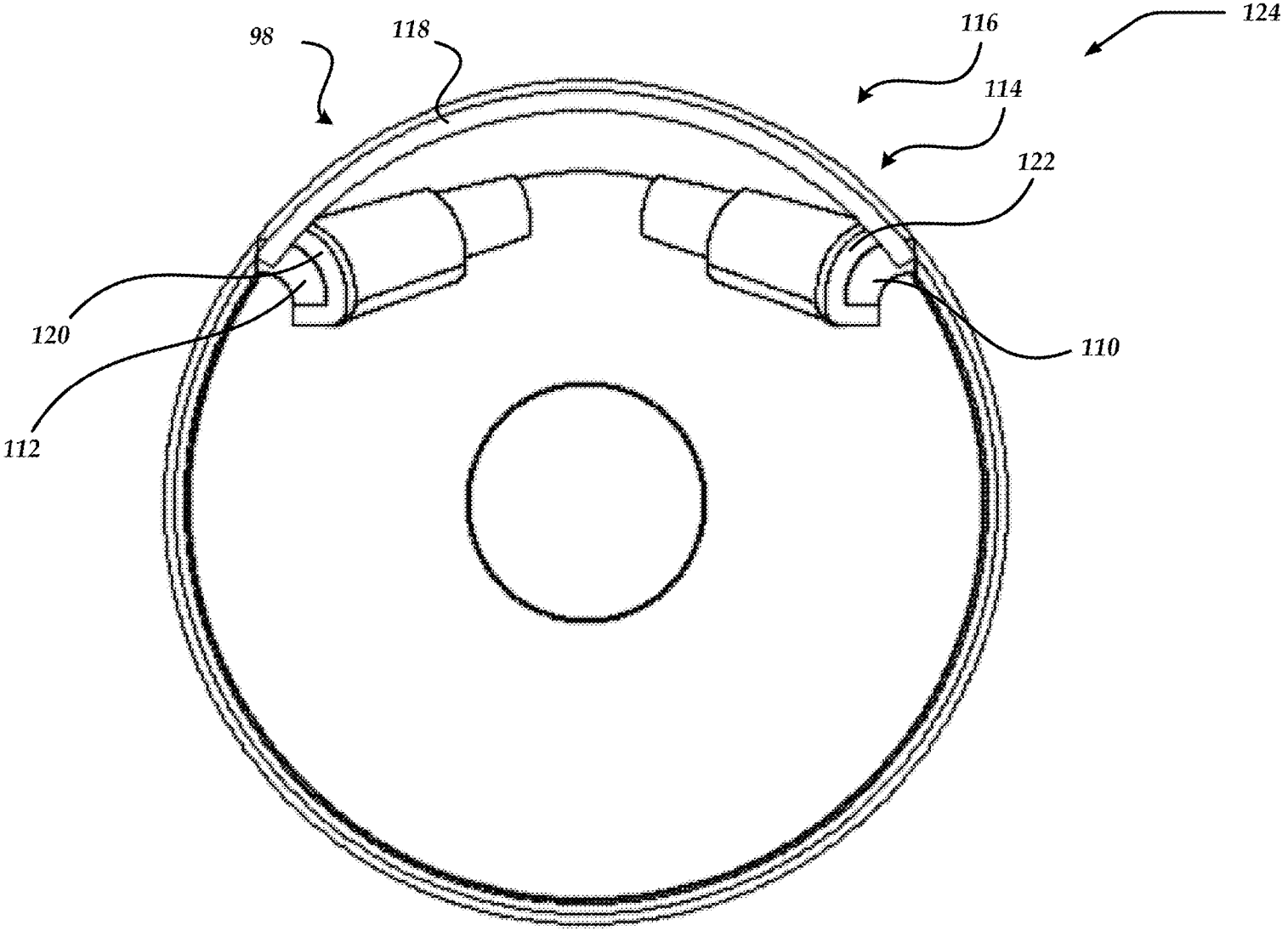
FIG. 12 is a distal-end view of the barrel of FIG. 11.

FIG. 10 shows a preferred barrel insert 116 in accordance with the principles of the invention. The barrel insert 116 preferably is the same as the barrel insert 42 or the barrel insert 68, except that the barrel insert 116 preferably has a protrusion 118 and one or more couplers, such as hooked lips 120, 122, that are configured to couple the barrel insert 116 to the barrel shell 98. As shown in FIGS. 11 and 12, the lips 120, 122 of the barrel insert 116 are configured to couple to the lips 110, 112 of the barrel shell 98 and thereby couple to the barrel insert 116 and the barrel shell 98 to each other to provide a barrel 124. Accordingly, the construction and composition of the barrel 124 is preferably asymmetrical about the longitudinal axis 126 of the barrel 124 (see FIG. 10).

Figure 13:
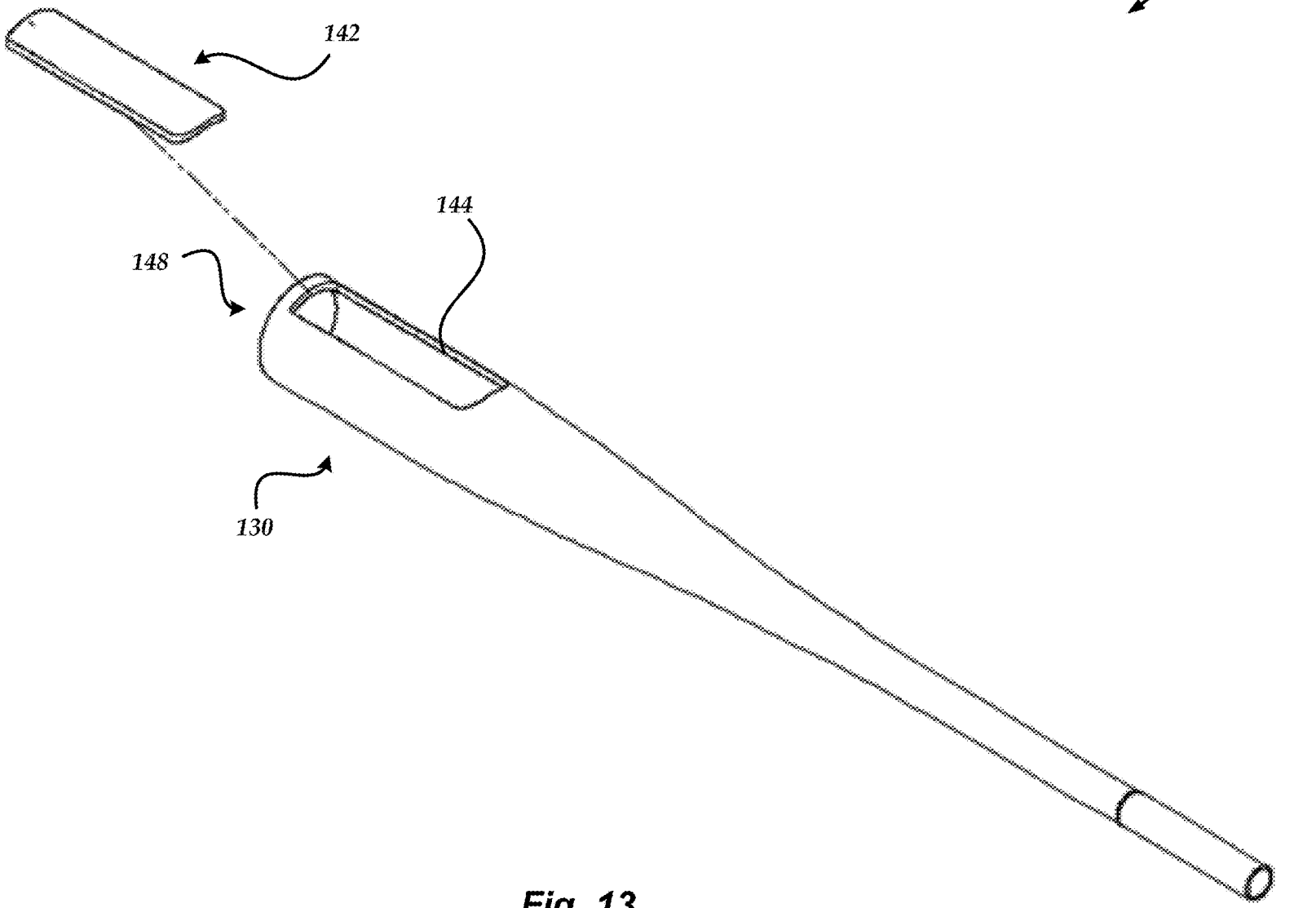
FIG. 13 is an isometric exploded view of a preferred barrel and handle portion of a baseball or softball bat.
Figure 14:
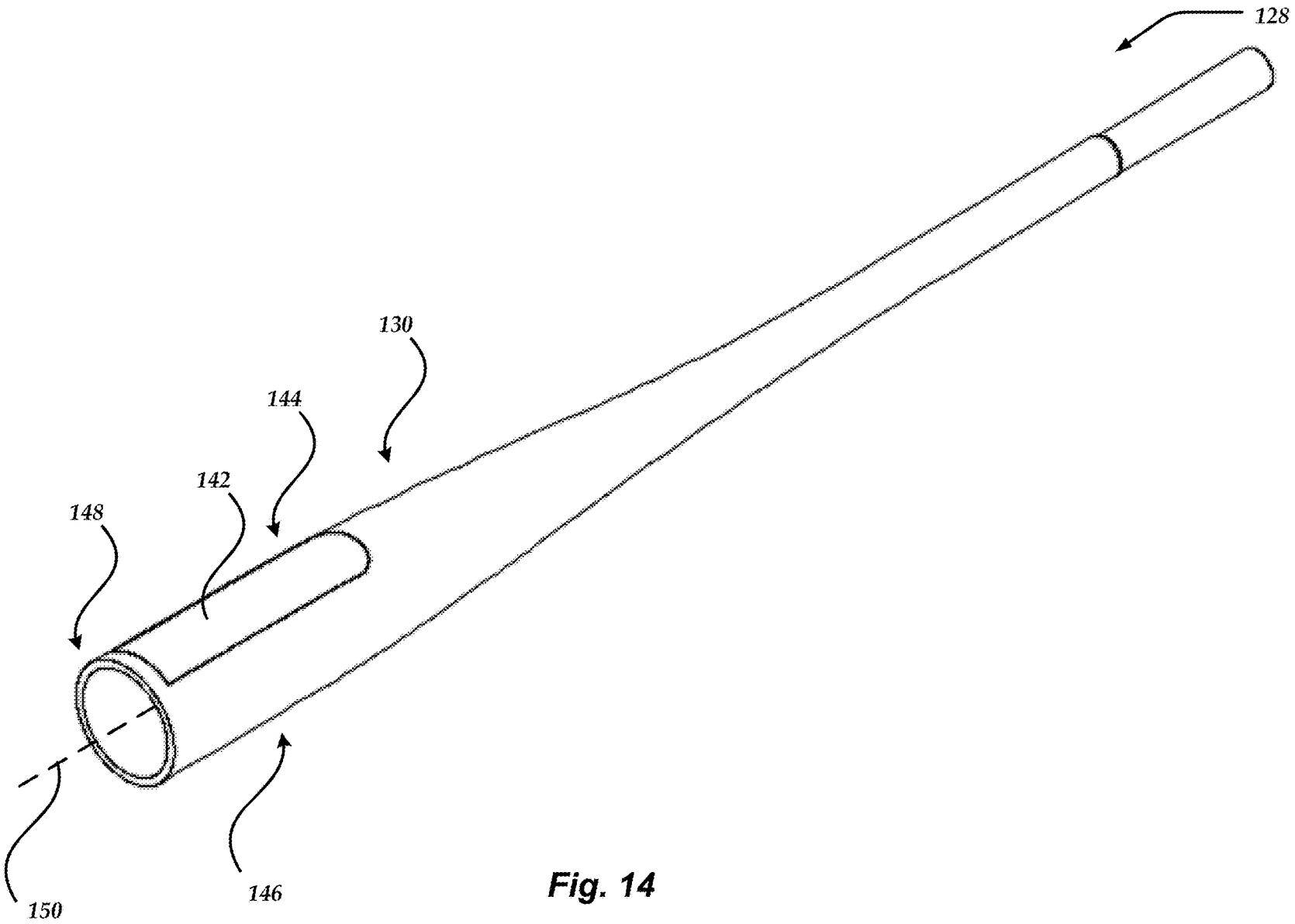
FIG. 14 is an isometric view of the barrel and handle portion of FIG. 13.
Figure 15:
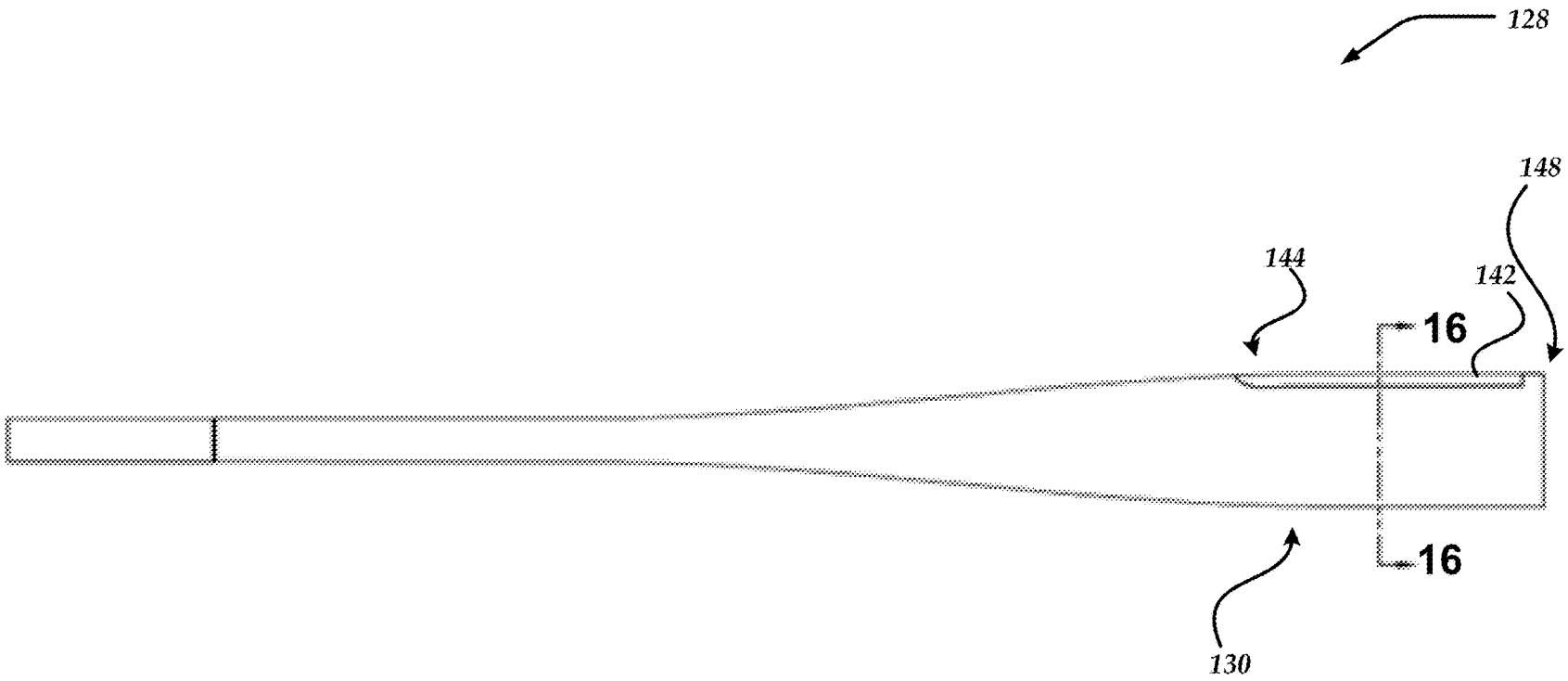
FIG. 15 is a side elevational view of the barrel and handle portion of FIG. 13.
Figure 16:
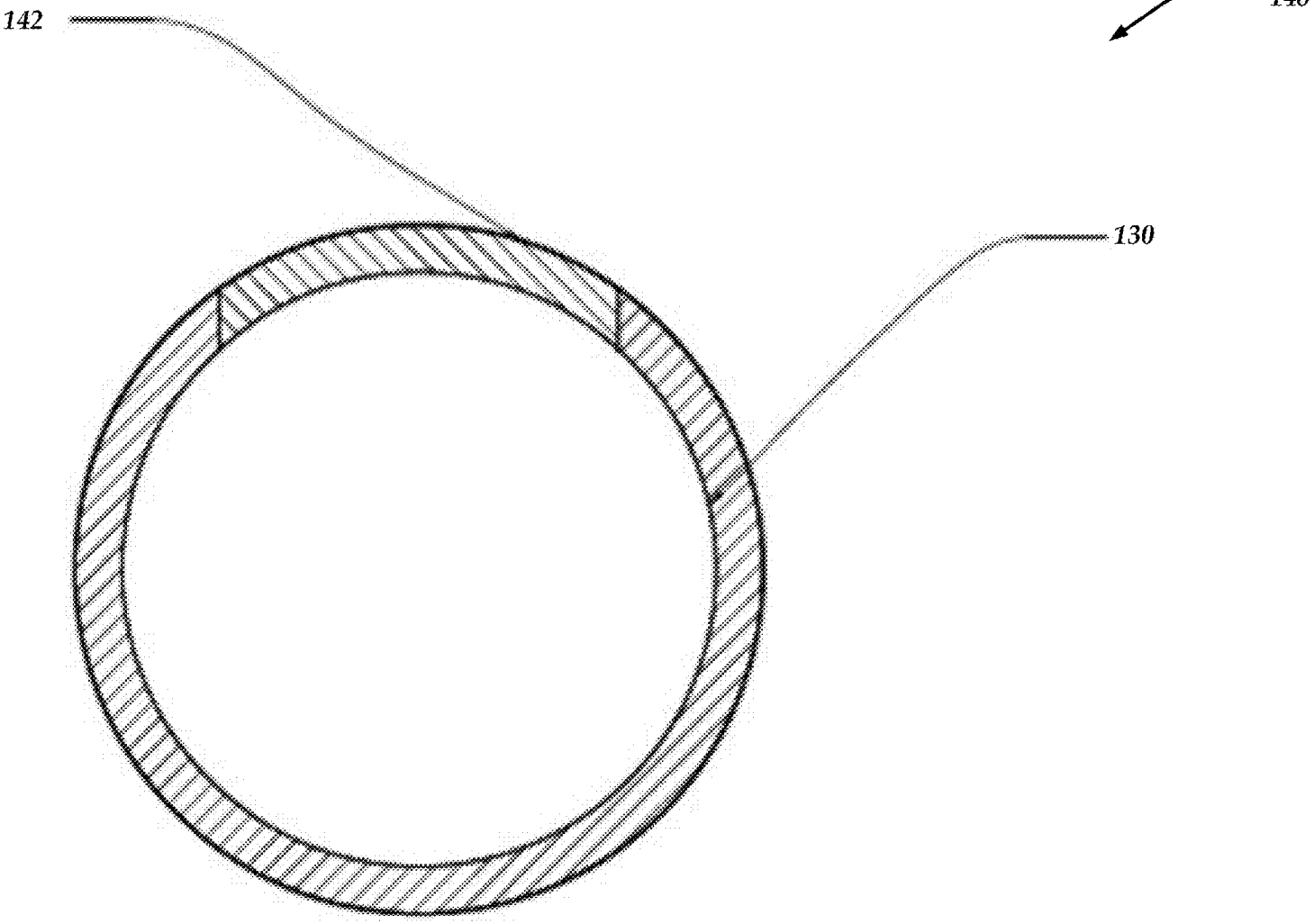
FIG. 16 is a cross-sectional view of the barrel and handle portion of FIG. 13, taken along the line 16-16 in FIG. 15.

FIGS. 13 and 14 show a preferred barrel and handle portion 128 of a baseball or softball bat in accordance with the principles of the invention. The barrel and handle portion 128 preferably includes a barrel shell 130 and an insert 142 that is sized and dimensioned to be received in an opening 144 defined by the barrel shell 130 to form a barrel 146 (see FIG. 14). The barrel shell 130 is the same or similar to one or more of the barrel shell 34 or the barrel shell 98, except the opening 144 of the barrel shell 130 is preferably spaced apart from the distal end portion 148 of the barrel shell 130. In some versions, the barrel shell 130 has a thicker shell wall than the barrel shell 34 or the barrel shell 98, and the insert 142 preferably does not influence performance of the barrel 146 (for example, BBCOR or BBS) yet decreases the weight of the bat compared to a similar barrel that does not have the opening 144. The opening 144 and the insert 142 preferably have a generally rectangular shape. The insert 142 preferably has a thickness that substantially matches the thickness of the barrel shell 130, such that the inner surface of the insert 142 is substantially flush with the inner surface of the barrel shell 130 and such that the outer surface of the insert 142 is substantially flush with the outer surface of the barrel shell 130 (see the cross-sectional view of FIG. 16, which is taken along the line 16-16 in FIG. 15).

The insert 142 is preferably created by filling the opening 144 with an uncured material, such as a preimpregnated composite material (for example, preimpregnated carbon fiber, preimpregnated glass fiber, or others), and the material is preferably allowed to cure to the portions of the barrel shell 130 that define or are near the opening 144, such as portions of the inner surface of the barrel shell 130 near the opening 144. The composite material preferably includes a matrix or series of plies of fiber bundles impregnated with a resin, such as one or more polymer matrix composites that include one or more types of fibers and one or more polymer resin matrixes. The fibers preferably include one or more of carbon, glass, aramid (for example, a para-aramid such as those available under the mark KEVLAR® or a meta-aramid such as those available under the mark NOMEX®), boron, basalt, graphite, carrot, poly-para-phenylene-2, 6-benzobisoxazole (PBO), hemp, or others. The resin preferably includes one or more of a thermoset polymer matrix (for example, epoxy, phenolics, or others) or a thermoplastic polymer matrix (for example, low-density polyethylene, high-density polyethylene, polypropylene, nylon, acrylics, or others). The fiber bundles in a given ply are preferably co-axially bundled and aligned in the ply.

A single ply preferably includes thousands of fiber bundles that are initially arranged to extend substantially coaxially and substantially parallel to each other in a resin that is initially uncured. Each ply preferably has a thickness between approximately 0.002-0.25 inches. Each ply is preferably wrapped or formed about a bladder mandrel or other forming structure inserted into the barrel shell 130 and thereby conformed to the shape of the mandrel or forming structure. Some of the plies are preferably laid such that the fiber bundles are oriented substantially parallel to the longitudinal axis 150 of the barrel 146. Sequentially laid plies are preferably oriented with their respective fiber bundles extending in substantially opposite angular polarities relative to the longitudinal axis 150 of the barrel 146 yet also substantially parallel to the longitudinal axis 150 of the barrel 146 (see FIG. 14). In some versions, one or more layers include plies having the bundles oriented substantially orthogonal to the longitudinal axis 150. The composite material is preferably then heated and cured to form the barrel 130. During the heating and curing process, the resin may flow between the plies and within the fiber bundles (termed "wet-out"). The barrel 146 is preferably relatively stiff in the radial direction (toward the longitudinal axis 150 of the barrel 146) compared to, for example, one or more other barrels described herein.

Figure 17:
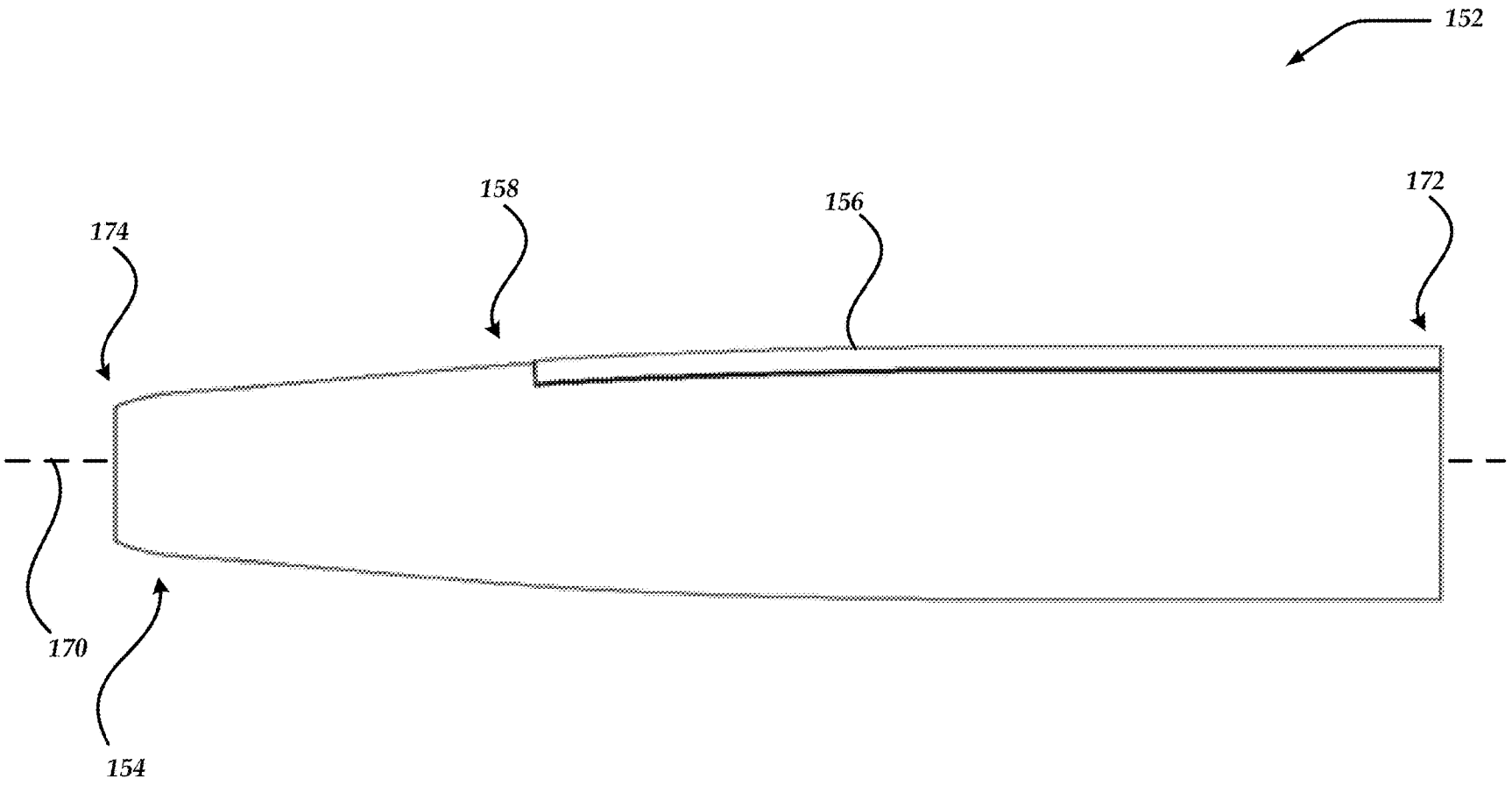
FIG. 17 is a side elevational view of a preferred barrel of a baseball or softball bat.
Figure 18:
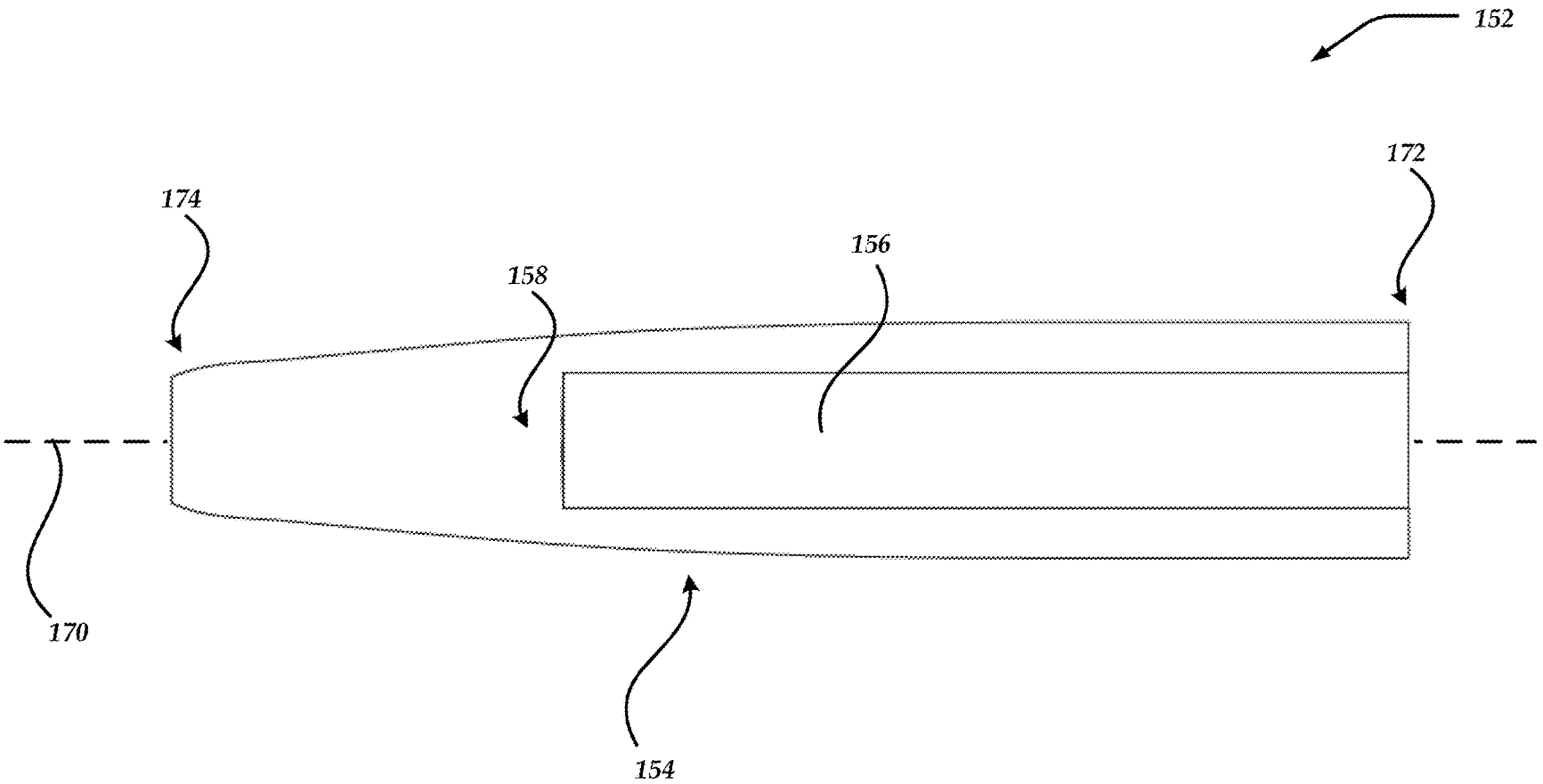
FIG. 18 is a rear elevational view of the barrel of FIG. 17.

FIGS. 17 and 18 show a barrel 152 of a baseball or softball bat in accordance with the principles of the invention. The barrel 152 preferably includes a barrel shell 154 and one or more inserts or characteristic-modifying sheets, such as the characteristic-modifying sheet 156, disposed on the outer surface of the non-hitting face 158 of the barrel shell 154. The characteristic-modifying sheet 156 preferably facilitates reducing vibration passed to the player's hands and, most preferably, does so without influencing barrel performance in comparison to a barrel having the barrel shell 154 that is continuous and devoid of the void configured to receive the sheet 156. In some versions, one or more characteristic-modifying sheets are also or alternatively disposed on the inner surface of the non-hitting face 158 of the barrel shell 154. The barrel shell 154 is preferably the same or similar to one or more of the barrel shell 34, the barrel shell 98, or the barrel shell 130, except that the barrel shell 154 is preferably devoid of any opening in the non-hitting face of the barrel shell 154. The barrel shell 154 preferably includes composite material. The sheet 156 preferably includes composite material and preferably one or more plies of composite material. The plies of the sheet 156 preferably include fiber bundles that are oriented substantially parallel to the longitudinal axis 170 of the barrel 152. In some versions, the fiber bundles are chopped and randomly oriented in the plies. The sheet 156 preferably extends from the distal end portion 172 of the barrel 152 to the proximal end portion 174 of the barrel or along most of the length to the proximal end portion 174. The material of the sheet 156 is preferably laid on the non-hitting face 158 of the barrel shell 154 before the material of the barrel shell 154 cures and, most preferably, is cured at the same time as the material of the barrel shell 154. In other versions, the material of the sheet 156 is laid on the non-hitting face 158 of the barrel shell 154 after the material of the barrel shell 154 cures and is subsequently cured.

Figure 19:
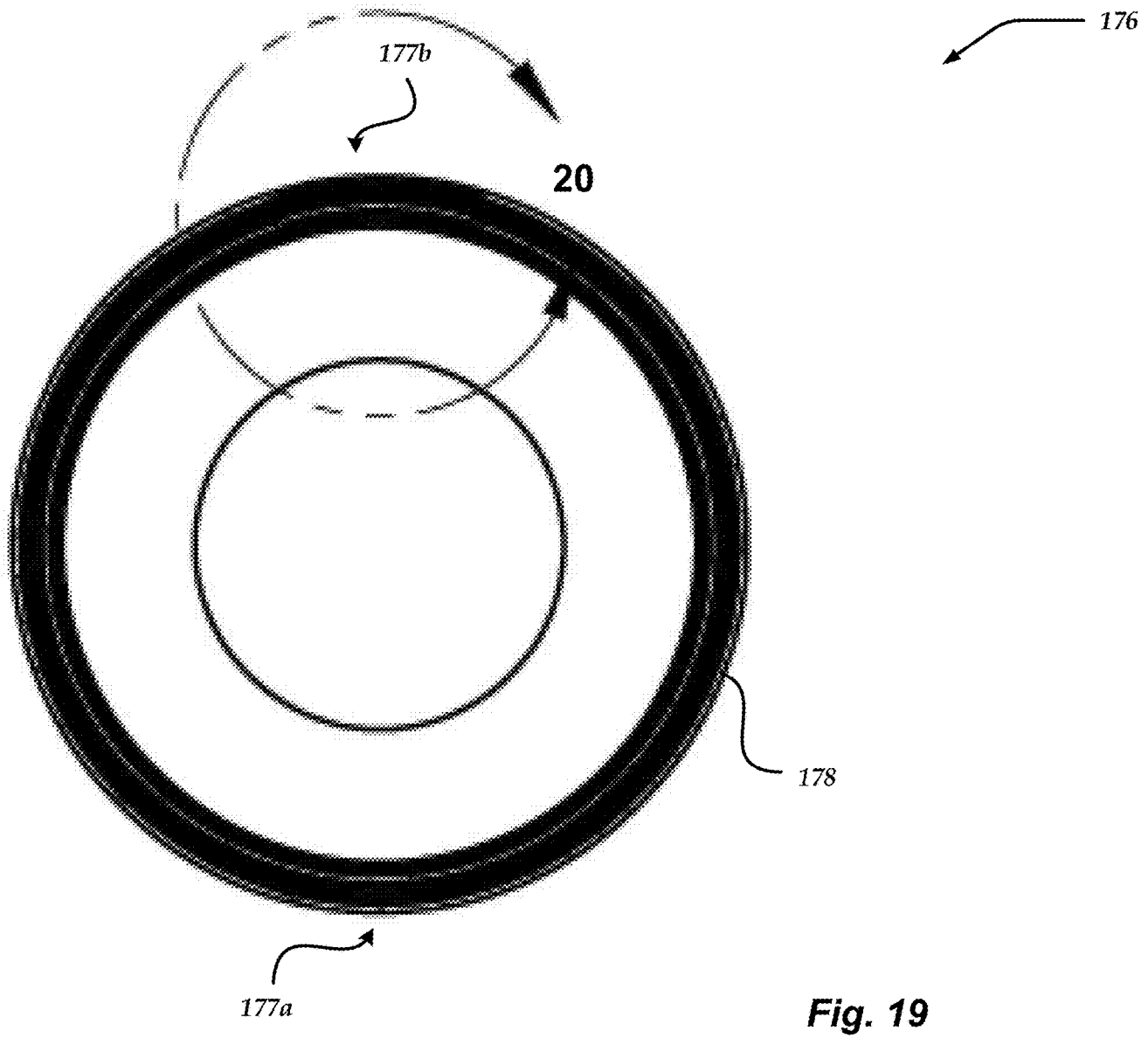
FIG. 19 shows a top plan view of a preferred barrel of a baseball or softball bat.
Figure 20:
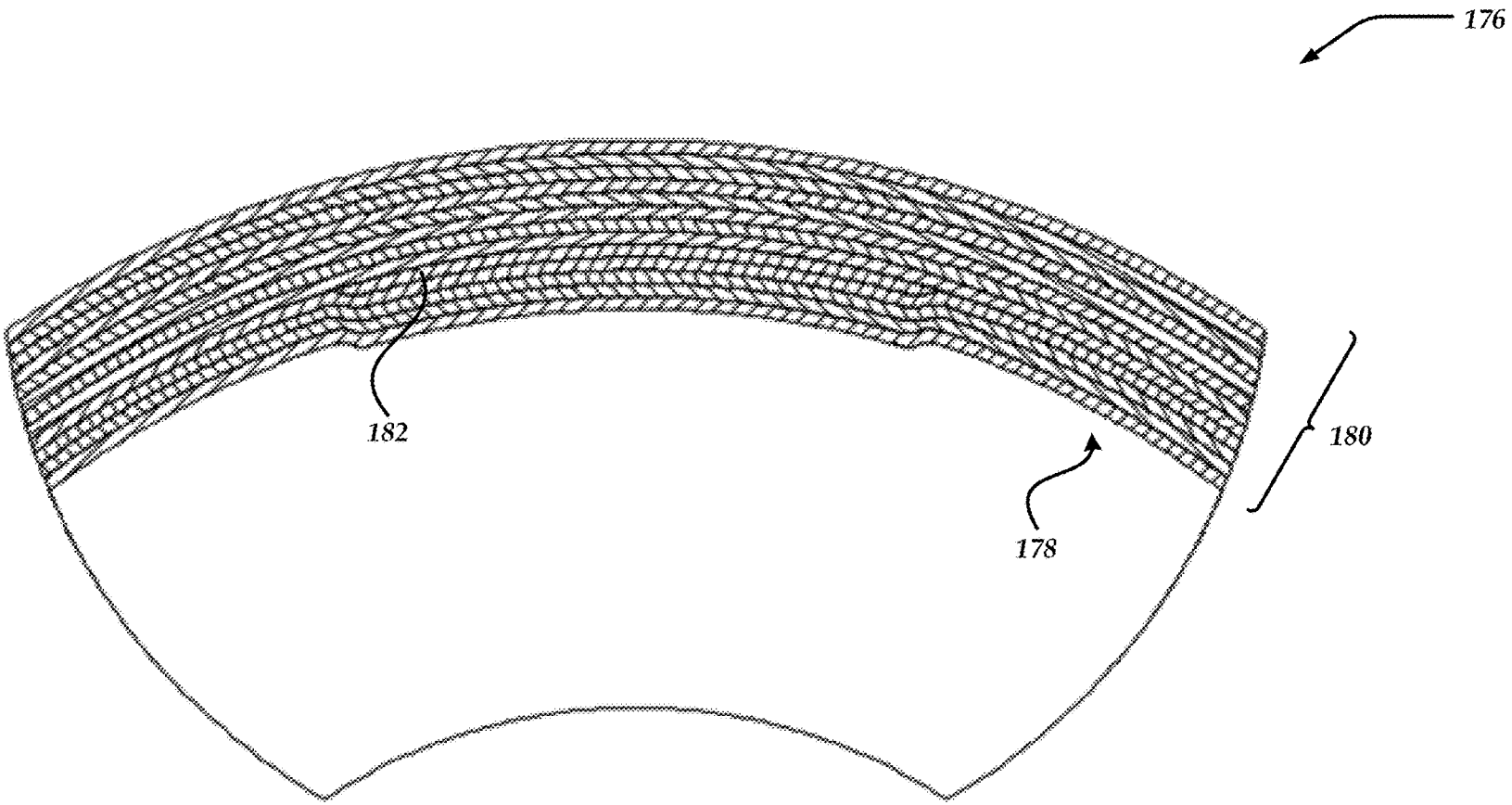
FIG. 20 shows a detail view of a portion of the barrel of FIG. 19 that is encircled by circle 20 in FIG. 19.

FIG. 19 shows a distal-end view of a barrel 176 of a baseball or softball bat in accordance with the principles of the invention. The barrel 176 has a hitting face 177*a* and a non-hitting face 177*b*. The barrel 176 preferably includes a barrel shell 178 that is preferably the same or similar to the barrel shell 154. FIG. 20 shows a detail view of the portion of the barrel 176 that is encircled by circle 20 in FIG. 19. The barrel shell 178 preferably includes a plurality of layers 180 of composite material (see FIG. 20). One or more characteristic-modifying sheets, such as characteristic-modifying sheet 182, are preferably disposed between two layers of the barrel shell 178. In some versions, one or more characteristic-modifying sheets are disposed between two sequentially laid ones of the layers 180, and another one or more characteristic-modifying sheets are disposed between another two sequentially laid ones of the layers 180. During the manufacturing process, the inner shape of the barrel 176 is preferably defined by a bladder, and the outer shape of the barrel 176 is preferably defined by a mold that is harder than the bladder. Accordingly, the characteristic-modifying sheet 182 preferably causes the layers disposed inward of the characteristic-modifying sheet to bulge inward in the region of the characteristic-modifying sheet 182.

Figure 21:
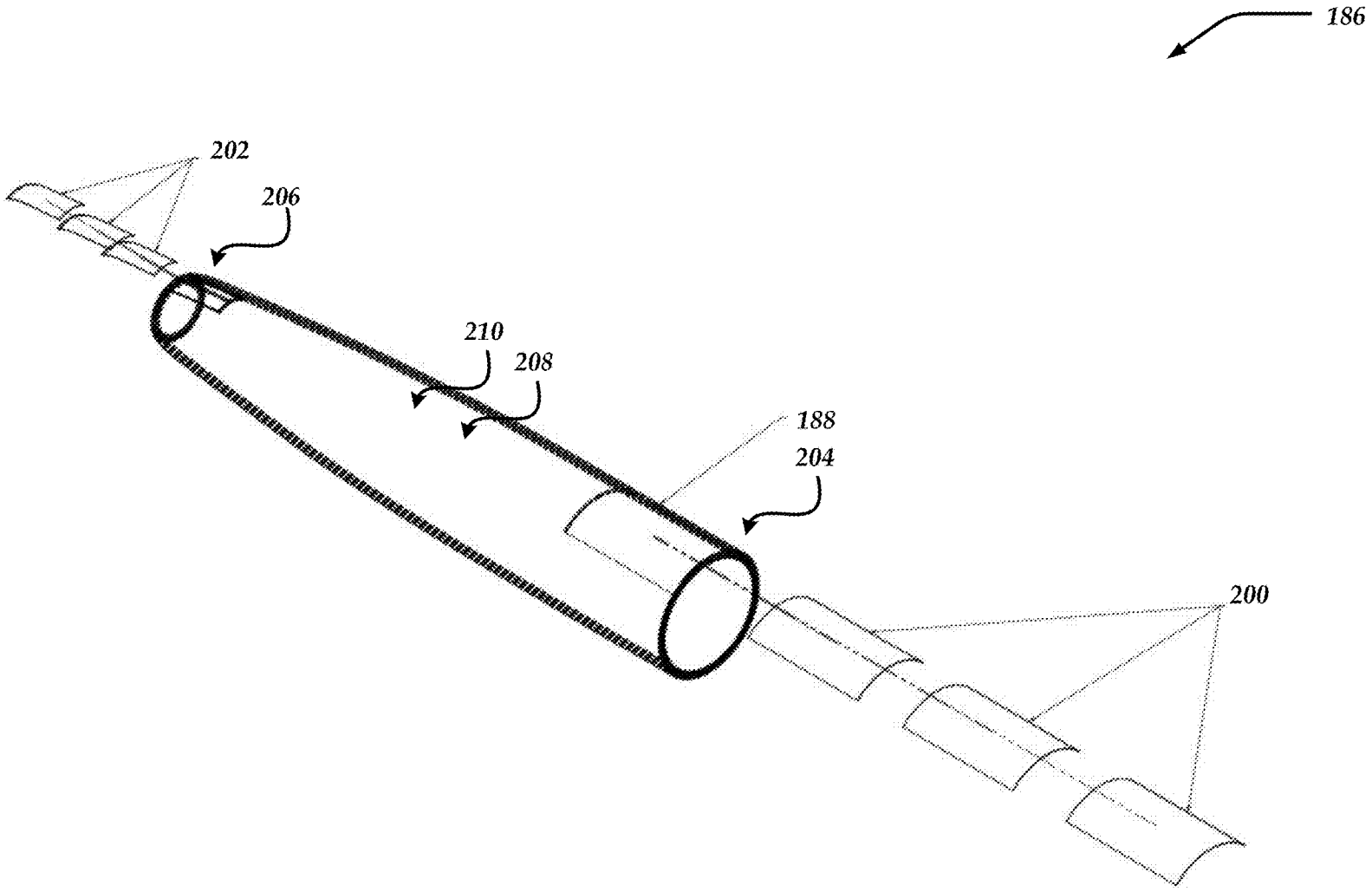
FIG. 21 shows an exploded transparent view of a preferred barrel of a baseball or softball bat.

FIG. 21 shows an exploded view of a barrel 186 of a baseball or softball bat in accordance with the principles of the invention. The barrel 186 preferably includes a barrel shell 188 that is preferably the same or similar to one or more of the barrel shell 154 or the barrel shell 178. One or more characteristic-modifying sheets, such as characteristic-modifying sheets 200 or characteristic-modifying sheets 202, are preferably disposed at the distal end portion 204 or the proximal end portion 206 of the non-hitting face 208 of the barrel shell 154. One or more of the sheets 200 or the sheets 202 are preferably disposed on the inner surface or the outer surface of the barrel shell 188 as discussed regarding the barrel 152 or between layers of the barrel shell 188 as discussed regarding the barrel 176. In some versions, one or more sheets are disposed in or on the barrel shell 154 between the sheets 200 and the sheets 202 at a middle portion 210 of the non-hitting face 208 of the barrel shell 188, and those middle sheets may be adjacent to or spaced apart from the sheets 200 or the sheets 202.

Figure 22:
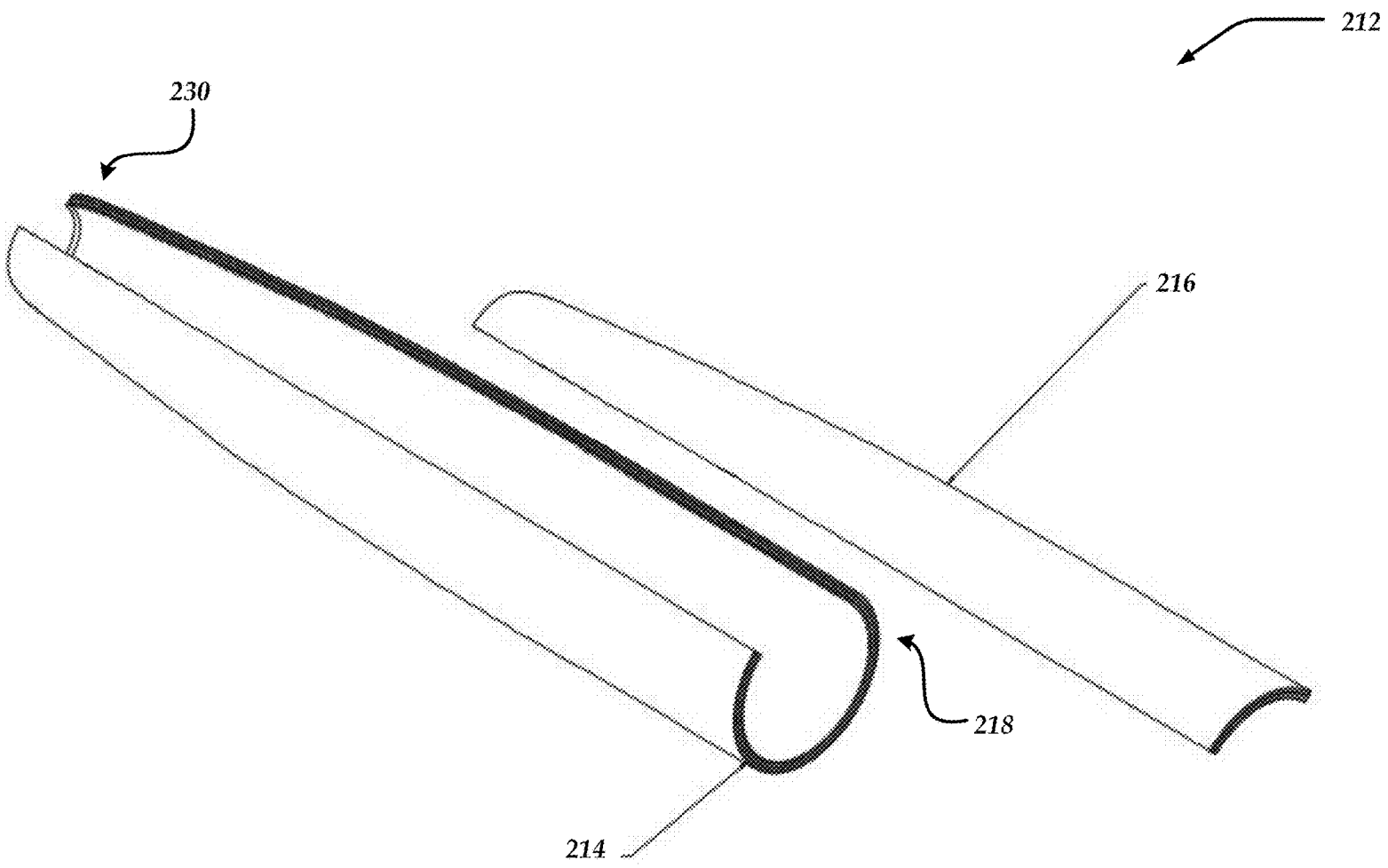
FIG. 22 shows an exploded view of a preferred barrel of a baseball or softball bat.

FIG. 22 shows an exploded view of a barrel 212 of a baseball or softball bat in accordance with the principles of the invention. The barrel 212 preferably includes a barrel shell 214 that is preferably the same or similar to one or more of the barrel shell 154, the barrel shell 178, or the barrel shell 188. The non-hitting face of the barrel 212 is preferably made entirely of a characteristic-modifying sheet 216. The characteristic-modifying sheet 216 preferably substantially longitudinally extends entirely from the distal end portion 218 of the barrel shell 214 to the proximal end portion 230 of the barrel shell 214. In some versions, the sheet 216 substantially longitudinally extends along only a portion of the length of the barrel shell 214 as measured along the longitudinal axis of the barrel 214, such as is shown for the sheet 156, the sheets 200, or the sheets 202. The characteristic-modifying sheets 216 preferably circumferentially extend across the entire inner and outer circumference of the non-hitting face of the barrel 212, such as approximately 120°. In some versions, the characteristic-modifying sheets 216 circumferentially extend across a portion of the inner and outer circumference of the non-hitting face of the barrel, such as no more than or at least 10, 20, 30, 40, 50, 60, 70, 80, or 90 percent of such circumferences. The characteristic-modifying sheets 216 preferably have substantially the same thickness as the walls of the barrel shell 214. The sheets 216 are preferably respectively laid and cured during the laying and curing processes for the barrel shell 214. In some versions, the sheets 216 are cured separately from the barrel shell 214.

Figure 23:
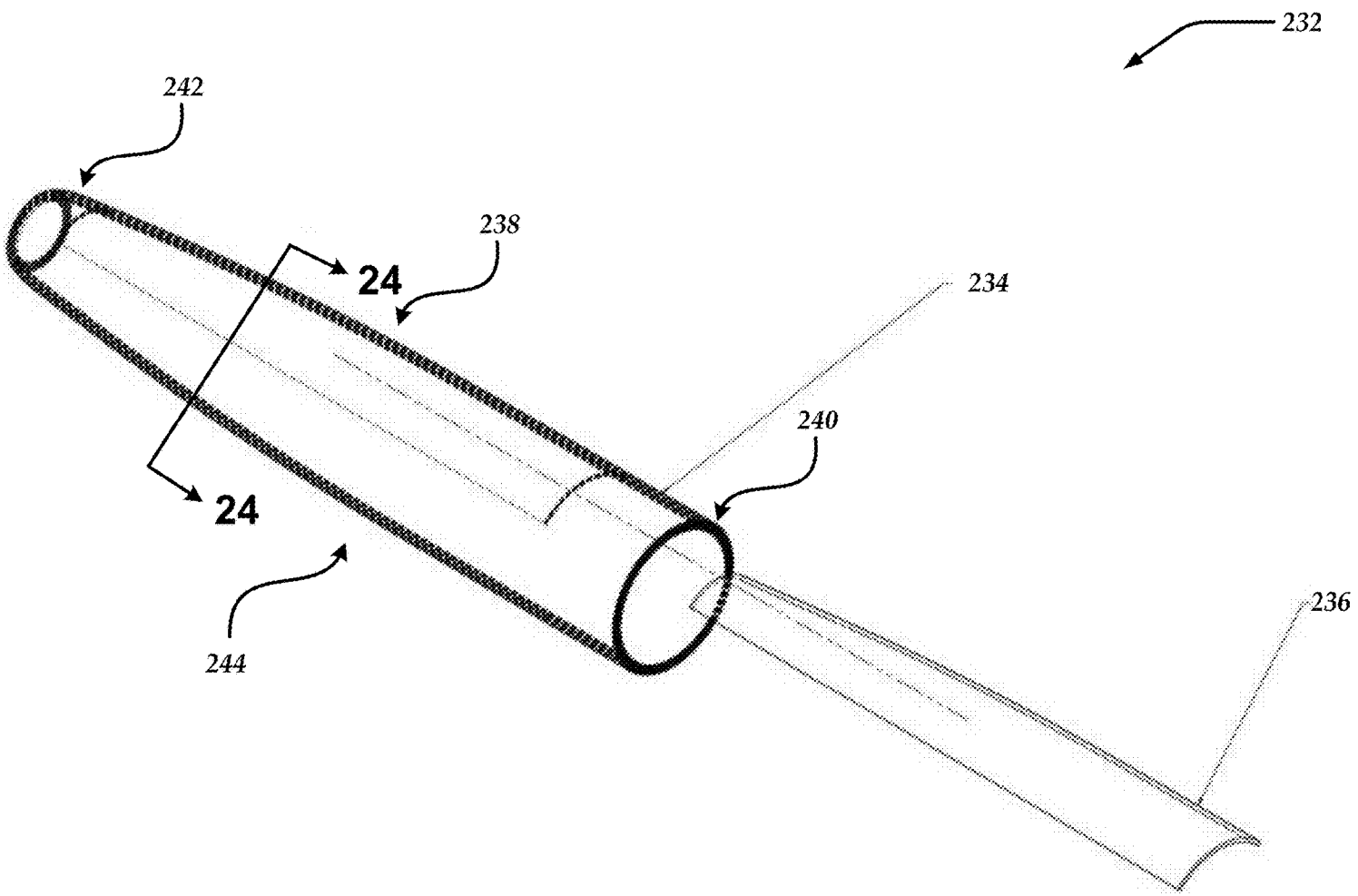
FIG. 23 shows an exploded transparent view of a preferred barrel of a baseball or softball bat.
Figure 24:
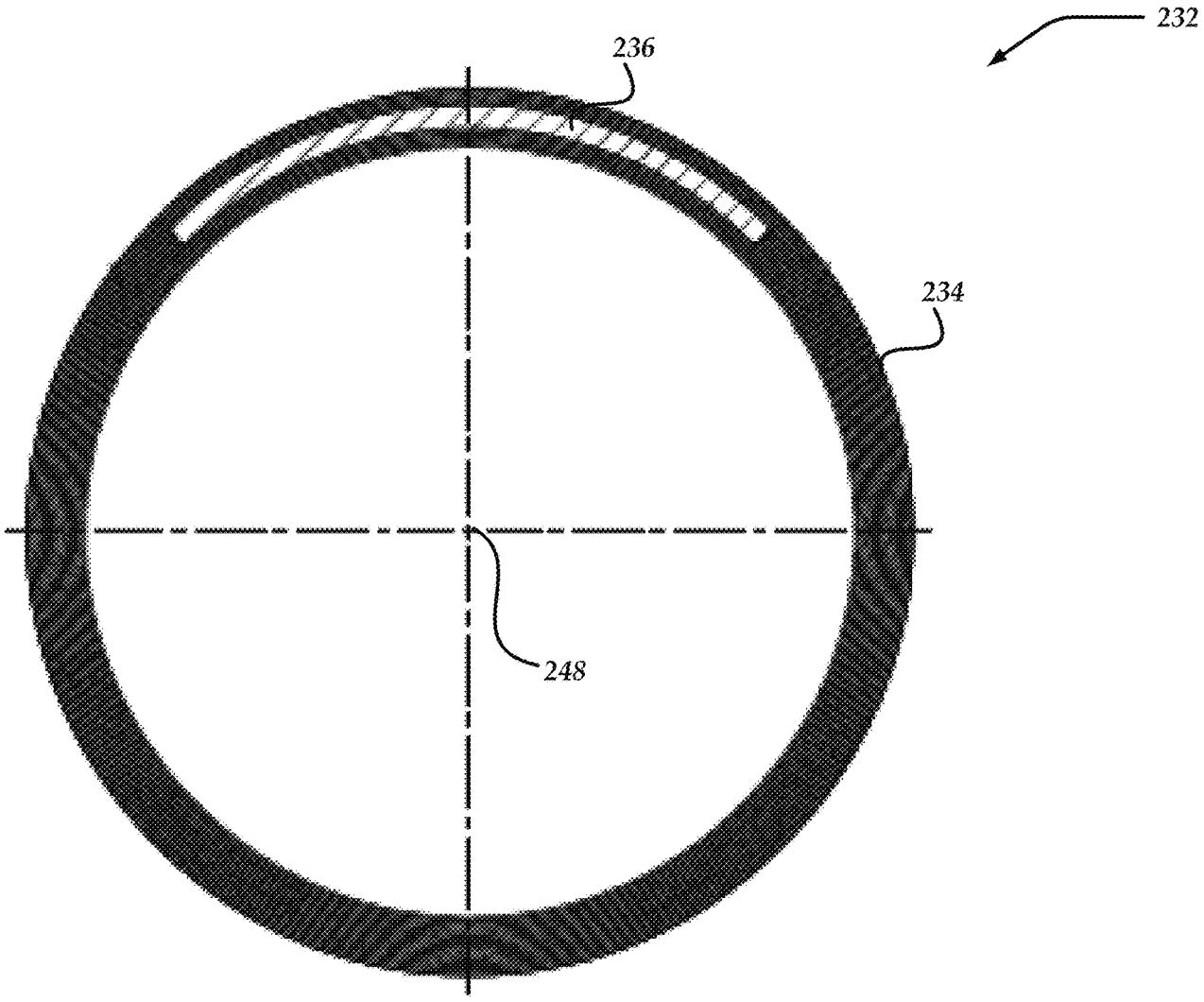
FIG. 24 shows a cross-sectional view of the barrel of FIG. 23, taken along line 24-24 in FIG. 23.

FIG. 23 shows an exploded view of a barrel 232 of a baseball or softball bat in accordance with the principles of the invention. The barrel 232 preferably includes a barrel shell 234 that is preferably the same or similar to one or more of the barrel shell 154, the barrel shell 178, the barrel shell 188, or the barrel shell 214. The non-hitting face of the barrel 232 preferably includes a characteristic-modifying sheet 236. The characteristic-modifying sheet 236 preferably substantially longitudinally extends only along a middle portion 238 of the non-hitting face of the barrel 232 and, most preferably, does not extend into the distal end portion 240 or into the proximal end portion 242. The sheet 236 preferably substantially longitudinally extends from a position between the distal end portion 240 and the sweet spot 244 to a position between the proximal end portion 242 and the sweet spot 244. In some versions, the sheet 236 is disposed only between the proximal end portion 242 and the sweet spot 244 or only between the distal end portion 240 and the sweet spot 244. The sheet 236 is preferably disposed between layers of the barrel shell wall of the barrel shell 234, as shown in FIG. 24, which is a cross-sectional view of the barrel 232 taken along line 24-24 of FIG. 23. In some versions, the sheet 236 is disposed on the outer surface of the barrel shell 234, is disposed on the inner surface of the barrel shell 236, or forms the entirety of the barrel wall of the barrel 232 in the middle portion 238 of the non-hitting face of the barrel 232.

Figure 25:
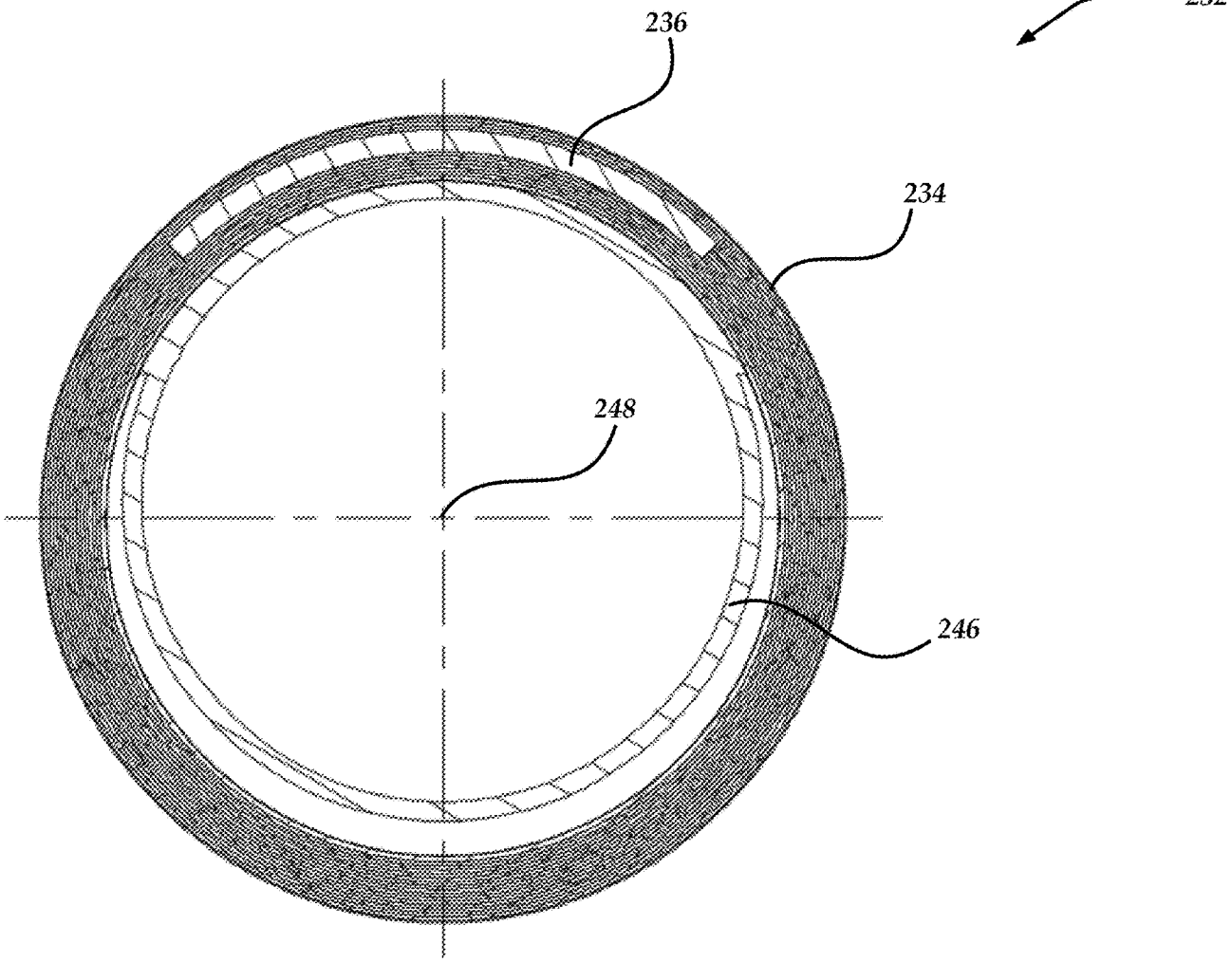
FIG. 25 shows a cross-sectional view of the barrel of FIG. 23, taken along line 24-24 in FIG. 23.

FIG. 25 shows another cross-sectional view of the barrel 232 taken along line 24-24 of FIG. 23. In FIG. 25, the barrel 232 also includes a performance-governing insert 246, such as a deflection-limiting ring or a stiffening ring. The performance-governing insert 246 preferably asymmetrically modifies the performance of the barrel 232 about the circumference of the barrel 232. The performance-governing insert 246 is preferably coupled to the inner surface of the non-hitting face of the barrel 232. The performance-governing insert 246 preferably does not contact the inner surface of the hitting face of the barrel 232 when the barrel is in a default configuration, as shown in FIG. 25. The performance-governing insert 246 preferably extends along the same portion of the longitudinal length of the barrel 232 as the sheet 236. In some versions, the performance-governing insert 246 is shorter or longer than the sheet 236. In some versions, the performance-governing insert 246 is longitudinally offset from the sheet 236, either toward the distal end portion 240 or the proximal end portion 242. Without the performance-governing insert 246 (see FIG. 24), the inner surface of at least a portion of the hitting face of the barrel 232 preferably moves a deformation distance toward the longitudinal axis 248 when a baseball or softball collides with the hitting face of the barrel 232 at a given speed relative to the barrel 232, such as 60 miles per hour. The performance-governing insert 246 is preferably spaced apart from the inner surface of the hitting face of the barrel 232 by a distance that is less than the deformation distance (see FIG. 25) and, most preferably approximately between 0.01 and 0.5 inches. Accordingly, the inner surface of at least a portion of the hitting face of the barrel 232 preferably contacts the performance-governing insert 246 when a player strikes a ball with the barrel 232, thereby limiting the performance of the barrel 232. Other inserts that may be provided in the barrels disclosed herein are described in U.S. Pat. No. 9,498,690, titled "BAT WITH MULTIPLE HITTING PROFILES", which is incorporated herein in its entirety by reference.

In some versions, the sheet 156, the sheets 200, the sheets 202, the sheet 216, or the sheet 236 includes damping material, such as an elastomeric material (for example, unsaturated rubber, such as nitrile rubber, butyl rubber, or styrene rubber or saturated rubber, such as silicone, ethylene, propylene diene rubber, fluorosilicone rubber, or fluroelastomer), unreinforced polymer, or a polymer composite that includes randomly oriented fibers or pattern-oriented fibers. The damping material is preferably precured and cut to fit into space in the corresponding barrel shell, such as a void created by cutting composite plies in the barrel shell wall. In some versions, the void is created without cutting the barrel shell because, for example, the plies are cut before laying them up or the plies are laid up in positions and orientations so as to avoid placing plies in a designated location on a mandrel so as to define the void. The barrel shell is preferably then cured around the precured damping material. The damping material preferably has a higher melting temperature than the material of the barrel shell such that curing the barrel shell around the precured damping material does not influence or materially influence the damping material. In some versions, when the damping material is uncured, the damping material may be cross-linked with the material of the barrel shell responsive to application of a chemical or increasing the temperature of the damping material.

Figure 26:
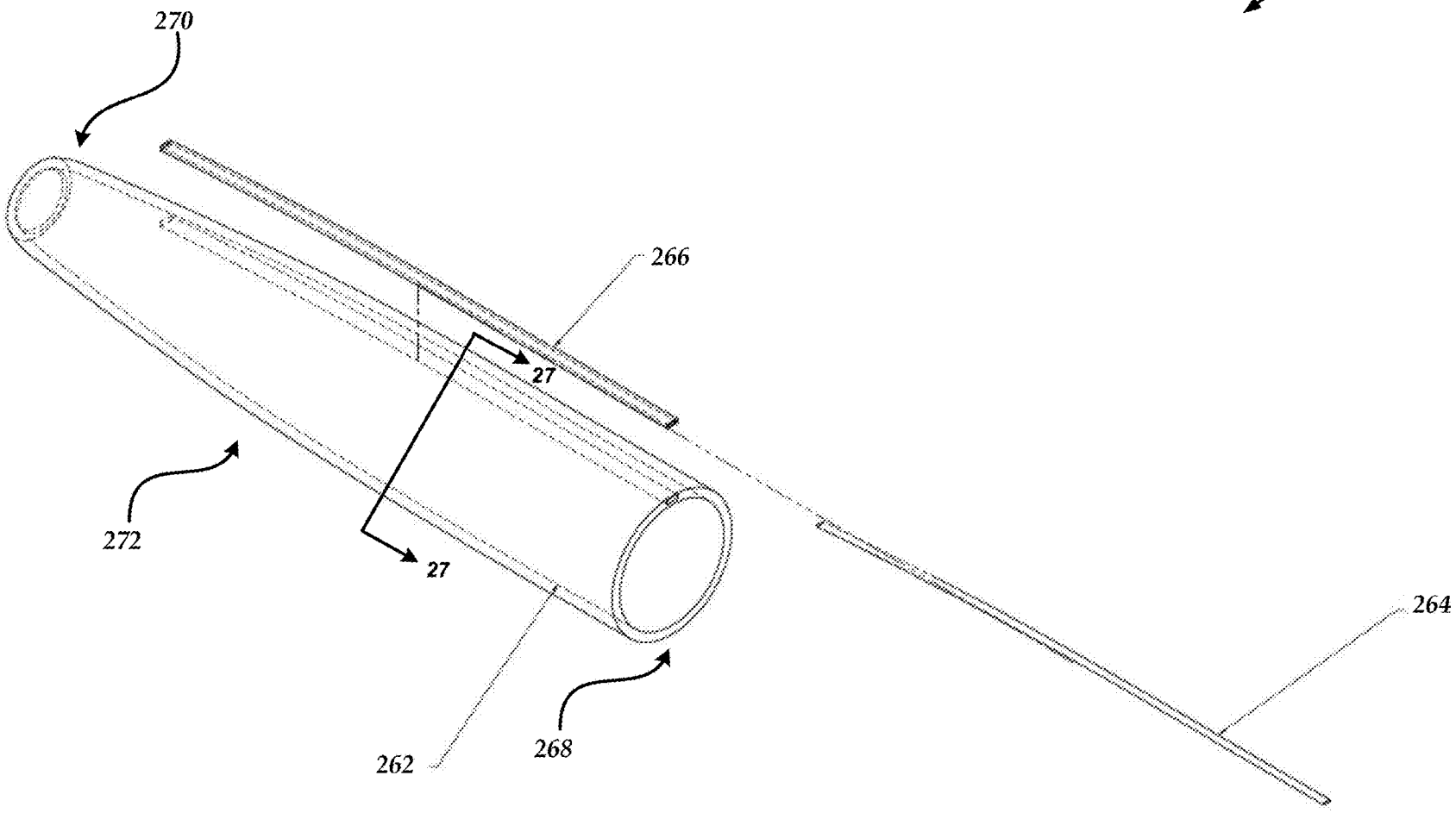
FIG. 26 shows an exploded transparent view of a preferred barrel of a baseball or softball bat.
Figure 27:
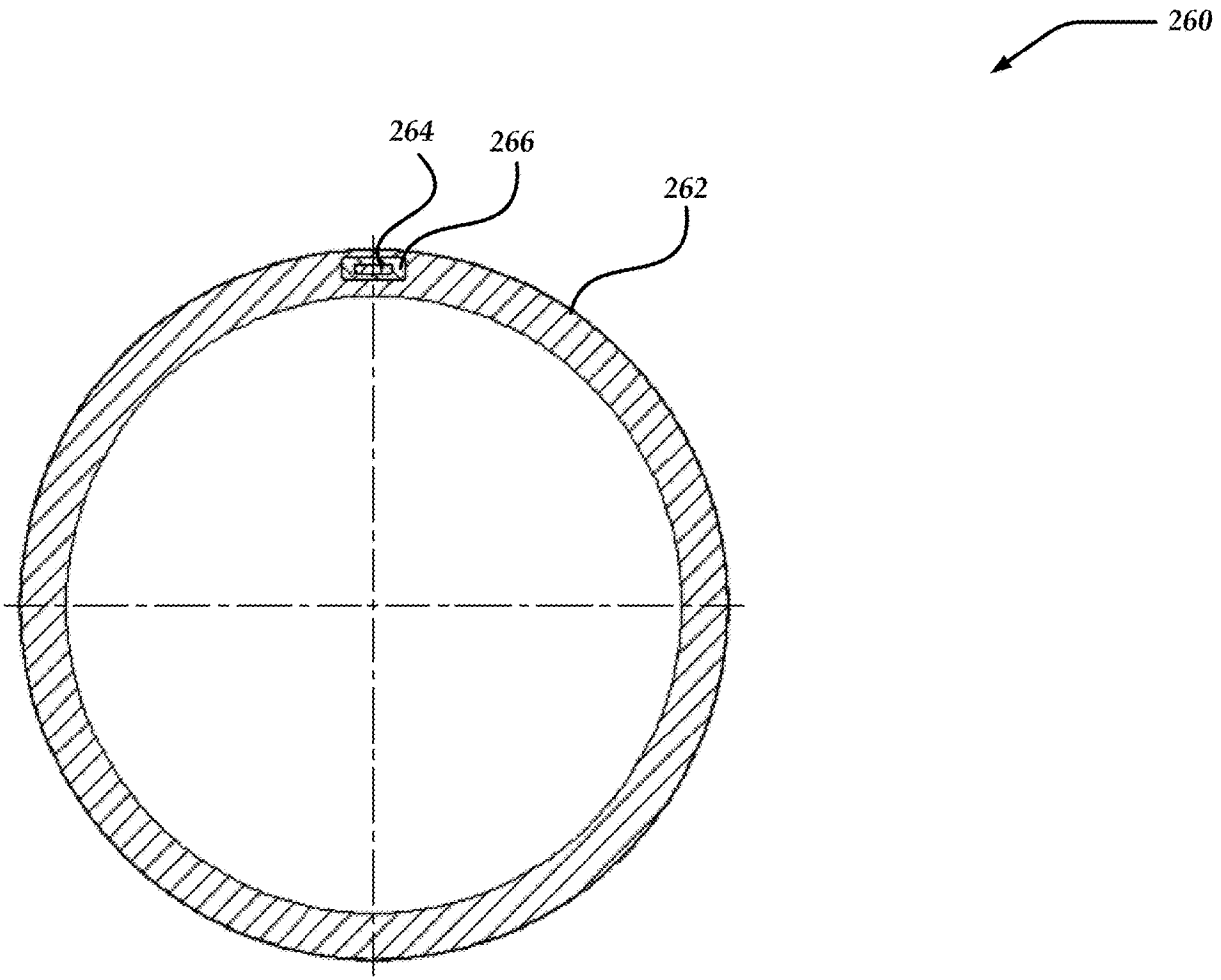
FIG. 27 shows a cross-sectional view of the barrel of FIG. 26, taken along line 27-27 in FIG. 26.

FIG. 26 shows an exploded view of a barrel 260 of a baseball or softball bat in accordance with the principles of the invention. The barrel 260 preferably includes a barrel shell 262 that is preferably the same or similar to one or more of the barrel shell 154, the barrel shell 178, the barrel shell 188, the barrel shell 214, or the barrel shell 234. The non-hitting face of the barrel 260 preferably includes a characteristic-modifying shaft 264. The characteristic-modifying shaft 264 is preferably wrapped in a sheet, such as a characteristic-modifying sheet 266. The characteristic-modifying shaft 264 preferably includes one or more of the damping materials described above regarding the sheet 236. When the sheet 266 is uncured, the sheet 266 is preferably wrapped around the shaft 264. In some versions, the sheet 266 is cured with an inner cavity that receives uncured material that is subsequently cured to form the shaft 264. The wrapped shaft 264 is then preferably inserted into a substantially longitudinally extending void defined by the barrel shell 262. The void is preferably created by removal of one or more portions of one or more layers in the barrel shell wall prior to curing the barrel shell 262. In some versions, the void is created by removing (for example, cutting or drilling) portions of the barrel shell wall after curing the barrel shell 262. In some versions, layers disposed outward of the inserted wrapped shaft 264 are laid onto the barrel shell 262 to cover the void and provide a cylindrical surface shape to the barrel 260. The outwardly disposed layers are preferably the same as or similar to the layers in the other portions of the barrel shell 262. In some versions, the outwardly disposed layers include one or more characteristic-modifying layers, such as layers that include one or more plies having substantially longitudinally extending fiber bundles or chopped and randomly oriented fibers in a polymer matrix. The shaft 264 and the sheet 266 preferably substantially longitudinally extend from the distal end portion 268 to a position between the proximal end portion 270 and the sweet spot 272. In some versions, the shaft 264 and the sheet 266 substantially longitudinally extend from a position disposed between the distal end portion 268 and the sweet spot 272 to the distal end portion 268, the proximal end portion 270, the sweet spot 272, a position between the proximal end portion 270 and the sweet spot 272, or another position between the distal end portion 268 and the sweet spot 272. In some versions, the shaft 264 and the sheet 266 substantially longitudinally extend from a position between the proximal end portion 270 and the sweet spot 272 to the proximal end portion 270, the sweet spot 272, or another position between the proximal end portion 270 and the sweet spot 272. In some versions, the barrel 260 includes more than two, three, four, five, or more characteristic-modifying shafts wrapped in respective characteristic-modifying sheets disposed in different respective longitudinal positions than the shaft 264 and the sheet 266 or each other or circumferentially offset from the shaft 264 and the sheet 266 or each other.

Figure 28:
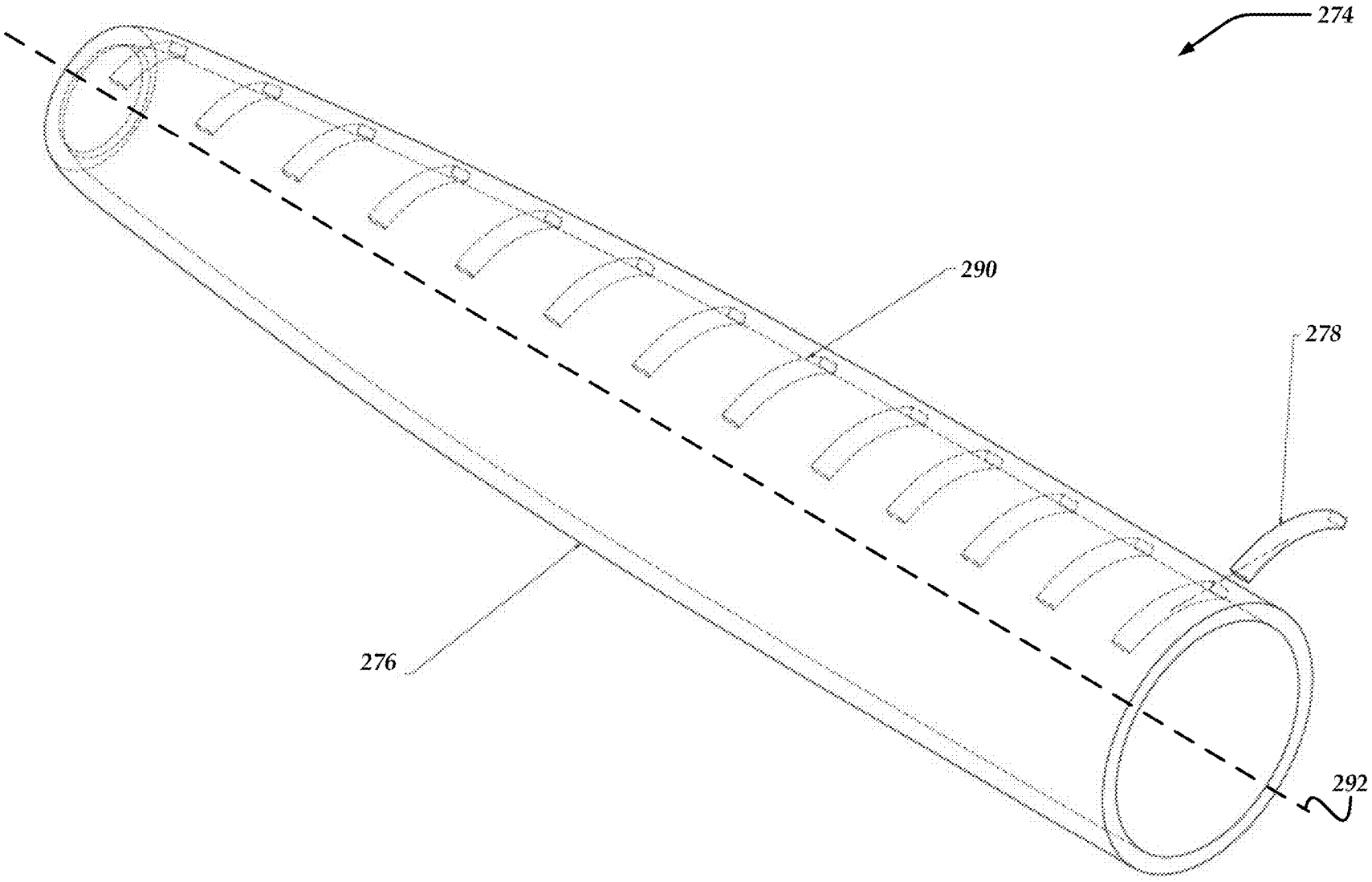
FIG. 28 shows a partially exploded transparent view of a preferred barrel of a baseball or softball bat.

FIG. 28 shows an exploded view of a barrel 274 of a baseball or softball bat in accordance with the principles of the invention. The barrel 274 preferably includes a barrel shell 276 that is preferably the same or similar to one or more of the barrel shell 154, the barrel shell 178, the barrel shell 188, the barrel shell 214, the barrel shell 234, or the barrel shell 262. The non-hitting face of the barrel 274 preferably includes one or more characteristic-modifying shafts, such as a characteristic-modifying shaft 278. In some versions, the non-hitting face of the barrel 274 also includes one or more characteristic-modifying sheets, as explained in other locations herein. The shafts are preferably unwrapped. In some versions, one or more of the shafts are wrapped in characteristic-modifying sheets in the same or similar manner as discussed regarding the shaft 264 and the sheet 266. The shafts are preferably disposed in substantially circumferentially extending voids, such as a substantially circumferentially extending void 290, defined by the barrel shell 276.

The voids are preferably made in the same or similar manner as described regarding the void defined by the barrel shell 262. Once installed in the barrel shell 276, the substantially circumferentially extending shafts are preferably spaced apart from each other along the longitudinal axis 292 of the barrel 274 by equal or unequal distances. The shafts are preferably distributed along the longitudinal axis 292 of the barrel in one or more of a variety of longitudinal arrangements. The shafts are preferably circumferentially aligned with each other. In some versions, one or more of the shafts are circumferentially offset from one or more of the other shafts. One or more of the shafts are preferably disposed between layers of the barrel shell wall. In some versions, one or more of the shafts are coupled to the outer surface of the barrel shell 276 or the inner surface of the barrel shell 276.

Figure 29:
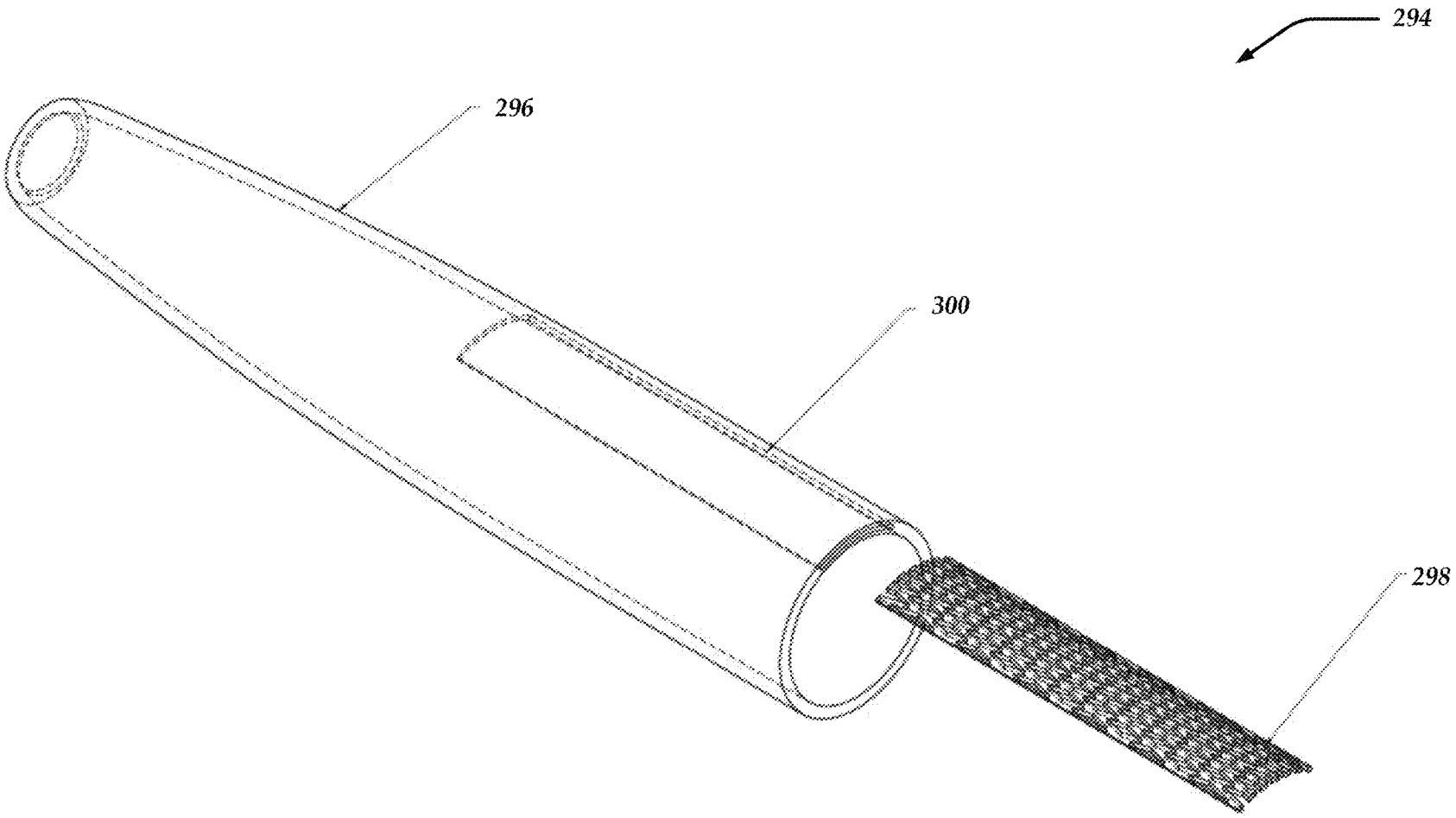
FIG. 29 shows an exploded transparent view of a preferred barrel of a baseball or softball bat.

FIG. 29 shows an exploded view of a barrel 294 of a baseball or softball bat in accordance with the principles of the invention. The barrel 294 preferably includes a barrel shell 296 that is preferably the same or similar to one or more of the barrel shell 154, the barrel shell 178, the barrel shell 188, the barrel shell 214, the barrel shell 234, the barrel shell 262, or the barrel shell 276. The non-hitting face of the barrel 294 preferably includes one or more characteristic-modifying sheets, such as a characteristic-modifying sheet 298. The sheet 298 preferably includes composite fibers disposed in a weave pattern. The barrel shell 296 preferably defines a void 300. The void 300 is preferably created as described with respect to any other void disclosed herein. The sheet 298 is preferably disposed in the void 300. The void 300 is preferably closed in one or more of a variety of closed arrangements. The sheet 298 is preferably disposed along the length of the barrel 294 in one or more of a variety of longitudinal arrangements. In some versions, the sheet 298 includes damping material, such as an elastomeric material (for example, unsaturated rubber, such as nitrile rubber, butyl rubber, or styrene rubber or saturated rubber, such as silicone, ethylene, propylene diene rubber, fluorosilicone rubber, or fluroelastomer), unreinforced polymer, or a polymer composite that includes randomly oriented fibers.

Figure 30:
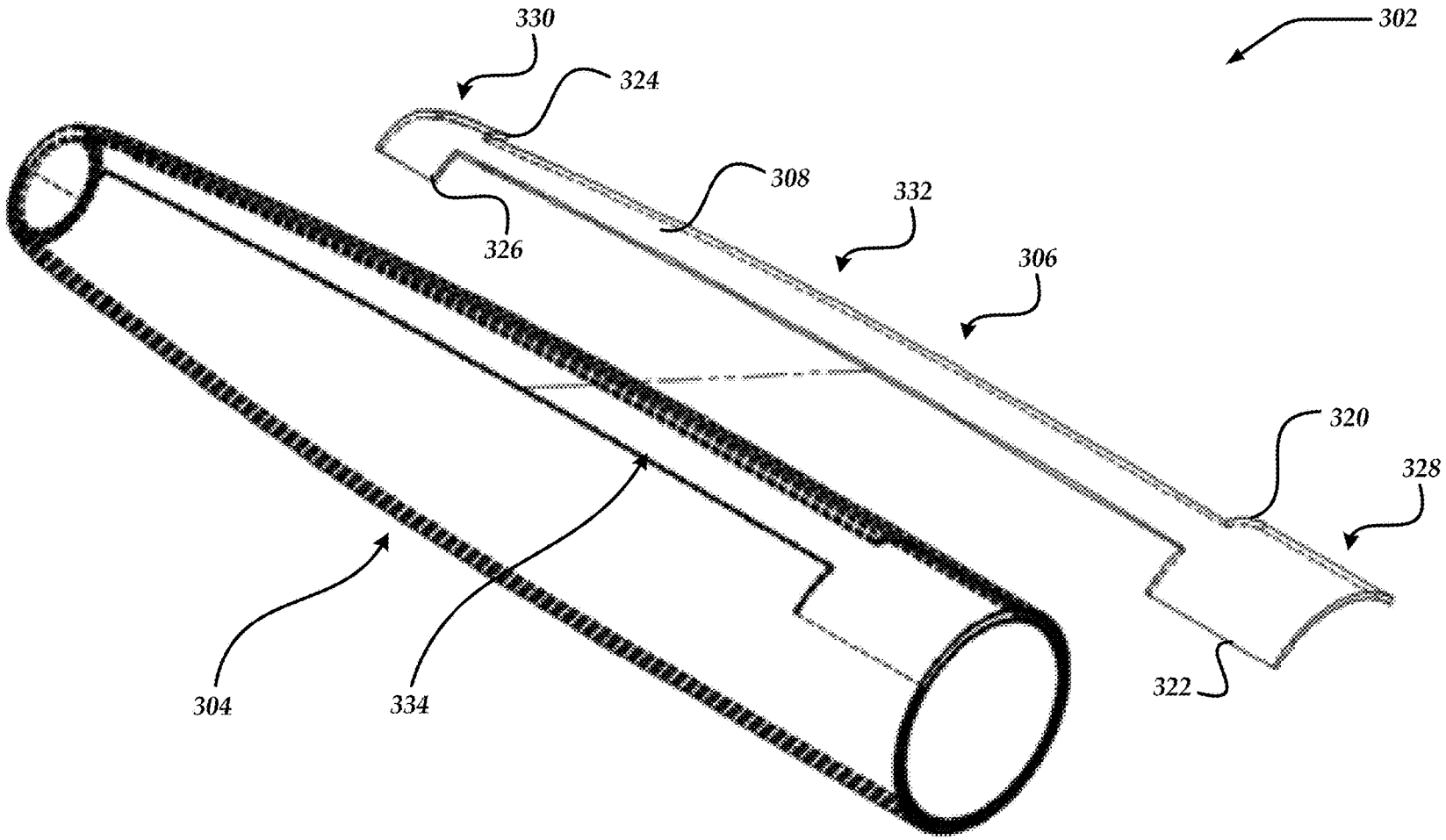
FIG. 30 shows an exploded transparent view of a preferred barrel of a baseball or softball bat.

FIG. 30 shows an exploded view of a barrel 302 of a baseball or softball bat in accordance with the principles of the invention. The barrel 302 preferably includes a barrel shell 304 that is preferably the same or similar to one or more of the barrel shell 154, the barrel shell 178, the barrel shell 188, the barrel shell 214, the barrel shell 234, the barrel shell 262, the barrel shell 276, or the barrel shell 296. The non-hitting face of the barrel 302 preferably includes one or more characteristic-modifying sheets, such as a characteristic-modifying sheet 306. The sheet 306 preferably includes one or more longitudinally extending portions, such as longitudinally extending portion 308, and one or more circumferentially extending portions, such as circumferentially extending portions 320-326. One or more of the circumferentially extending portions 320, 322 are preferably disposed at the distal end portion 328 of the sheet 306. One or more of the circumferentially extending portions 324, 326 are preferably disposed at the proximal end portion of the sheet 306. In some versions, one or more circumferentially extending portions are disposed at a middle portion 332 of the sheet 306. The barrel shell 304 preferably defines one or more voids, such as a void 334, that are configured to receive the one or more characteristic-modifying sheets, such as sheet 306. The sheet 306 and the void 334 are preferably I-shaped. In some versions, one or more sheets and a corresponding one or more voids in the barrel shell 304 are D-shaped E-shaped, S-shaped, T-shaped, U-shaped, V-shaped, X-shaped, Y-shaped, Z-shaped, oval, rectangular, triangular, or others.

Each void is preferably created in one or more of a variety of void-creation manners. Each sheet is preferably disposed in a corresponding void. Each void is preferably closed in one or more of a variety of closing arrangements. Each sheet is preferably disposed along the length of the barrel 302 in one or more of a variety of longitudinal arrangements. In some versions, one or more sheets includes damping material.

Figure 31:
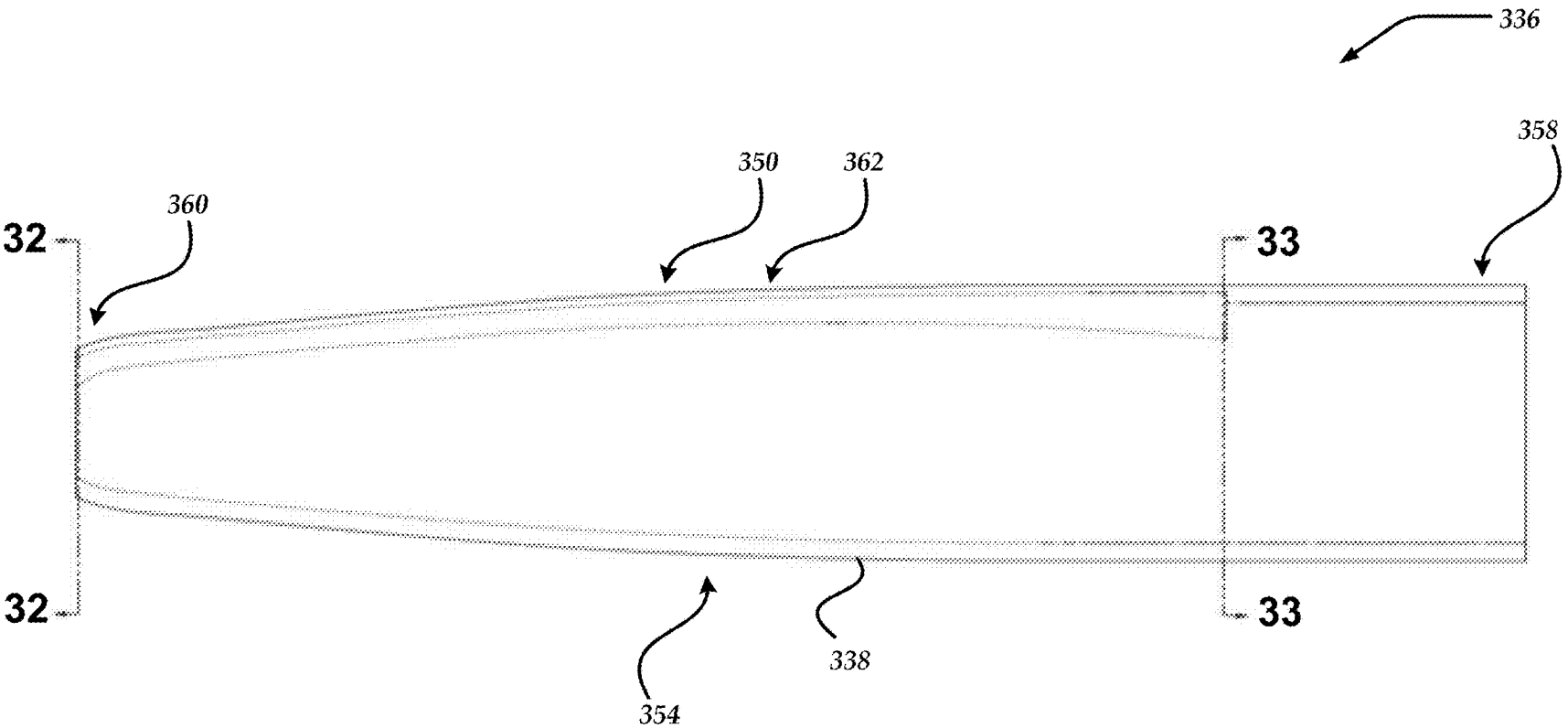
FIG. 31 shows a transparent side-elevational view of a preferred barrel of a baseball or softball bat.
Figure 32:
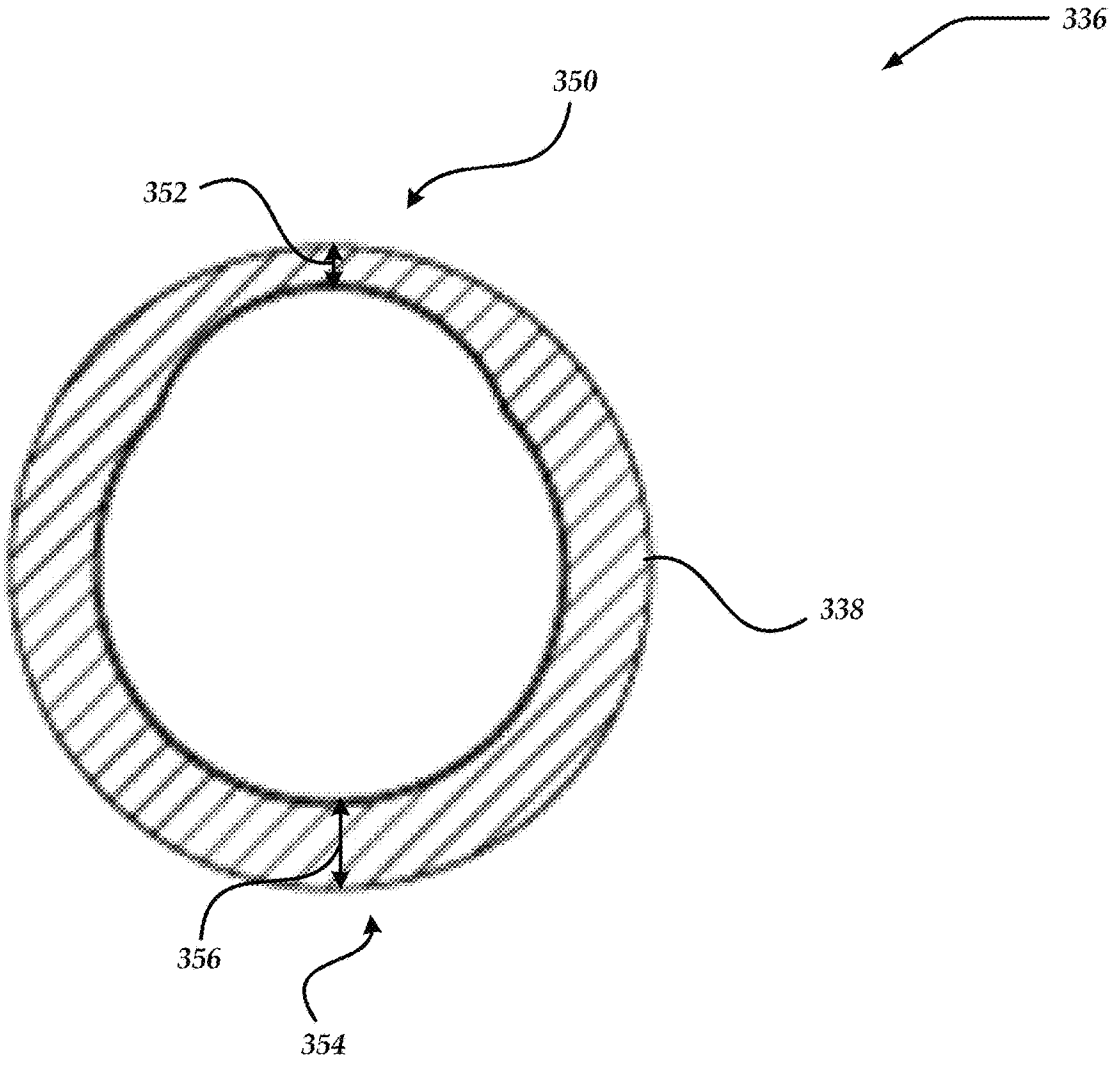
FIG. 32 shows a schematic representation of a cross-sectional view of the barrel of FIG. 31, taken along the line 32-32 in FIG. 31.
Figure 33:
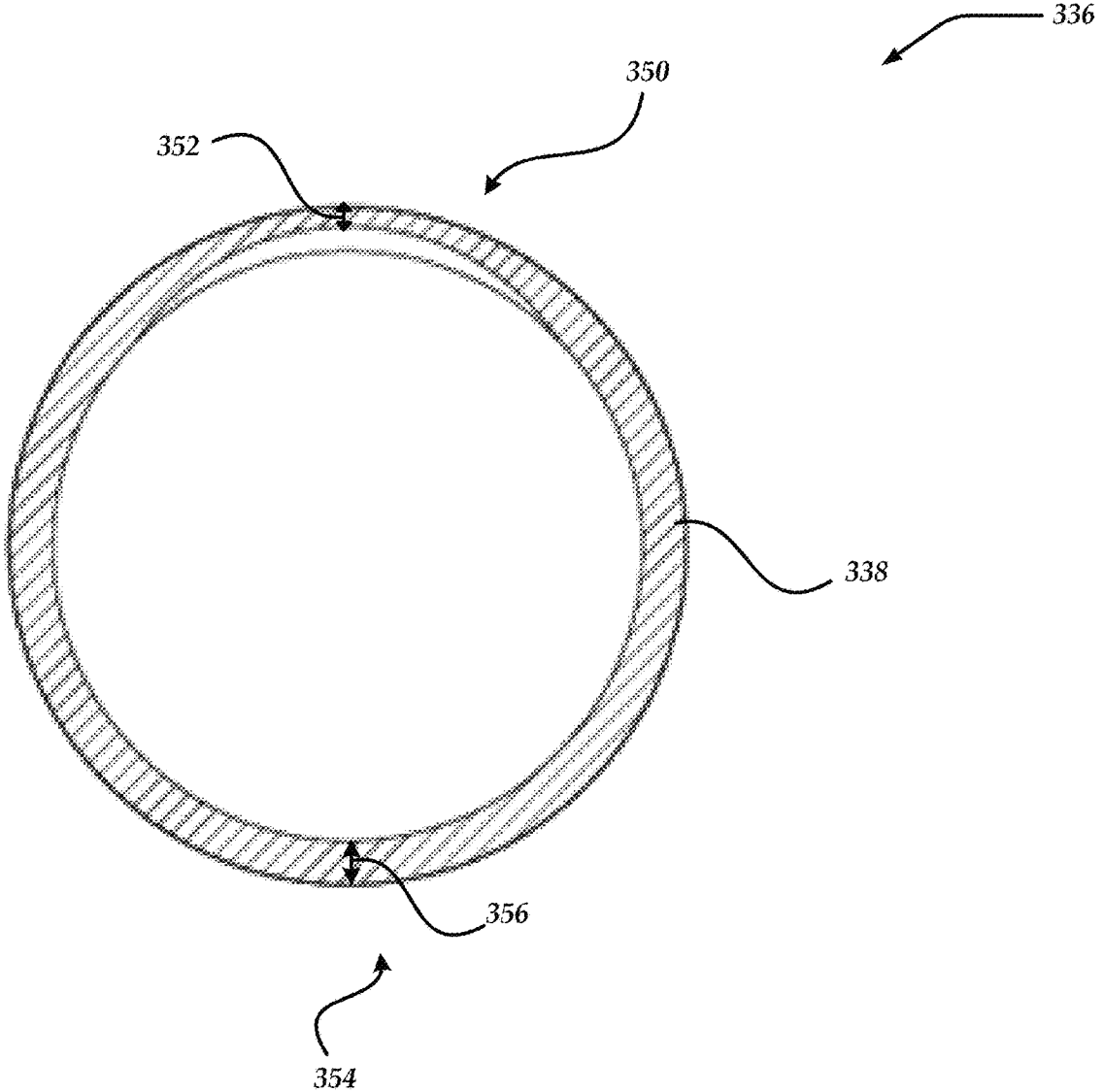
FIG. 33 shows a schematic representation of a cross-sectional view of the barrel of FIG. 31, taken along the line 33-33 in FIG. 31.

FIG. 31 shows a transparent elevational-side view of a barrel 336 of a baseball or softball bat in accordance with the principles of the invention. The barrel 336 preferably includes a barrel shell 338 that is preferably the same or similar to one or more of the barrel shell 154, the barrel shell 178, the barrel shell 188, the barrel shell 214, the barrel shell 234, the barrel shell 262, the barrel shell 276, the barrel shell 296, or the barrel shell 304. The barrel shell wall along the non-hitting face 350 of the barrel 336 preferably has a thickness 352 (see FIGS. 32 and 33, which are schematic representations of cross-sectional views respectively taken along lines 32-32 and 33-33 in FIG. 31). The barrel shell wall along the hitting face 354 of the barrel 336 preferably has a thickness 356 (see FIGS. 32 and 33). The thickness 352 of one or more portions of the barrel shell wall along the non-hitting face 350 is preferably different from the thickness 356 of one or more corresponding portions of the barrel shell wall along the hitting face 354 (such as corresponding portions disposed at different circumferential locations yet at the same longitudinal location). The asymmetrical construction or composition of the barrel 336 preferably causes the barrel 336 to break if rolled yet not break when the barrel 336 incurs normal baseball or softball collisions on the hitting face 354.

The thickness 352 of the barrel shell wall along the non-hitting face 350 is preferably non-uniform along the length of the barrel 336. For example, the thickness 352 at the distal end portion 358 of the non-hitting face 350 may substantially match the thickness of the corresponding portion of the hitting face 354, and the thickness 352 at one or more of the proximal end portion 360 or the middle portion 362 of the non-hitting face 350 may be different than one or more of each other, the thickness 352 at the distal end portion 358 of the non-hitting face 350, or the thicknesses 356 of the corresponding portions of the hitting face 354. The variations in the thickness 352 along the non-hitting face 350 may be disposed in a variety of longitudinal arrangements or in a variety of circumferential arrangements. The thickness 352 preferably gradually varies along the circumference of the non-hitting face 350 of the barrel 336, transitioning from the thickness 356 to a minimal amount of the thickness 352 (see FIGS. 32 and 33). In some versions, the transition between the thickness 352 and the thickness 356 is abrupt, such as a corner transition as opposed to gradual slope.

Figure 34:
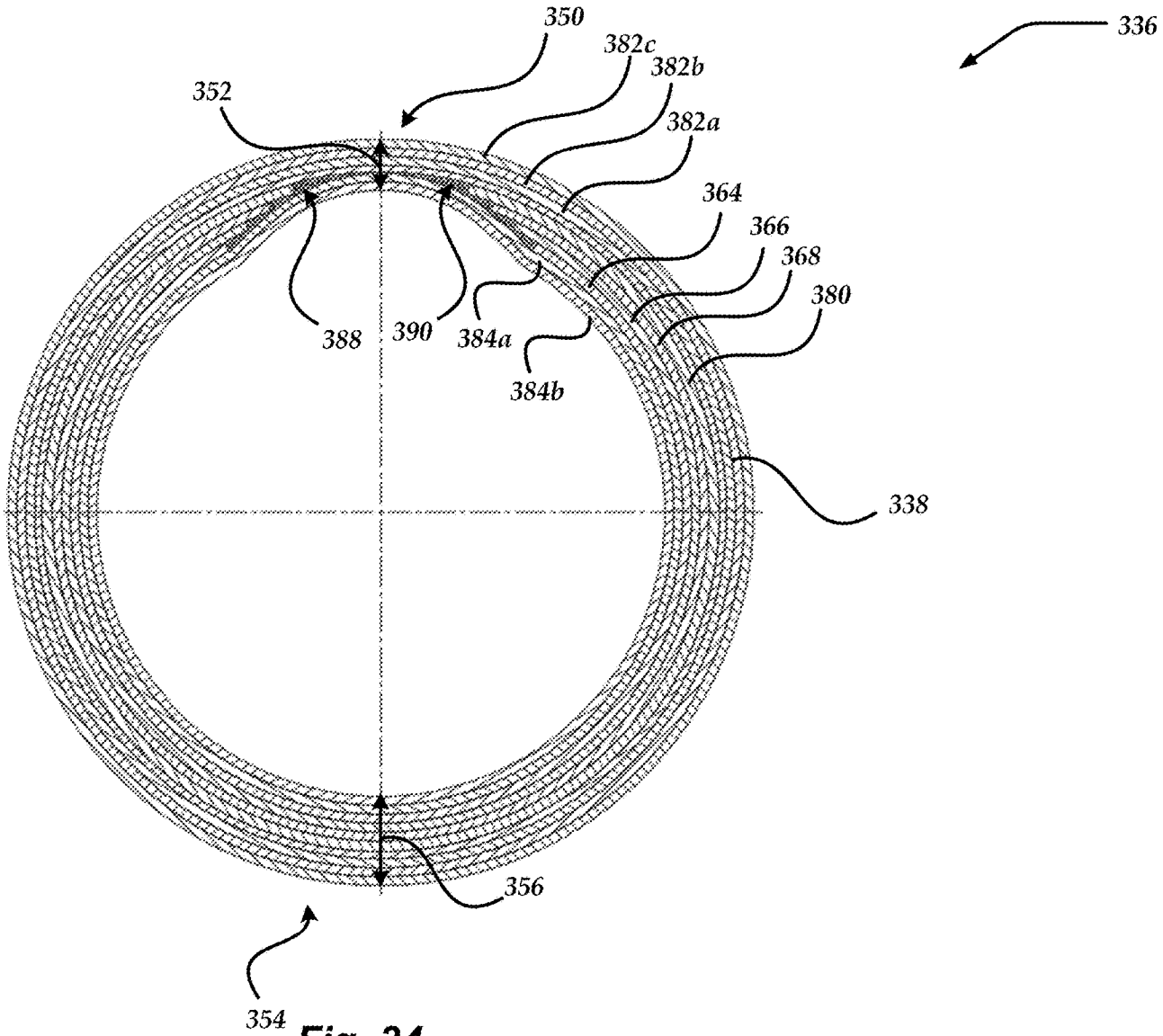
FIG. 34 is a cross-sectional view of the barrel of FIG. 31, taken along the line 32-32 in FIG. 31.

FIG. 34 shows a cross-sectional view of the layers of the barrel 336 taken along line 32-32 in FIG. 31. One or more portions of the barrel shell 338 along the non-hitting face 350 preferably includes fewer layers than one or more corresponding portions of the barrel shell 338 along the hitting face 354. As shown in FIG. 34, one or more layers, such as layers 364-380, preferably extend only partially around the circumference of the barrel 336 and, most preferably, do not extend into or only partially extend into the non-hitting face 350 of the barrel 336. One or more layers, such as layers **382*a*-384*b*, preferably extend around the entire circumference of the barrel 336 and, most preferably, have a uniform thickness about the entire circumference of the barrel 336. One or more layers that do not extend entirely around the circumference of the barrel 336 are preferably disposed outward of one or more layers, such as layers 384*a*, 384*b* that extend about the entire circumference of the barrel 336 and inward of one or more layers, such as layers 382*a*-382*c*, that extend about the entire circumference of the barrel 336. The barrel 336 preferably has a substantially cylindrical outer shape. One or more portions of the non-hitting face 350 preferably include a polymeric resin or tapered sheets, such as resin regions 388, 390 that facilitate tapering the thickness of the barrel 336. Accordingly, the non-hitting face 350 of the barrel 336** preferably includes a thin laminate that is configured to crack if directly hit with a baseball or softball or if rolled.

Figure 42:
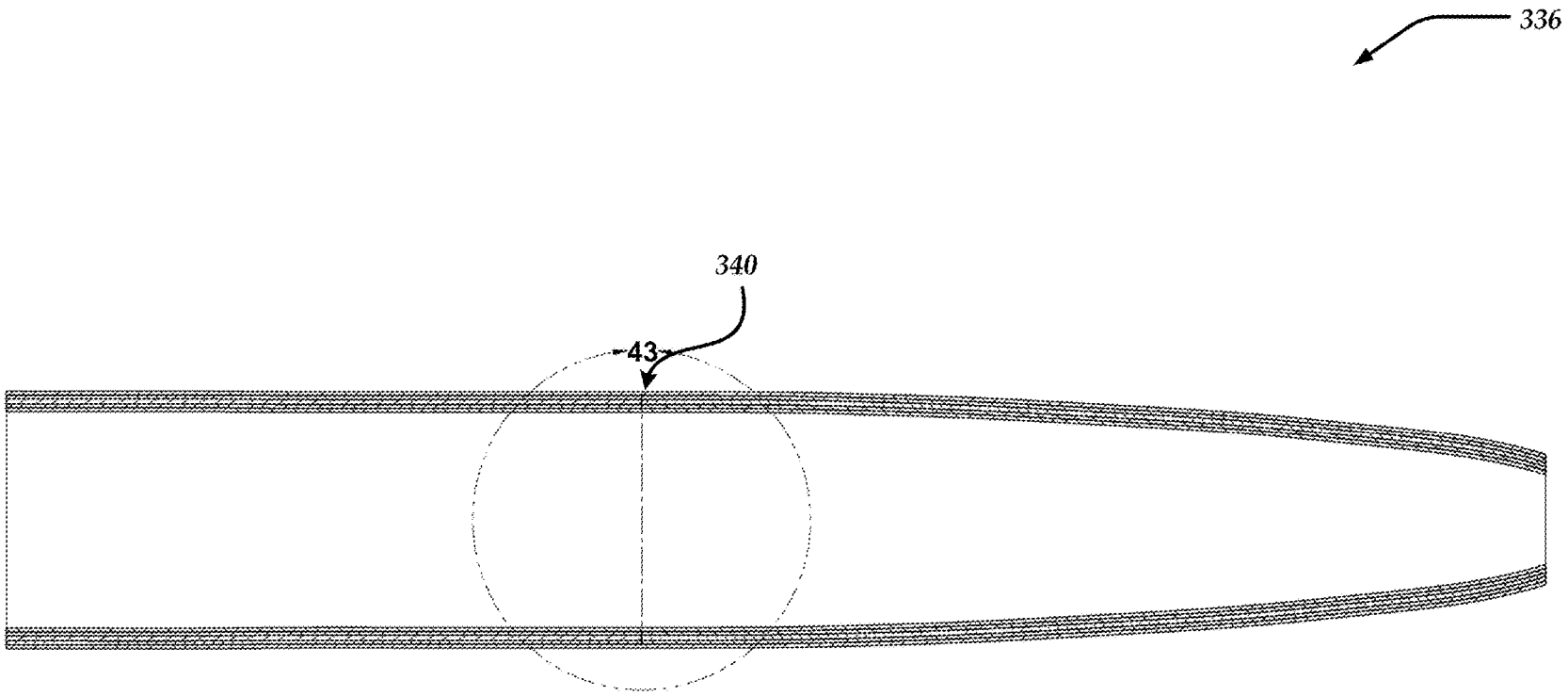
FIG. 42 is a cross-sectional view of the barrel of FIG. 31, taken along the longitudinal axis of the barrel of FIG. 31.
Figure 43:
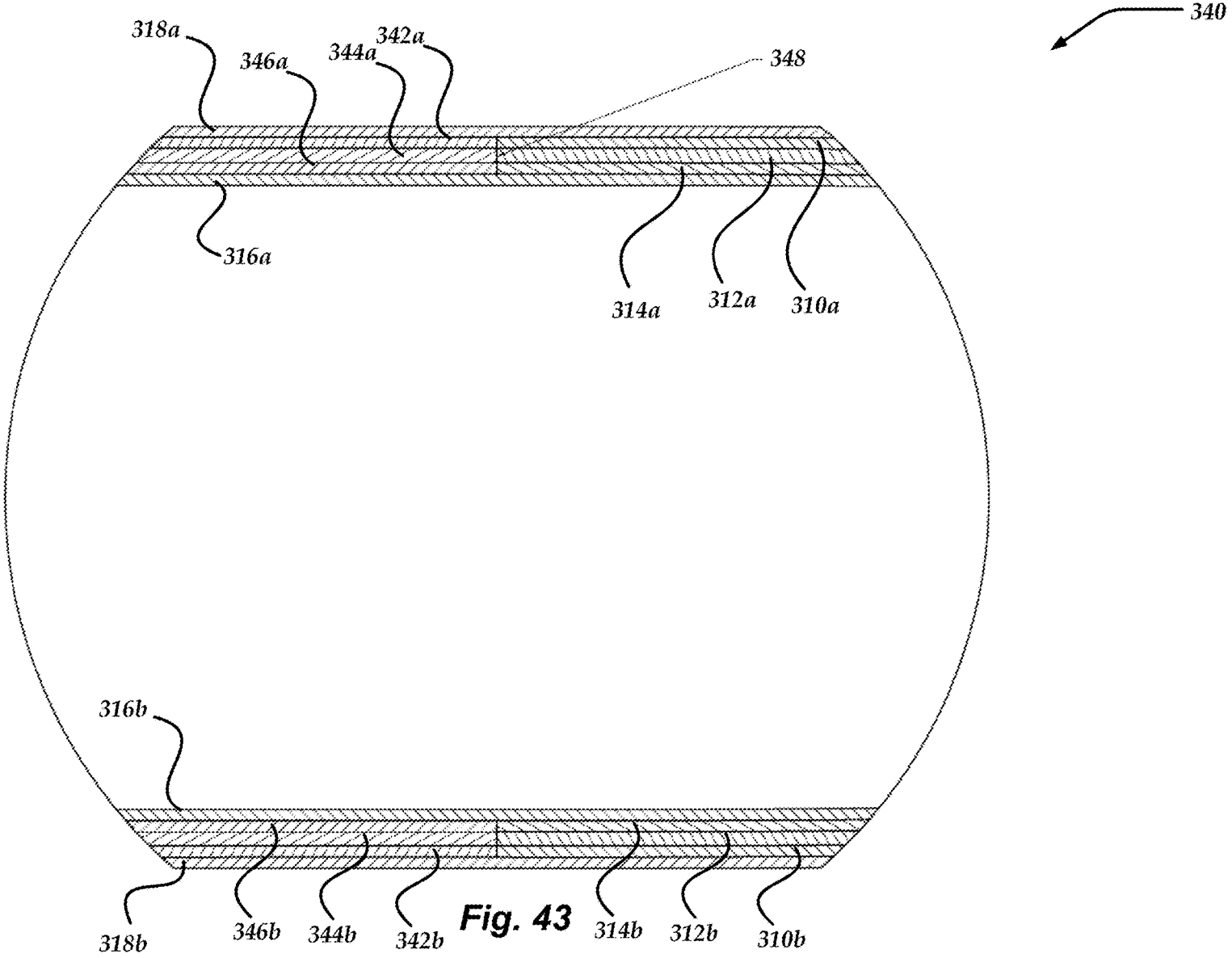
FIG. 43 is a detail view of a portion of the cross-sectional view of FIG. 42, taken within the circle 43 in FIG. 42.

In some versions, the non-hitting face 350 includes a trigger, such as the trigger 340 (see FIG. 43, which is a detail view of the portion of the barrel 336 in the circle 43 in FIG. 42). The trigger 340 is preferably defined by a set of non-overlapping plies, such as trigger plies **342*a*-346*b* that form a butt-to-butt joint 348 in combination with trigger plies 310*a*-314*b*. In contrast, the plies in the location of the joint 348 would ordinarily be continuous and extend from the barrel 336 and through the transition portion to the handle. Accordingly, the joint 348 in the laminate of the barrel 336 or barrel shell 348 preferably provides a hinge to facilitate failure in the barrel shell 338 when rolled. One or more cap plies, such as cap plies 316*a*-318*b*, preferably extend over the joint 348 to facilitate preventing hinging of the bat at the joint 348 until the trigger 340 is activated by rolling the bat, which preferably eliminates or significantly reduces the hoop stiffness in the region of the joint 348. In some versions, one side of the joint 348 has more plies than the other side of the joint 348, thereby facilitating increasing the stiffness that a nylon roller must overcome during the rolling process and thereby further stressing the trigger 340** to failure during such tampering process. The trigger 340 is preferably formed by laying up one or more layers of continuous inner plies to define one or more cap plies 316*a*, 316*b*, cutting one or more inner plies, laying up the cut plies with the ends of the cut plies being disposed butt-to-butt to define the trigger plies 342*a*-346*b*, 310*a*-314*b* and the joint 348, and laying up one or more layers of continuous outer plies to define the cap plies 318*a*, 318*b*. The joint 348 preferably extends circumferentially around the entire circumference of the barrel 336. The joint 348 is preferably located between the sweet spot and the transition portion of the barrel 336 and, most preferably, closer to the transition portion than the sweet spot to facilitate increasing the length of the lever defined by the joint 348 and thereby increasing the likelihood that the bat breaks when impacting a ball after tampering by rolling. In some versions, the joint 348 is located at the distal edge of the transition portion. Accordingly, the barrel 336 facilitates the barrel 336 being manufactured with higher original performance due to the removal of risk that the performance subsequently increases based on delamination as a result of rolling.

Figure 35:
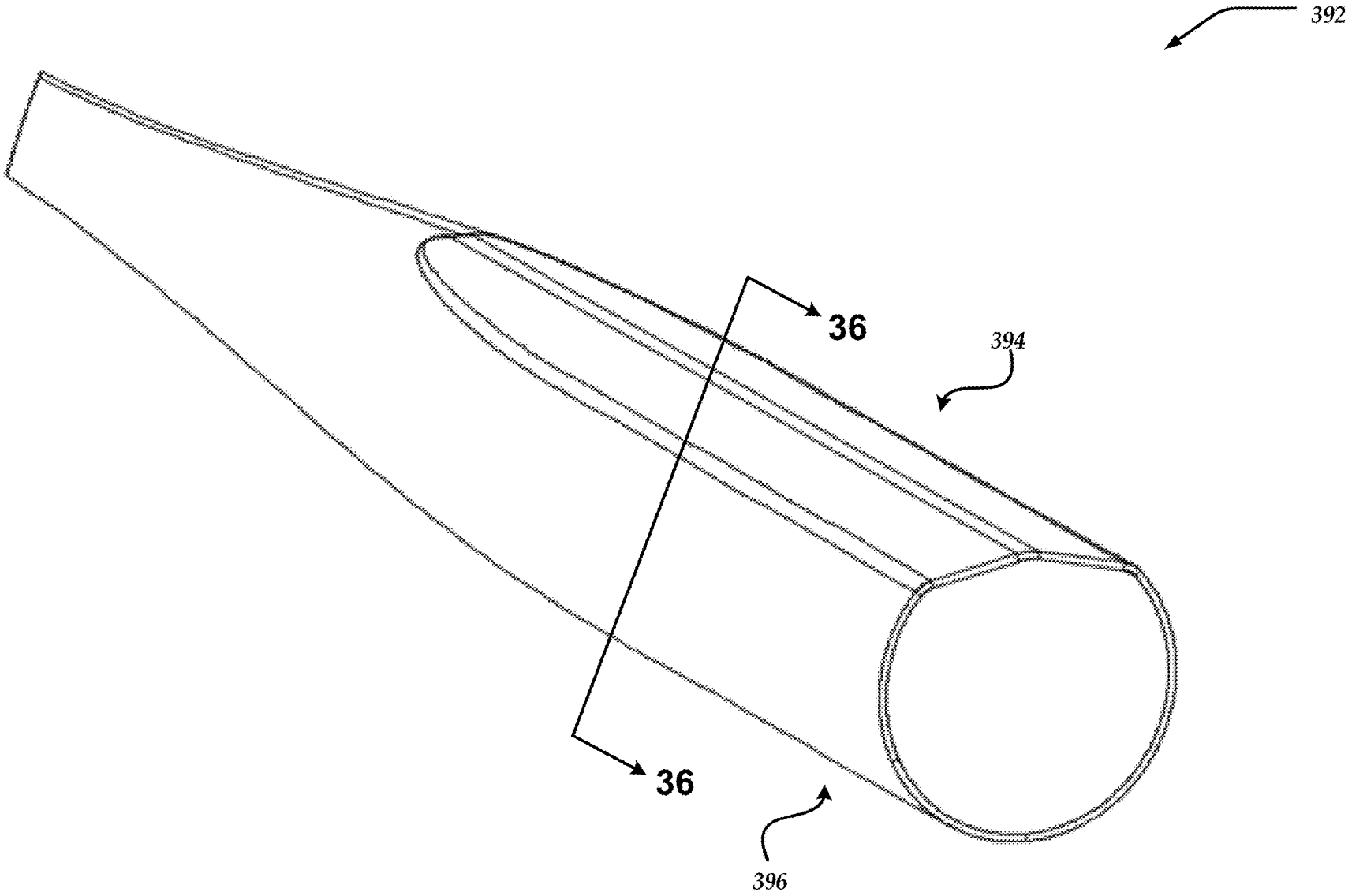
FIG. 35 is perspective view of a preferred barrel shell of a baseball or softball bat.
Figure 36:
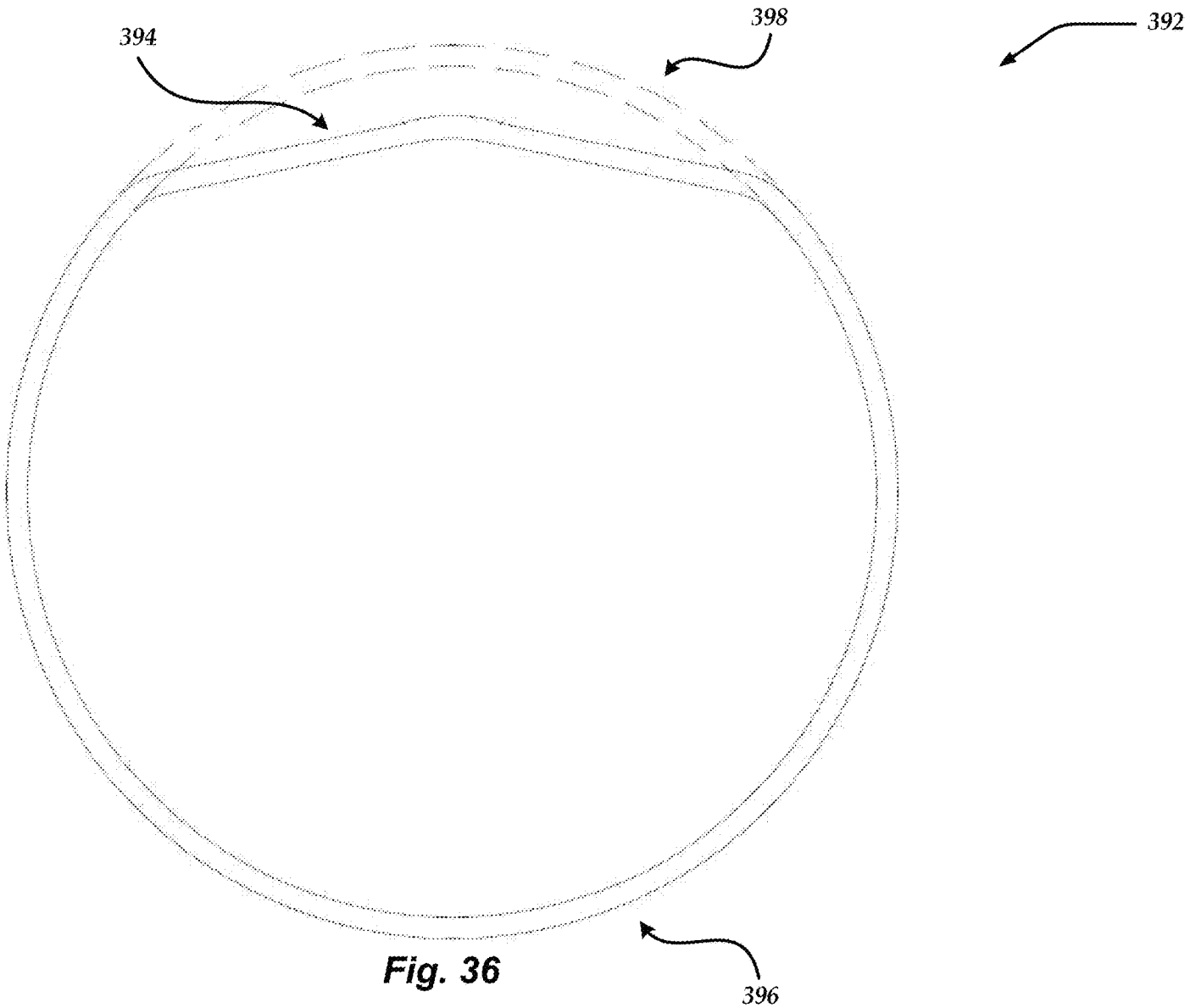
FIG. 36 is a schematic representation of a top plan view of the barrel of FIG. 35 in different stages of the manufacturing process.

FIG. 35 shows a barrel shell 392 of a baseball or softball bat in accordance with the principles of the invention. The barrel shell 392 is preferably the same or similar to one or more of the barrel shell 34, the barrel shell 98, or the barrel shell 130. The barrel shell 392 preferably defines a non-hitting face 394 and a hitting face 396. FIG. 36 shows a cross-sectional view of the barrel shell 392 taken along line 36-36 in FIG. 35, with dashed lines representing a preferred original non-hitting face 398 of the barrel shell 392 during an intermediate phase in the preferred manufacturing process. The barrel shell 392 is preferably manufactured to originally have a cylindrical shape, including the original non-hitting face 398. The shell wall of the barrel shell 392 is preferably thinner along the non-hitting face 398 than the hitting face 396, thereby facilitating reducing the weight of the barrel shell 392. The reduced thickness of the non-hitting face 398 is preferably achieved by grinding or another subtractive manufacturing process. The non-hitting face 398 is preferably pressed and thereby deformed or bent to provide a non-cylindrical shape to the non-hitting face 394 of the barrel shell 392, such as a secant shape. The non-cylindrical shape of the non-hitting face 394 preferably increases the strength and stiffness of the barrel shell 392.

Figure 37:
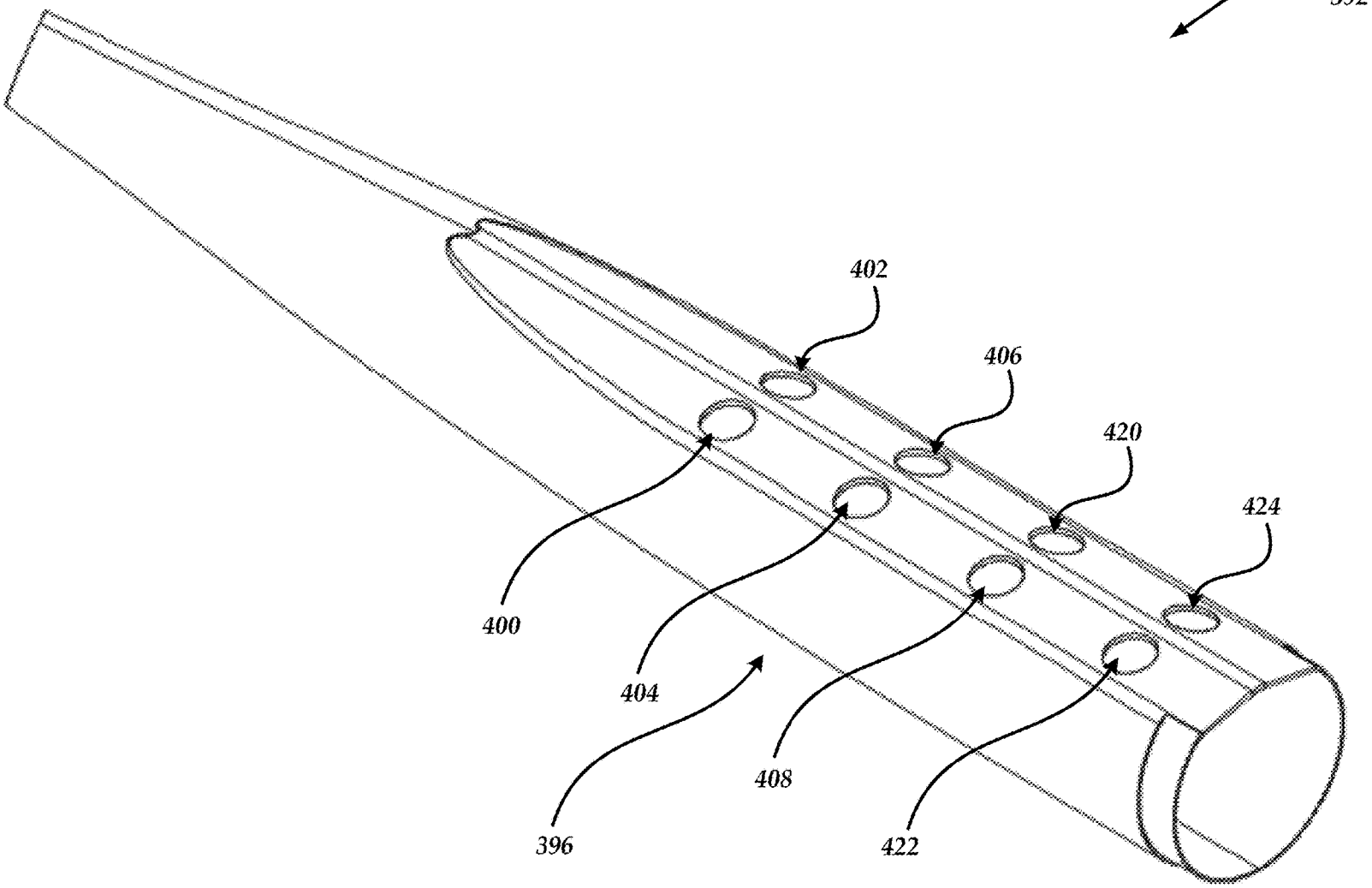
FIG. 37 is a perspective view of the barrel of FIG. 35 in another stage of the manufacturing process.
Figure 38:
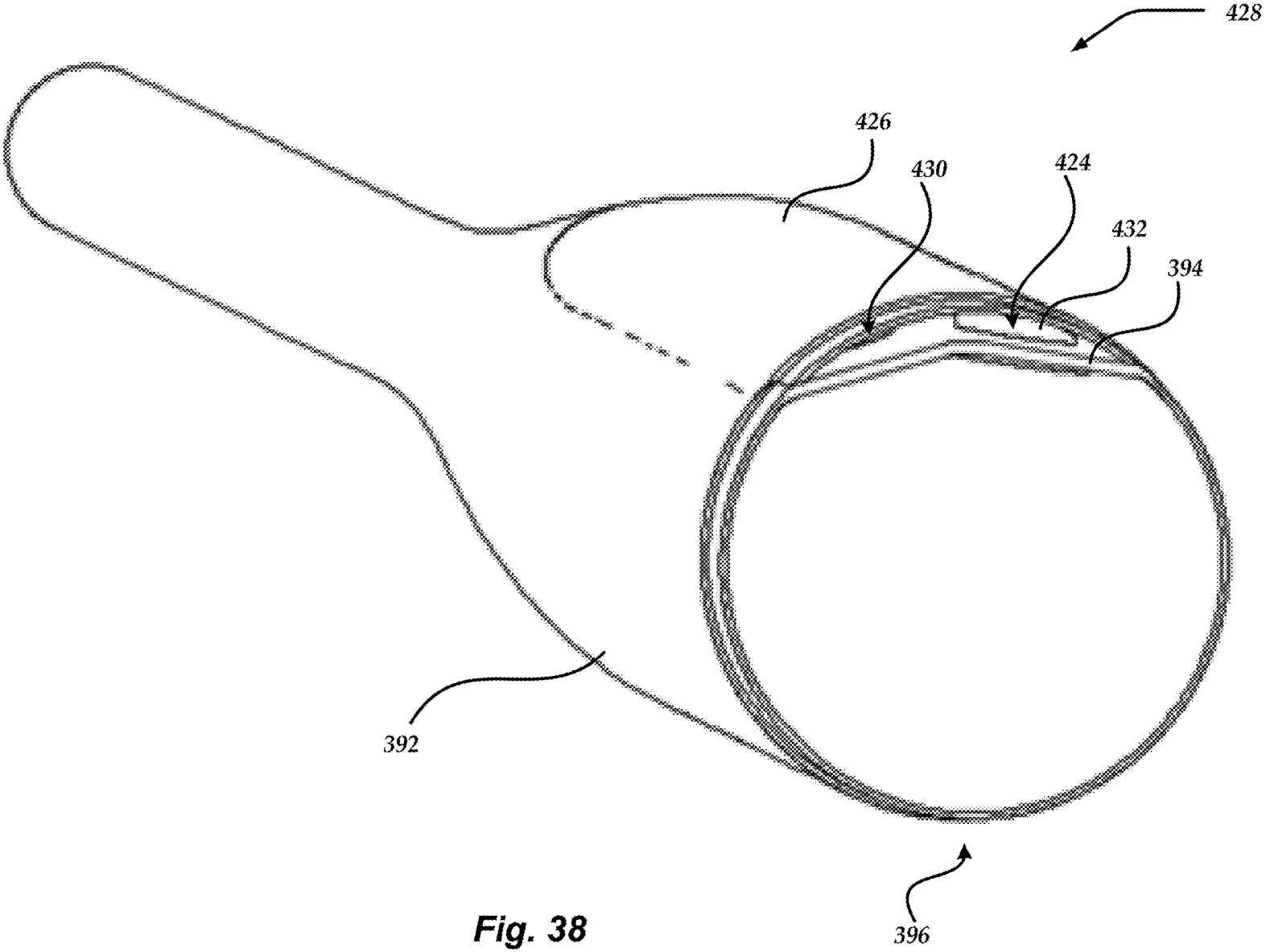
FIG. 38 is a perspective view of a barrel of a baseball or softball bat that includes the barrel shell of FIG. 35.
Figure 39:
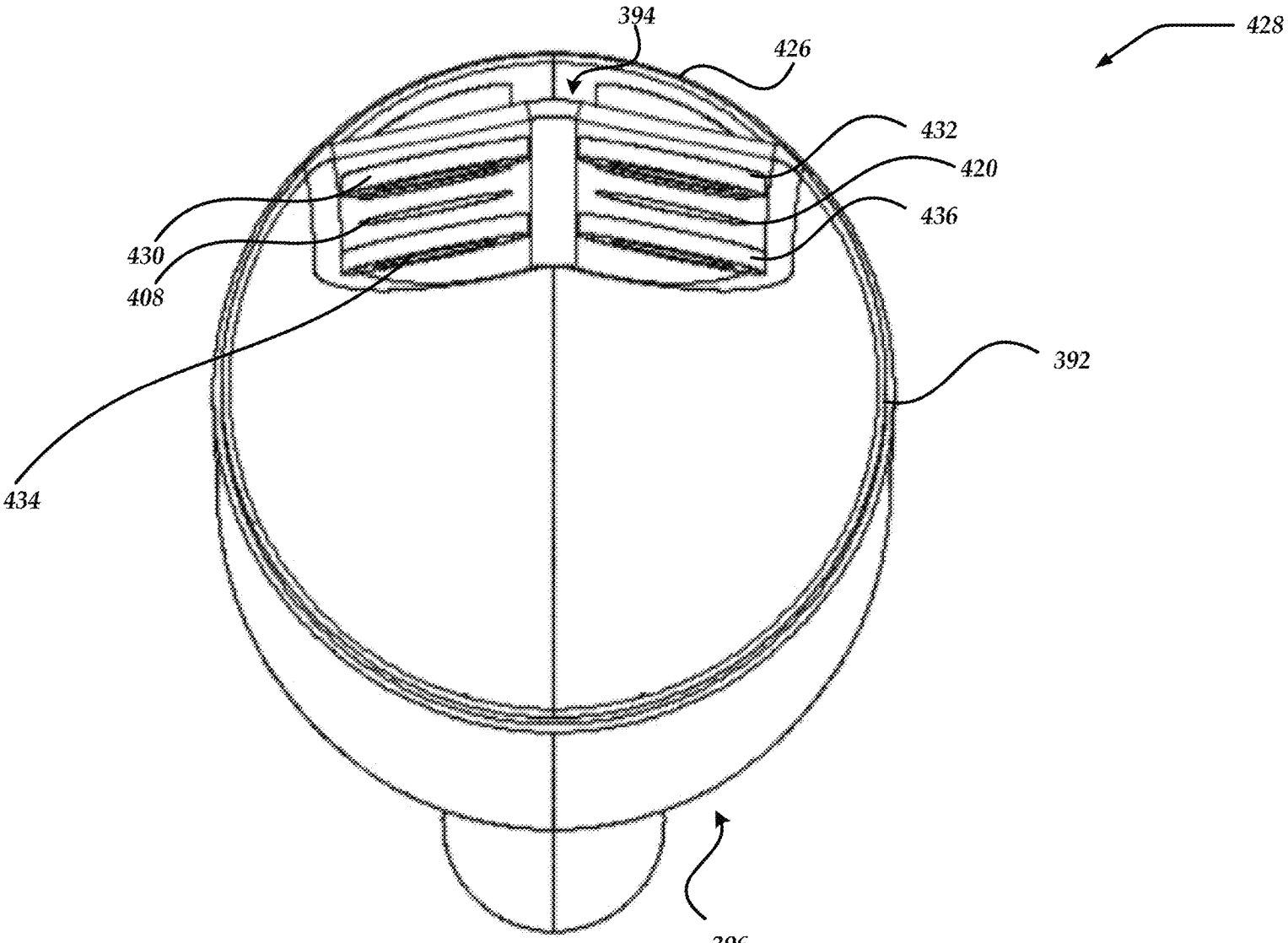
FIG. 39 is a distal-end view of the barrel of FIG. 38.
Figure 40:
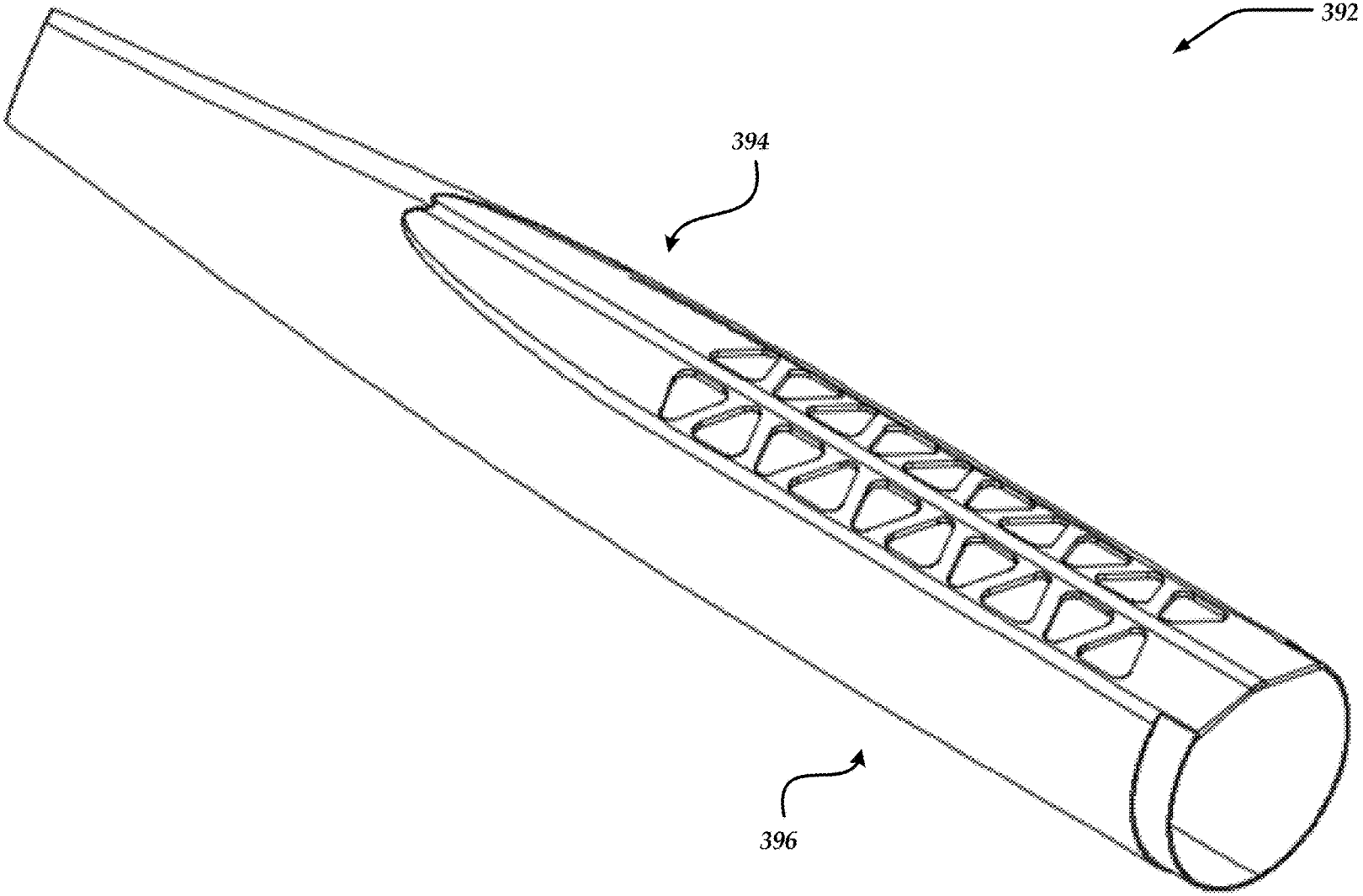
FIG. 40 is a perspective view of the barrel shell of FIG. 35 having undergone a different manufacturing process.
Figure 41:
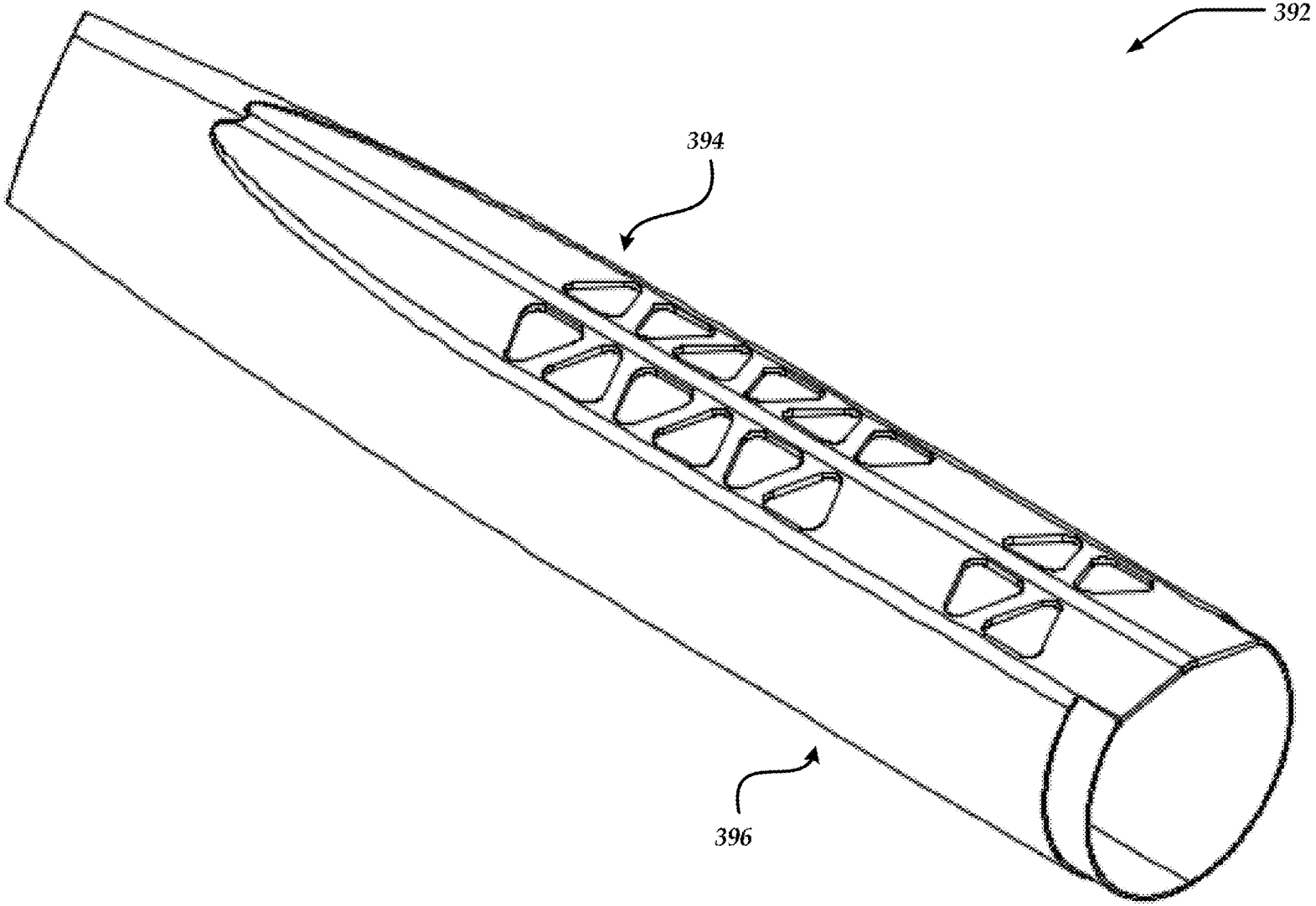
FIG. 41 is a perspective view of the barrel shell of FIG. 35 having undergone another manufacturing process.

As shown in FIG. 37, one or more couplers, such as couplers 400-424, are preferably defined by the non-hitting face 394 of the barrel shell 392. In some versions, one or more couplers are coupled (for example, coupled with adhesive or one or more fasteners) to the non-hitting face 394 of the barrel shell 392. The couplers 400-424 are preferably configured to receive an insert, such as a spine cap 426, and couple the spine cap 426 to the barrel shell 392 to completes the cylindrical shape of the barrel 428 of the baseball or softball bat. As shown in the distal-end view of FIG. 39, the spine cap 426 preferably includes one or more couplers, such as couplers 430-436, that are configured to be received by or couple to one or more of the couplers 400-424. The couplers 400-424 preferably include holes, and the couplers 430-436 preferably include projections with flanges having greater diameters than the couplers 400-424, thereby facilitating the spine cap 426 being secured to the barrel shell 392 when the flanges are pressed through the holes. The holes are preferably circular. In some versions, the holes have other shapes, such as triangular shapes (see FIGS. 40 and 41), and the projections or flanges are similarly shaped. The holes and the projections may be disposed in a variety of longitudinal arrangements (see FIGS. 40 and 41). In some versions, the sweet spot is devoid of holes and projections to increase the stiffness of the sweet spot (see FIG. 41). In some versions, the non-hitting face 394 and the spine cap 426 are devoid of couplers and are instead coupled to each other with adhesive.

As used herein, the following terms take the meanings explicitly associated herein, unless the context clearly dictates otherwise. The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular.

The term "configured" refers to being one or more of sized, dimensioned, oriented, or positioned to achieve the recited feature, function, objective, or result. The term "substantially the same orientation" in reference to a players grip and barrel orientation refers to the orientation of the barrel at the moment of impact in a traditional baseball or softball swing such that a majority of swings by the player result in no more than 10, 20, 30, 40, 60, 90, or 120 degrees of variation in the orientation of the bat across those majority of swings. The term "hitting face" refers to the side of a barrel or barrel shell of a bat that contacts the ball during a majority of traditional baseball or softball swings that make contact with the ball, wherein the bat has one or more characteristics that induce a player to grip the bat with substantially the same orientation each time the player grips the bat to swing during competitive game play. The hitting face preferably constitutes approximately two thirds of the circumference of the barrel. The term "spine" refers to the non-hitting face of the barrel or barrel shell. The term "non-hitting face" refers to the side of a barrel or barrel shell of a bat that does not contact the ball during a majority of traditional baseball or softball swings that make contact with the ball, wherein the bat has one or more characteristics that induce a player to grip the bat with substantially the same orientation each time the player grips the bat to swing during competitive game play. The non-hitting face preferably constitutes approximately one third of the circumference of the barrel. The hitting face and the non-hitting face of a barrel include the structure that defines the barrel. The term "barrel" does not include inserts disposed radially inward of the barrel wall, such as the insert 246 described herein or the insert 202 in U.S. Pat. No. 9,498,690. The term "construction" refers to an arrangement of materials but not a quantity or size of such materials. For example, a barrel having symmetrical construction may have a non-hitting face that is thinner than the hitting face. The term "composition" refers to materials or material types. For example, a barrel having asymmetrical composition preferably has a non-hitting face that includes one or more materials or types of materials that are absent from the hitting face of the barrel.

The term "sweet spot" refers to an area on the hitting-face of a barrel that extends approximately three inches toward the distal end portion of the barrel and approximately three inches toward the proximal end portion of the barrel from the center of percussion ("COP"). The COP is preferably defined by ASTM International (formerly known as American Society for Testing and Materials) Standard F2219.

The term "approximately" in the context of numerical values refers to a value that is the same as or within (plus or minus) 75, 50, 25, 20, 15, 10, 5, or less percent of the stated value or values. The term "near" refers to a distance that is 30, 25, 20, 15, 10, 5, or fewer inches. The term "substantially parallel" refers to parallel or within 30, 25, 20, 15, 10, 5, or less degrees of parallel. The term "substantially orthogonal" refers to orthogonal or within 60, 45, 30, 25, 20, 15, 10, 5, or less degrees of orthogonal. The term "transverse" refers to a non-parallel orientation and includes yet is not limited to a perpendicular orientation.

The term "characteristic-modifying" refers to a component that forms at least a portion of a barrel or barrel wall, such as an insert or a sheet, having one or more of different performance characteristics (for example, BBCOR or BBS) than the hitting face of the barrel, different vibrational characteristics than the hitting face of the barrel (for example, vibration passed to the player's hands responsive to striking a ball outside the sweet spot during game play), or different weight characteristics than the hitting face of the barrel (for example, lower density materials in the non-hitting face than the hitting face, such as aluminum foam disposed in the non-hitting face and a composite material such as carbon fiber or fiberglass disposed in the hitting face). Characteristic-modifying sheets are preferably made as disclosed regarding the insert 142 or the characteristic-modifying sheet 156.

The term "outward" refers to being closer to the outer surface of the barrel than a comparative element. For example, a first layer that is disposed outward of a second layer is disposed closer to the outer surface of the barrel than the second layer. Conversely, the term "inward" refers to being closer to the longitudinal axis of the barrel than a comparative element. For example, when the barrel wall bends inward, the barrel wall moves closer to the longitudinal axis of the barrel.

The term "similar" in the context of one element being similar to another refers to the elements sharing one or more functions, features, components, characteristics, configurations, materials, or methods of manufacturing. The term "variety of longitudinal arrangements" refers to the component being configured to one or more of the following: (i) longitudinally extend from the distal end portion of the barrel to the proximal end portion, a position between the distal end portion and the sweet spot, a position in the sweet spot, or a position between the sweet spot and the proximal end portion; (ii) longitudinally extend from a position between the distal end portion of the barrel and the sweet spot to the proximal end portion, another position between the distal end portion and the sweet spot, a position in the sweet spot, or a position between the sweet spot and the proximal end portion; (iii) longitudinally extend from a position in the sweet spot to the proximal end portion of the barrel or a position between the proximal end portion and the sweet spot; or (iv) longitudinally extend from a position between the proximal end portion of the barrel and the sweet spot to another position between the proximal end portion and the sweet spot or to the proximal end portion. The term "longitudinally extend" refers to the position or length of the component as measured along the longitudinal axis of the barrel. The term "variety of radial arrangements" refers to the component being configured to one or more of the following: (i) be disposed on the inner surface of the barrel shell; (ii) be disposed on the outer surface of the barrel shell; (iii) be disposed between layers of the barrel shell; or (iv) define an entirety of the thickness of a portion of the barrel. The term "variety of circumferential arrangements" refers to the component being configured to one or more of the following: (i) be circumferentially centered in the non-hitting face of the barrel; (ii) be circumferentially offset from the circumferential center in the non-hitting face of the barrel; or (iii) circumferentially extend across an entirety or only a portion of the inner and outer circumference of the non-hitting face of the barrel, such as no more than or at least 10, 20, 30, 40, 50, 60, 70, 80, or 90 percent of such circumferences. The term "circumferentially extend" refers to position or length of the component as measured around the longitudinal axis of the barrel. The term "variety of closed arrangements" refers to a void being closed along the inner surface or the outer surface of the barrel, such as with a characteristic-modifying component being disposed in the void, in one or more of the following manners: (i) one or more layers disposed inward or outward of the void being the same as or similar to the layers in one or more other portions of the barrel; (ii) one or more layers disposed inward or outward of the void including one or more plies having substantially longitudinally extending fiber bundles; or (iii) one or more layers disposed inward or outward of the void including one or more plies having chopped and randomly oriented fibers in a polymer matrix. Any of the voids described herein may be closed in any one of a variety of closed arrangements. Each of the inserts or characteristic-modifying sheets described herein may be configured in a variety of longitudinal arrangements, variety of radial arrangements, or variety of circumferential arrangements.

The term "default configuration" in the context of the barrel refers to the barrel at rest with no non-ambient forces acting on the barrel, such as the barrel striking a baseball or softball. The terms "distal" and "proximal" are defined relative to the longitudinal axis of the bat or barrel when fully assembled. The term "distal" means at or more toward the farthest portion of the described component from the portion of the bat that is held during game play, such as the handle. The term "proximal" means at or near the closest portion of the described component to the portion of the bat that is held by the player during gameplay, such as the handle. For example, for a bat that has an end cap, the end cap is disposed at the distal end portion of the bat or barrel. As another example, the transition portion of the barrel is disposed at the proximal end portion of the barrel. As a further example, a knob coupled to or defined by the handle is typically disposed at the proximal end portion of the bat.

While the preferred embodiment of the invention has been illustrated and described, as noted above, many changes can be made without departing from the spirit and scope of the invention. For example, any of the inserts or characteristic-modifying sheets described herein may be disposed or arranged in the manner of any other insert or characteristic-modifying sheet described herein or combined with any other insert or characteristic-modifying sheet described herein. As another example, each component described herein may include one or more materials described with respect to one or more other components described herein. As a further example, each disclosure of a component preferably having a feature or characteristic is intended to also disclose the component as being devoid of that feature or characteristic, unless the principles of the invention clearly dictate otherwise. As another example, each version described herein that facilitates reducing the weight of the bat for a given length may also be described as influencing the drop weight of the bat in a corresponding manner (measured by subtracting the bat weight in ounces from the bat length in inches). As a further example, each version described herein may be arranged with any combination of handle, barrel, endcap, knob, barrel/handle connection, assembly, or material such as an alloy barrel with a composite handle. Accordingly, the scope of the invention is not limited by the disclosure of the preferred embodiment. Instead, the invention should be determined entirely by reference to the claims that follow. It should also be noted that the claim dependencies or combinations of elements recited in the claims does not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (for example, "The bat of any one of the preceding or subsequent claims . . . "). This disclosure is also intended to disclose the subject matter of any one of the dependent claims, as if it was an independent claim, with or without all or a portion of the subject matter of the original independent claim(s) or any other subject matter disclosed herein.

We claim:

1. A softball or baseball bat comprising:

a handle having a proximal end and a distal end portion; and a barrel coupled to the distal end portion of the handle, the barrel defining a longitudinal axis, the barrel having asymmetrical composition or construction about the longitudinal axis of the barrel, wherein the barrel has a hitting face and a non-hitting face, the bat having one or more characteristics that induce a player to grip the bat with a substantially same orientation when the player makes a full swing and hits a ball with the barrel during the full swing such that the hitting face contacts the ball during the full swing and such that the non-hitting face does not contact the ball during the full swing, wherein the hitting face defines a first external surface of the barrel and has a first weight, the first external surface having a first surface area, wherein the non-hitting face defines a second external surface of the barrel and has a second weight, the second external surface having a second surface area, wherein the barrel defines an external circumference that consists of the hitting face and the non-hitting face, a majority of the external circumference consisting of the hitting face, a minority of the external circumference consisting of the non-hitting face, wherein a ratio of the second weight to the second surface area is less than a ratio of the first weight to the first surface area, whereby a moment of inertia of the bat is equal to or less than a moment of inertia of another bat having a same length as the bat, having another handle with a same length, composition, and construction as the handle, and having another barrel with a same length as the barrel, with another longitudinal axis, with symmetrical composition and construction about the other longitudinal axis, and with the composition and construction of the other barrel matching a composition and construction of the hitting face, wherein the moment of inertia of the bat is measured with reference to pivoting of the bat about a pivot point on the handle and is measured on a side of the pivot point on the handle that the barrel is disposed, the pivot point on the handle being disposed a distance from the proximal end of the handle, the pivoting of the bat being about a first pivot axis that is perpendicular to the longitudinal axis of the bat and that intersects the pivot point on the handle, wherein the moment of inertia of the other bat is measured with reference to pivoting of the other bat about a pivot point on the other handle and is measured on a side of the pivot point on the other handle that the other barrel is disposed, the other handle having a proximal end and a distal end portion, the other barrel being coupled to the distal end portion of the other handle, the pivot point on the other handle being disposed the distance from the proximal end of the other handle, the pivoting of the other bat being about a second pivot axis that is perpendicular to the longitudinal axis of the other bat and that intersects the pivot point on the other handle.

2. The bat of claim 1, wherein one or more portions of the non-hitting face have a different thickness than one or more portions of the hitting face.

3. A softball or baseball bat comprising:

a handle; and a barrel coupled to the handle, the barrel defining a longitudinal axis, the barrel having asymmetrical composition or construction about the longitudinal axis of the barrel, wherein the barrel has a hitting face and a non-hitting face, the bat having one or more characteristics that induce a player to grip the bat with a substantially same orientation when the player swings and hits a ball with the barrel such that the hitting face contacts the ball when the player swings the bat and such that the non-hitting face does not contact the ball when the player swings the bat, wherein the hitting face defines a first external surface of the barrel and has a first weight, the first external surface having a first surface area, wherein the non-hitting face defines a second external surface of the barrel and has a second weight, the second external surface having a second surface area, wherein a ratio of the second weight to the second surface area being less than a ratio of the first weight to the first surface area, whereby a moment of inertia of the bat is equal to or less than a moment of inertia of another bat having a same length as the bat and having another barrel with a same length as the barrel, with another longitudinal axis, with symmetrical composition and construction about the other longitudinal axis, and with the composition and construction of the other barrel matching a composition and construction of the hitting face, wherein the non-hitting face includes one or more materials that are absent from the hitting face.

4. A softball or baseball bat comprising:

a handle; and a barrel coupled to the handle, the barrel defining a longitudinal axis, the barrel having asymmetrical composition or construction about the longitudinal axis of the barrel, wherein the barrel has a hitting face and a non-hitting face, the bat having one or more characteristics that induce a player to grip the bat with a substantially same orientation when the player swings and hits a ball with the barrel such that the hitting face contacts the ball when the player swings the bat and such that the non-hitting face does not contact the ball when the player swings the bat, wherein the hitting face defines a first external surface of the barrel and has a first weight, the first external surface having a first surface area, wherein the non-hitting face defines a second external surface of the barrel and has a second weight, the second external surface having a second surface area, wherein a ratio of the second weight to the second surface area being less than a ratio of the first weight to the first surface area, whereby a moment of inertia of the bat is equal to or less than a moment of inertia of another bat having a same length as the bat and having another barrel with a same length as the barrel, with another longitudinal axis, with symmetrical composition and construction about the other longitudinal axis, and with the composition and construction of the other barrel matching a composition and construction of the hitting face, wherein the barrel includes a barrel shell that defines the hitting face, the non-hitting face including an insert coupled to the barrel shell.

5. The bat of claim 4, wherein the insert includes a characteristic-modifying sheet.

6. The bat of claim 4, wherein the insert includes a shaft.

7. The bat of claim 4, wherein the barrel shell defines an opening or void disposed in the non-hitting face, the insert being at least partially disposed in the opening or void of the barrel shell.

8. A softball or baseball bat comprising:

a handle; and a barrel coupled to the handle, the barrel defining a longitudinal axis, the barrel having asymmetrical composition or construction about the longitudinal axis of the barrel, wherein the barrel has a hitting face and a non-hitting face, one or more portions of the non-hitting face having a different composition or construction than one or more portions of the hitting face, wherein the barrel includes a barrel shell that defines the hitting face, the non-hitting face including an insert coupled to the barrel shell, wherein the insert includes a spine cap, wherein the barrel has a center of gravity that is disposed a first distance from the hitting face and a second distance from the insert, the second distance being at least as large as the first distance.

9. A baseball or softball bat, comprising:

a handle; and a barrel coupled to the handle, the barrel defining a longitudinal axis, the barrel comprising:

a hitting face that defines a portion of an external surface of the barrel about a circumference of the barrel and that is configured to strike a ball during game play; and a non-hitting face that defines a portion of the external surface of the barrel about the circumference of the barrel, wherein one or more portions of the non-hitting face has a different construction or composition than the hitting face, and the different construction or composition of the non-hitting face is configured to reduce vibration passed from the barrel to a player's hands when the hitting face strikes a ball, wherein the bat has one or more characteristics that induce a player to grip the bat with a substantially same orientation when the player swings and hits the ball with the barrel such that the hitting face contacts the ball when the player swings the bat and such that the non-hitting face does not contact the ball when the player swings the bat.

10. The bat of claim 9, wherein the non-hitting face includes one or more materials that are absent from the hitting face.

11. The bat of claim 9, wherein one or more portions of the non-hitting face have a different thickness than one or more portions of the hitting face.

12. The bat of claim 9, further comprising a barrel shell that defines the hitting face, the non-hitting face including an insert coupled to the barrel shell.

13. The bat of claim 12, wherein the insert includes a characteristic-modifying sheet.

14. The bat of claim 9, wherein the barrel has a length and a weight, the weight of the barrel being equal to or less than a weight of another barrel with a same length as the barrel, with another longitudinal axis, with symmetrical composition and construction about the other longitudinal axis, and with the composition and construction of the other barrel matching a composition and construction of the hitting face.

15. The bat of claim 9, wherein the hitting face defines a first portion of the external surface of the barrel and has a first weight, the first portion of the external surface having a first surface area, wherein the non-hitting face defines a second portion of the external surface of the barrel and has a second weight, the second portion of the external surface having a second surface area, wherein a ratio of the second weight to the second surface area is equal to or less than a ratio of the first weight to the first surface area.

16. A softball or baseball bat comprising:

a handle; and a barrel coupled to the handle, the barrel defining a longitudinal axis, the barrel having asymmetrical composition or construction about the longitudinal axis of the barrel, wherein the barrel has a hitting face and a non-hitting face, the bat having one or more characteristics that induce a player to grip the bat with a substantially same orientation when the player swings and hits a ball with the barrel such that the hitting face contacts the ball when the player swings the bat and such that the non-hitting face does not contact the ball when the player swings the bat, wherein the hitting face defines a first external surface of the barrel and has a first weight, the first external surface having a first surface area, wherein the non-hitting face defines a second external surface of the barrel and has a second weight, the second external surface having a second surface area, wherein a ratio of the second weight to the second surface area is less than a ratio of the first weight to the first surface area, wherein the one or more characteristics that induce the player to grip the bat with the substantially same orientation include a shape of the handle, wherein the handle is asymmetric about the longitudinal axis and at least one of:

(i) protrudes a first distance away from the longitudinal axis on a same side of the longitudinal axis as the hitting face and protrudes a second distance away from the longitudinal axis on a same side of the longitudinal axis as the non-hitting face, wherein the first distance is greater than the second distance; or (ii) defines a substantially flat surface that intersects the longitudinal axis on a side of the handle opposite from the barrel, wherein the surface has a first portion that is disposed on the same side of the longitudinal axis as the hitting face and has a second portion that is disposed on the same side of the longitudinal axis as the non-hitting face, wherein the first portion is closer to the barrel than the second portion.

17. A softball or baseball bat comprising:

a handle; and a barrel coupled to the handle, the barrel defining a longitudinal axis, the barrel having asymmetrical composition or construction about the longitudinal axis of the barrel, wherein the barrel has a hitting face and a non-hitting face, the bat having one or more characteristics that induce a player to grip the bat with a substantially same orientation when the player swings and hits a ball with the barrel such that the hitting face contacts the ball when the player swings the bat and such that the non-hitting face does not contact the ball when the player swings the bat, wherein the hitting face defines a first external surface of the barrel and has a first weight, the first external surface having a first surface area, wherein the non-hitting face defines a second external surface of the barrel and has a second weight, the second external surface having a second surface area, wherein a ratio of the second weight to the second surface area is less than a ratio of the first weight to the first surface area, wherein the hitting face has a higher bat-ball coefficient of restitution (BBCOR) than the non-hitting face.

* * * * *